US007094526B2

(12) United States Patent
Ando et al.

(10) Patent No.: US 7,094,526 B2
(45) Date of Patent: Aug. 22, 2006

(54) SILVER SALT PHOTOTHERMOGRAPHIC DRY IMAGING MATERIAL AND PRODUCTION METHOD OF THE SAME

(75) Inventors: Hiroaki Ando, Hino (JP); Kazuhito Ihara, Hachioji (JP); Shinichi Karakata, Hachioji (JP); Kazuyoshi Shioiri, Kyoto (JP)

(73) Assignee: Konica Minolta Medical & Graphic, Inc, Tokyo (JP)

( * ) Notice: Subject to any disclaimer, the term of this patent is extended or adjusted under 35 U.S.C. 154(b) by 0 days.

(21) Appl. No.: 10/976,005

(22) Filed: Oct. 28, 2004

(65) Prior Publication Data

US 2005/0095541 A1 May 5, 2005

(30) Foreign Application Priority Data

Nov. 5, 2003 (JP) ..... 2003-375349
Dec. 19, 2003 (JP) ..... 2003-422484

(51) Int. Cl.
*G03C 1/00* (2006.01)
*G03C 1/005* (2006.01)
*G03C 1/494* (2006.01)

(52) U.S. Cl. ..... 430/617; 430/618; 430/619; 430/620; 430/627

(58) Field of Classification Search ..... 430/617, 430/618, 619, 620, 627
See application file for complete search history.

(56) References Cited

U.S. PATENT DOCUMENTS 6,350,561 B1 * 2/2002 Miller et al. ..... 430/619
6,420,102 B1 * 7/2002 Bauer et al. ..... 430/350

* cited by examiner

*Primary Examiner*—Geraldine Letscher
(74) *Attorney, Agent, or Firm*—Lucas & Mercanti, LLP

(57) ABSTRACT

A photothermographic imaging material containing a support having thereon photosensitive silver halide grains, light-insensitive organic silver salt grains, a reducing agent for silver ions and polymer, wherein and average particle size of the photosensitive silver halide grains is 0.005 to 0.1 μm, and the polymer dissolves both in water and in an organic solvent.

11 Claims, 1 Drawing Sheet

SILVER SALT PHOTOTHERMOGRAPHIC DRY IMAGING MATERIAL AND PRODUCTION METHOD OF THE SAME

FIELD OF THE INVENTION

The present invention relates to a silver salt photothermographic dry image material which results in high density and exhibits excellent image retention properties against light irradiation as well as excellent silver color tone, a production method of the same, and an image recording method as well as an image forming method using the same.

BACKGROUND OF THE INVENTION

Heretofore, in the medical and printing plate-making fields, effluent generated by the wet process of image forming materials has resulted in problems for workability. In recent years, it has increasingly been demanded to reduce the processing effluent in view of environmental protection and space saving. Accordingly, silver salt photothermographic dry imaging materials capable of forming images by application of only heat have been practiced and increasingly employed in the aforesaid fields. Silver salt photothermographic dry imaging materials themselves (hereinafter referred to as heat developable materials or simply as light-sensitive materials) were proposed a relatively long time ago (refer, for example, to Patent Documents 1 and 2).

However, it has been difficult to disperse, into organic solvents, conventional light-sensitive silver halide grains which are prepared employing gelatin as a protective colloid. As a result, it has been difficult to mix the above grains with polymers dissolved in organic solvents or organic silver particles dispersed in organic solvents. On account of that, it has been required that light-sensitive silver halide grains are previously mixed during a process in which organic silver salts are prepared in an aqueous system and after drying, organic silver particles are dispersed into organic solvents. Due to that, when a relatively large force is applied to the dispersion of organic silver salts, silver halide grains are damaged, whereby problems occur in which restrictions are applied to dispersion of organic silver salts.

An example is proposed in which silver halide grains are prepared employing synthetic hydrophilic polymers instead of gelatin and polymers having an amino group are employed so that the resulting silver halide grains can be dispersed into organic solvents. However, the use of such an amino group accelerates Ostwald ripening of silver halide, and it becomes difficult to decrease the size of silver halide grains. In addition, by making the amino group hydrophobic, grains are subjected to sedimentation, whereby desalting is carried out. In order to do so, it is necessary to raise the pH to at least 8, whereby problems occur in which fog of silver halide grains increases. As a result, in practice, the above proposal has not been suitable as a means to enhance photographic speed, to retard fog, and to improve silver color tone (refer, for example, to Parent Documents 3 and 4).

| | |
|---|---|
| (Patent Document 1) | U.S. Pat. No. 3,152,904 |
| (Patent Document 2) | U.S. Pat. No. 3,457,075 |
| (Patent Document 3) | Japanese Patent Publication Open to Public Inspection (hereinafter referred to as JP-A) No. 47-9179 |
| (Patent Document 4) | U.S. Pat. No. 3,748,143 |

SUMMARY OF THE INVENTION

In view of the foregoing problems, an object of the present invention was decided. The object is to provide a silver salt photothermographic dry imaging material which exhibits high photographic speed, low fog, improved silver color tone, and excellent image retention properties against light irradiation, as well as a production method of the same.

The object of the present invention can be achieved by the following embodiments.

A feature of the present invention is a photothermographic imaging material containing a support having thereon photosensitive silver halide grains, light-insensitive organic silver salt grains, a reducing agent for silver ions and a polymer, wherein an average particle size of the photosensitive silver halide grains is a sub-micron order and the polymer is capable of dissolving both in water and in an organic solvent.

Based on the present invention, it is possible to provide a silver salt photothermographic dry imaging material which exhibits high photographic speed, results in retardation of fog formation, exhibits improved silver color tone and excellent lightfastness of images, as well as a production method of the same.

PREFERRED EMBODIMENTS OF THE INVENTION

Figure 1:
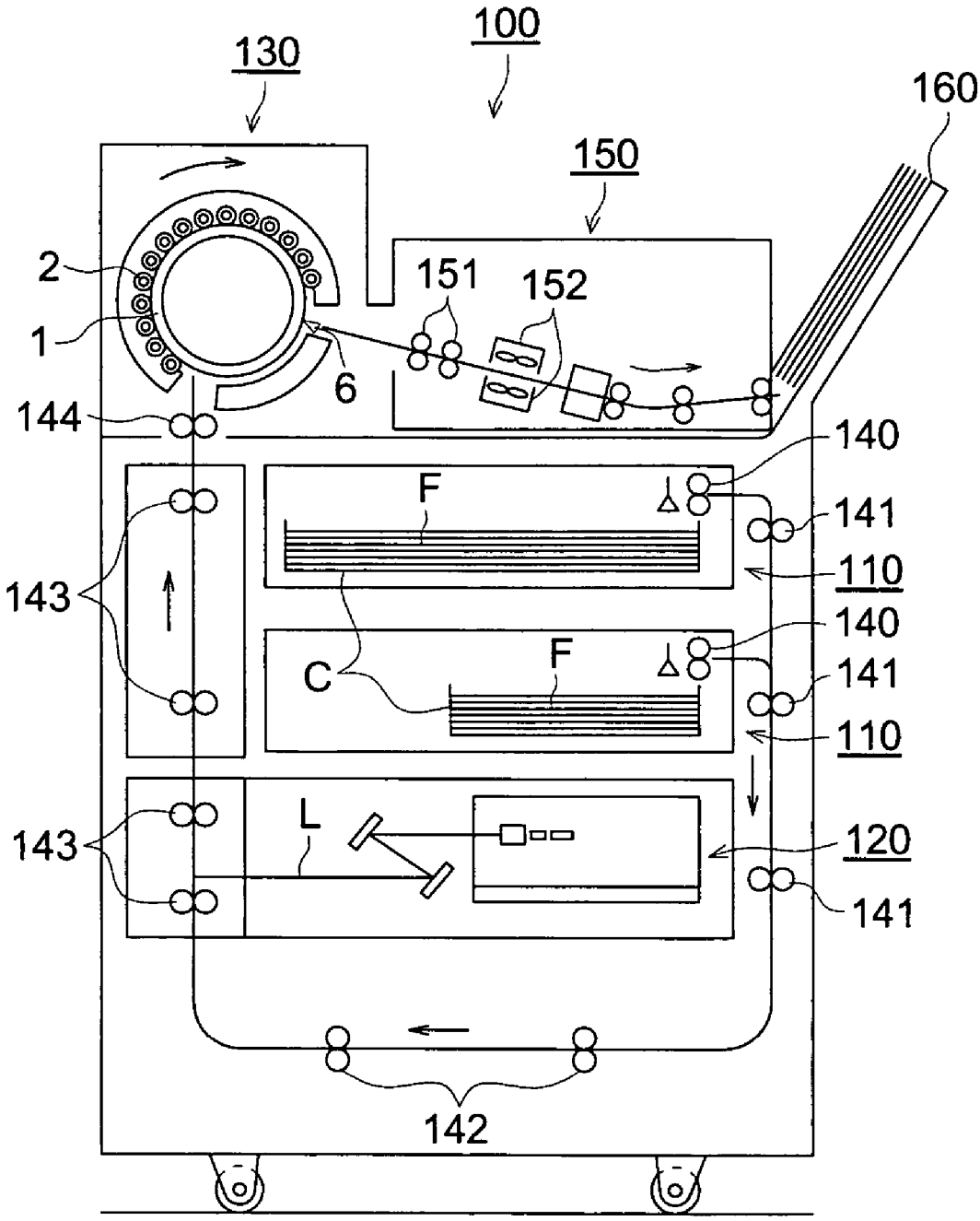
FIG. 1 is a sectional view showing a specific example of the constitution of a heat developable processor.

The preferred embodiments of the present invention are as follows.

(1) An embodiment of the present invention includes a photothermographic imaging material comprising a support having thereon photosensitive silver halide grains, light-insensitive organic silver salt grains, a reducing agent for silver ions and a polymer, wherein an average particle size of the photosensitive silver halide grains is 0.005 to 0.1 μm, and the polymer dissolves both in water and in an organic solvent.

(2) Another embodiment of the present invention includes a photothermographic imaging material of Item 1, wherein the photosensitive silver halide grains contain AgBr in an amount of not less than 50 weight % based on the total weight of the photosensitive silver halide grains.

(3) Another embodiment of the present invention includes a photothermographic imaging material of Item-1 or Item 2, wherein the polymer has a solubility in water at 25° C. of not less than 1 weight %, and has a solubility in methyl ethyl ketone at 25° C. of not less than 5 weight %.

(4) Another embodiment of the present invention includes a photothermographic imaging material of any one of Items 1 to 3, wherein the polymer has a molecular weight of 3000 to 200000.

(5) Another embodiment of the present invention includes a photothermographic imaging material of any one of Items 1 to 4, wherein the polymer contains a group represented by the following formula:

$$-(EO)_l-(PO)_m-(TO)_n-R$$

wherein E is an ethylene group; P is a propylene group; T is a butylene group; R is a substituent; 1 is an integer of 1 to 300; m is an integer of 0 to 60; and n is an integer of 0 to 40, provided that $1+m+n \geqq 2$.

(6) Another embodiment of the present invention includes a photothermographic imaging material of any one of Items 1 to 5, wherein the polymer has an amide group in the molecule.

(7) Another embodiment of the present invention includes a photothermographic imaging material of any one of Items 1 to 6, wherein the polymer contains a group selected from the group consisting of a straight chain or branched chain alkyl group having 4 to 22 carbon atoms, an aryl group and a heterocylic group having a ring size of not less than 5.

(8) Another embodiment of the present invention includes a photothermographic imaging material of any one of Items 1 to 7, wherein the polymer has an isoelecrtic point in water at 25° C. of not more than pH 6.

(9) Another embodiment of the present invention includes a photothermographic imaging material of any one of Items 1 to 8, wherein the polymer has an carboxyl group in the molecule.

(10) Another embodiment of the present invention includes a method of producing the photothermographic imaging material of any one of Items 1 to 9, comprising the steps of:

(i) preparing the photosensitive silver halide grains in a water-based solvent containing the polymer capable of dissolving both in water and in an organic solvent;

(ii) dispersing the prepared photosensitive silver halide grains into the organic solvent so as to obtain a first coating composition;

(iii) preparing a second coating composition containing the light-insensitive organic silver salt grains and the reducing agent for silver ions;

(iv) mixing the first coating composition and the second coating composition to obtain a coating mixture; and (v) applying the coating mixture onto the support to obtain a layer; and (vi) drying the layer.

(11) Another embodiment of the present invention includes a production method of Item 10, further comprising the step of:

desalting the photosensitive silver halide grains in the water-based solvent containing the polymer prior to the dispersing step (ii).

(12) Another embodiment of the present invention includes a production method of Item 11, wherein the desalting step is carried out using an aggregation precipitation method.

(13) Another embodiment of the present invention includes a production method of Item 11, wherein the desalting step is carried out using a membrane separation method.

(14) Another embodiment of the present invention includes a production method of any one of Items 10 to 13, wherein the mixing step (iv) is carried out just prior to the applying step (v).

(15) Another embodiment of the present invention includes a photothermographic imaging material of Item 1, wherein a variation coefficient in a size of the photosensitive silver halide grains is from 0 to 30%.

(16) Another embodiment of the present invention includes a photothermographic imaging material of Item 1, wherein a dispersion degree of the photosensitive silver halide grains is not more than 80%.

Each of the constitution elements related to the present invention will now be sequentially described.

The silver salt photothermographic dry imaging material of the present invention incorporates a support having thereon a light-sensitive layer containing light-insensitive aliphatic carboxylic acid silver salt particles, light-sensitive emulsions containing light-sensitive silver halide grains, silver ion reducing agents, and binders.

Initially described will be light-sensitive emulsions containing light-sensitive silver halide grains.

In the silver salt photothermographic dry imaging material of the present invention, the average grain diameter of the light-sensitive emulsion is at most 0.1 μm and is preferably 0.005–0.08 μm. As used herein, the term "average grain diameter" refers to the following. Silver halide grains may be in the form of normal crystals such as a cube or an octahedron, or may also not be in the form of normal crystals such as a spherical grain or a rod-shaped grain. In such a case, the diameter of a silver halide grain refers to the diameter of a sphere which has the same volume as that of the silver halide grain, being a so-called equivalent spherical diameter. Incidentally, in the case in which a silver halide grain is tabular, its diameter refers to the diameter of a circle which has the same area as the projected area of the primary surface. The diameter of each of 1,000 grains is determined employing an electron microscope and the resultant values are averaged.

A preferable value of a variation coefficient in a size of silver halide grains is 0 to 30%, and more preferably, is 0 to 20%. The variation coefficient indicates a degree of a distribution of grains and can be calculated by dividing a standard deviation value of an equivalent circular diameter by an average particle diameter.

The added amount of light-sensitive silver halide is preferably 0.01–1.0 g per $m^2$ of the heat developable material in terms of coated silver, is more preferably 0.01–0.4 $g/m^2$, and is most preferably 0.01–0.2 $g/m^2$.

The grain size and added amount of light-sensitive silver halide are controlled to satisfy the above conditions so that photographic performance is improved, density is enhanced under the same silver amount, and haze is reduced to enhance image quality. When the grain size is less than 0.005 μm, photographic speed decreases markedly. Further, when the size of silver halide grains is simply reduced, silver halide grains themselves tend to coagulate during the preparation process of silver halide grains, as well as during the preparation process with organic silver salts. As a result, the grain size distribution is markedly broadened, and it is not possible to sufficiently lower haze. Further, when the grain size exceeds 0.1 μm, haze is particularly pronounced. When the silver coated amount is less than 0.01 $g/m^2$, targeted functions as heat developable materials are not fully obtained, whereby sufficient photographic performance is not achieved. On the other hand, when it exceeds 1.0 $g/m^2$ haze becomes problematic.

Employed as silver halide usable in the present invention may be silver chlorobromide, silver bromide, silver iodobromide, and silver iodochloride. It is preferable that Br is at least 50 percent by weight with respect to the total halogen composition. When silver chloride is excessively large, Ostwald ripening tends to be accelerated to result in an increase in the grain size. On the other hand, when silver iodide is excessively large, photographic speed of silver halide grains decrease. As a result, both are not preferred.

The distribution of the halogen composition in a grain may be uniform, and the halogen composition may vary stepwise or gradually. Further, it preferable to use silver halide grains having a core/shell structure. Preferred as such a structure is one which is composed of 2- to 5-fold halogen composition. It is possible to more preferably employ 2- to 4-fold structured core/shell grains. Further, it is possible to employ techniques in which silver bromide, silver iodobromide and silver iodide are localized on the surface of silver chlorobromide.

In the present invention, the production method of silver salt photothermographic dry imaging materials may be such that polymers, which are soluble in both water and organic solvents may be added during preparation of organic silver salts or may be added immediately before formation of organic silver salt particles, and in addition, various types of components may be mixed and then coated. However, it is specifically preferable that production is carried out in such a manner that light-sensitive silver halide grains are prepared in water-based solvents, employing polymers which are soluble in both water and organic solvents as a protective colloid, and thereafter, dispersed into organic solvents, and then applied onto a support together with organic silver salts and silver ion reducing agents. It is preferable that the time from being mixed with the organic silver salts and silver ion reducing agents, to coating is as short as possible. The above period is preferably less than two hours, and is more preferably at most 30 minutes. Further, it is preferable that silver halide grains are desalted and dried before being dispersed into organic solvents.

Employed as methods for forming light-sensitive silver halide may be prior art methods, for example, described in Item 17029 of Research Disclosure, June 1978 and U.S. Pat. No. 3,700,458. It is possible to use gelatin and polymers known in the art, and it is also possible to use all methods and devices for forming grains by replacing all, or only some part, with polymers of the present invention.

Specifically, light-sensitive silver halide is prepared by adding silver supplying compounds and halogen supplying compounds to the polymer solution of the present invention. Particularly preferred is a method in which grains are formed by adding an aqueous silver ion solution and an aqueous halide solution employing a double jet method.

The polymers of the present invention may be any of the natural resins or polymers and copolymers, as well as synthetic resins, or polymers and copolymers. For example, employed may be various types of gelatin, various types of rubber, as well as those which are prepared by modifying gelatin and rubber to be included in the category of the present invention. Alternatively, it is possible to use polymers which belong to the classification described below by introducing a functional group to be suitable for the present invention: poly(vinyl alcohols), hydroxyethylcellulose, cellulose acetates, cellulose acetate butyrates, poly(vinylpyrrolidones), casein, starch, poly(acrylic acids and acrylates), poly(methylmethacrylic acid and methacrylates), poly(vinyl chlorides), poly(methacrylic acids), styrene-maleic anhydride copolymers, styrene-acrylonitrile copolymers, styrene-butadiene copolymers, poly(vinyl acetals) (e.g., poly (vinyl formal) and poly(vinyl butyral)), poly(esters), poly (urethanes), phenoxy resins, poly(vinylidene chlorides), poly(epoxides), poly(carbonates), poly(vinyl acetates), poly (olefins), cellulose esters, and poly(amides). Some types of these polymers may form copolymers. However, polymers are preferred which are prepared by particularly copolymerize acrylic acid, methacrylic acid, or monomers of esters thereof.

Polymers in the present invention, which are soluble in both water and organic solvents, may be those which are soluble in both water and organic solvents in the same state, but also include those which are soluble either in water or in organic solvents by controlling the pH or temperature or insoluble in either of them. For example, the phenomena of a cloud point are well known for nonionic surface active agents. The present invention includes polymers which are heated to become oleophilic, resulting in solubility in organic solvents, and are cooled to become hydrophilic, resulting in becoming soluble in water. Surface active agents need not be completely dissolved but may be usable when they are uniformly emulsified while forming micelles. Alternatively, some types of polymers having an acidic group, such as a carboxylic acid, become hydrophilic in a dissociated state. However, when a non-dissociated state is formed by lowering the pH, they become oleophilic and can then be dissolved in solvents. On the contrary, polymers having an amino group becomes oleophilic when the pH is increased, while when the pH is lowered, they become ionized to be more soluble in water. In the present invention, various monomers are simultaneously employed. Since various types of monomers are combined, it is not possible to generally describe preference of the type of monomers and the amount thereof. However, it is easily understood that when hydrophilic monomers and hydrophobic monomers are combined at an appropriate ratio, desired polymers are obtained.

It is preferable that polymers which are soluble in both water and organic solvents exhibit solubility in water of at least one percent by weight (at 25° C.) when dissolving conditions such as pH, as described above are controlled or may not be controlled, and solubility in methyl ethyl ketone as an organic solvent of at least 5 percent by weight (at 25° C.).

In view of solubility, as polymers according to the present invention which are soluble in both water and organic solvents, so-called block polymers and graft polymers are more suitable than straight chain polymers, and graft polymers are particularly preferred. When such graft polymers are produced, it is possible to use various types of methods. It is desirable to use monomers which are subjected to introduction of a side chain, at a molecular weight of at least 200 to the side chain. In particular, it is preferable to use ethylenic unsaturated monomers containing a polyoxyalkylene group such as ethylene oxides or propylene oxides.

Preferred as ethylenic unsaturated monomers containing a polyoxyalkylene group are those having the polyoxyalkylene group, represented particularly by the general formula described below.

$$-(EO)_l-(PO)_m-(TO)_n-R$$

wherein E represents an ethylene group, P represents a propylene group, T represents a butylene group; R represents a substituent, the butylene group includes a tetramethylene group, and an isobutylene group, l represents an integer of 1 to 300, m represents an integer of 0 to 60, and n represents an integer of 0 to 40, and l is preferably 1 to 200, m is preferably 0 to 30, n is preferably 0 to 20, and $l+m+n \geqq 2$.

R represents a substituent such as an alkyl group, an aryl group, or a heterocyclic group. The alkyl group includes a methyl group, an ethyl group, a propyl group, a butyl group, a hexyl group, an octyl group, and a dodecyl group; the aryl group includes a phenyl group and a naphthyl group; and the heterocyclic group includes a thienyl group and a pyridyl group. Further, these groups may be substituted with a halogen atom, an alkoxy group (a methoxy group, an ethoxy group, or a butoxy group), an alkylthio group (a methylthio group and a butylthio group), an acyl group (an acetyl group and a benzoyl group), an alkanamide group (an acetamide group and a propionamide group), and an arylamide group (a benzoylamide group). Further, these substituents may be substituted with any of the above groups.

By employing these ethylenic unsaturated monomers having a polyoxyalkylene group, it is possible to introduce that polyoxyalkylene group into polymers. Examples of ethylenic unsaturated monomers having any of these groups include (polyoxyalkylene)acrylate and methacrylate. It is possible to produce them by allowing commercially available hydroxypoly(oxyalkylene) materials such as Pluronics, a trade name (produced by Asahi Denka Kogyo K.K.), Adeka Polyether (produced by Asahi Denka Kogyo K.K.), Carbowax (Glyco Products), Triton (produced by Rohm and Haas), and P.E.G. (produced by Dai-Ichi Kogyo Seiyaku Co., Ltd.) to react with acrylic acid, methacrylic acid, acrylchloride, methacrylchloride, or acrylic anhydride, employing prior art methods. Separately, it is possible to use poly(oxyalkylene)diacrylate which are produced employing prior art methods.

Further, listed as commercially available monomers are Blenmer PE-90, Blenmer PE-200, Blenmer PE-350, Blenmer AE-90, Blenmer AE-200, Blenmer AE-400, Blenmer PP-1000, Blenmer PP-500, Blenmer PP-800, Blenmer AP-150, Blenmer AP-400, Blenmer AP-550, Blenmer AP-800, Blenmer 50PEP-300, Blenmer 70PEP-350B, the Blenmer AEP Series, Blenmer 55PET-400, Blenmer 30PET-800, Blenmer 55PET-800, the Blenmer AET Series, Blenmer 30PPT-800, Blenmer 50PPT-800, Blenmer 70PPT-800, the Blenmer APT Series, Blenmer 10PPB-500B, and Blenmer 10APB-500B as hydroxyl group terminal polyalkylene glycol mono(meth)acrylate, all of which are produced by NOF Corp. In addition, listed as Alkyl terminal polyalkylene glycol mono(meth)acrylates are Blenmer PME-100, Blenmer PME-200, Blenmer PME-400, Blenmer PME-1000, Blenmer PME-4000, Blenmer AME-400, Blenmer 50POEP-800B, Blenmer 50AOEP-800B, Blenmer PLE-200, Blenmer ALE-200, Blenmer ALE-800, Blenmer PSE-400, Blenmer PSE-1300, the Blenmer ASEP Series, the Blenmer PKEP Series, the Blenmer AKEP Series, Blenmer ANE-300, Blenmer ANE-300, the Blenmer PNEP Series, the Blenmer PNPE Series, Blenmer 43ANEP-500, and Blenmer 70ANEP-550, all of which are produced by NOF Corp. as well as Light Ester MC, Light Ester 130MA, Light Ester 041MA, Light Acrylate BO-A, Light Acrylate EC-A, Light Acrylate MTG-A, Light Acrylate 130A, Light Acrylate DPM-A, Light AcrylateP-200A, Light Acrylate NP-4EA, and Light Acrylate NP-8EA, all of which produced by Kyoeisha Chemical Co., Ltd.).

In the present invention, it is possible to employ graft polymers using so-called macromers, which are described, for example, in "Shin Kobunshi Jikkengaku 2, Kobunshi no Gosei•Hanno (New Polymer Experiment Study 2, Synthesis and Reaction of Polymers)", Kyoritsu Shuppan Co., Ltd., 1955. Further, details are described in Yuya Yamashita, "Macromonomer no Kagaku to Kogyo (Chemistry and Industry of Macromonomers)", ABC, 1989. The molecular weight of macromonomers is preferably in the range of 400–100,000, is more preferably in the range of 1,000–50,000, and is most preferably in the range of 1,500–20,000. When the molecular weight is at most 400, it is not possible to achieve the desired effects, while when it is at least 100,000, polymerization with copolymerizable monomers, which form the main chain, is degraded. Specifically, it is possible to use AA-6, AS-6S, and AN-6s, produced by Toa Gosei Chemical Industry Co., Ltd.

Obviously, the present invention is not limited to the above specific examples. Ethylenic unsaturated monomers having a polyoxyalkylene group may be employed individually or in combinations of at least two types.

Listed as other specific monomers which are capable reacting with the above monomers are those listed below.

Acrylic acid esters: methyl acrylate, ethyl acrylate, propyl acrylate, chloroethyl acrylate, 2-hydroxyethyl acrylate, trimethylolpropane monoacrylate, benzyl acrylate, methoxybenzyl acrylate, furfuryl monoacrylate, and tetrahydrofurfuryl acrylate;

Methacrylic acid esters: methyl methacrylate, ethyl methacrylate, propyl methacrylate, chloroethyl methacrylate, 2-hydroxyethyl methacrylate, trimethylolpropane monomethacrylate, benzyl methacrylate, methoxybenzyl methacrylate, furfuryl methacrylate, and tetrahydrofurfuryl methacrylate.

acrylamides: acrylamide, N-alkylacrylamide (being an alkyl group having 1–3 carbon atoms, such as a methyl group, an ethyl group, or a propyl group), N,N-dialkylacrylamide, N-hydroxyethyl-N-methylscrylamode, or N-2-acetamidoethyl-N-acertylacrylamide, and further, as alkyloxyacrylamides, methoxymethylacrylamide and butoxymethylacrylamide;

methacrylamides: methacrylamide, N-alkylmethacrylamide, N-hydroxyethyl-N-methylmethacrylamide, N-2-acetamidoethyl-N-acetylmethacrylamide, methoxymethylmethacrylamide, and butoxymethylmethacrylamide;

allyl compound: allyl esters (e.g., allyl acetate, allyl caproate, allyl caprylate, allyl laurate, allyl palmitate, allyl stearate, allyl benzoate, allyl acetoacetate, and allyl lactate) and allyloxyethanol;

vinyl ethers: alkyl vinyl ethers (e.g., hexyl vinyl ether, octyl vinyl ether, decyl vinyl ether, ethylhexyl vinyl ether, methoxyethyl vinyl ether, decyl vinyl ether, ethylhexyl vinyl ether, methoxyethyl vinyl ether, ethoxyethyl vinyl ether, chloroethyl vinyl ether, 1-methyl-2,2-dimethylpropyl vinyl ether, 2-ethylbutyl vinyl ether, hydroxyethyl vinyl ether, diethylene glycol vinyl ether, diethylaminoethyl vinyl ether, diethylaminoethyl vinyl ether, butylaminoethyl vinyl ether, benzyl vinyl ether, and tetrahydrofurfuryl vinyl ether;

vinyl esters: vinyl butyrate, vinyl isobutyrate, vinyl trimethylacetate, vinyl diethylacetate, vinyl valerate, vinyl caproate, vinyl chloroacetate, vinyl dichloroacetate, vinyl methoxyacetate, vinyl butoxyacetate, vinyl dichloroacetate, vinyl methoxyacetate, vinyl butoxyacetate, vinyl lactate, vinyl-β-phenyl butyrate, and vinylcyclohexylcarboxylate;

dialkyl itaconates: dimethyl itaconate, diethyl itaconate, and dibutyl itaconate;

dialkyl and monoalkyl fumarates: dibutyl fumarate; and others: crotonic acid, itaconic acid, acrylonitrile, methacrylonitrile, maleironitrile, and styrene.

In cases in which an amide group, a straight or branched alkyl group having 4–22 carbon atoms, an aromatic group, or a 5-membered or higher membered heterocyclic group is introduced, of the aforesaid monomers or other monomers, monomers having these functional groups may be selected. For example, for the introduction of a 5-membered or higher membered heterocyclic group, it is possible to use 1-vinylimidazole or derivatives thereof. Further, an isocyanate group and an epoxy group are previously be introduced into polymers, and various other types of functional groups may be introduced into the above polymers by allowing them to react with any of alcohols and amines containing a straight or branched alkyl group, an aromatic group, or a 5-membered or higher membered heterocyclic group. In order to introduce isocyanate as well as epoxy, it is possible to use Karenz MOI (produced by Showa Denko K.K.) and Blenmer G (produced by NOF Corp.) In the present invention, it is also preferable to introduce a urethane bond.

In the present invention, it is preferable that the isoelectric point of polymers is achieved when the pH is at most 6. When polymers having a high isoelectric point are used, as described below, during desalting of silver halide grains employing a coagulation process, decomposition of silver halide grains is accelerated, whereby photographic performance is adversely affected. Further, when silver halide grains are dispersed into solvents, an increase in the pH is required to achieve desired dispersion, while an increase in the pH is not desired due to an increase in fog. The isoelectric point of polymers is determined, for example, by employing an isoelectric point electrophoresis method, or measuring the pH of a 1 percent aqueous solution which has been passed through a mixed bed of cationic and anionic ion exchange resins.

In order to lower the isoelectric point of polymers, it is possible to introduce various types of acidic groups. Examples include carboxylic and sulfonic acid groups. It is possible to introduce carboxylic acid by employing acrylic or methacrylic acid monomers, or also by partially hydrolyzing polymers containing methyl methacrylate. It is possible to introduce the sulfonic acid group by employing, as a monomer, styrenesulfonic acid or 2-acrylamido-2-methylolpropanesulfonic acid, or after preparation of polymers employing various types of sulfonation methods. Carboxylic acids are particularly preferably employed, since solubility in solvents is relatively high at a pre-neutralized state, and it is also possible to vary water solubility by neutralizing or semi-neutralizing. It is possible to achieve neutralization employing sodium or potassium salts, or organic salts of ammonia, ethanolamine, diethanolamine, or triethanol amine. It is also possible to employ imidazoles, triazoles, and amidoamines.

Polymerization may be carried out in the presence or absence of solvents. However, in view of workability, the presence of solvents is preferred. Listed as solvents are alcohols such as ethanol, isopropyl alcohol, n-butanol, isobutanol, or tert-butanol; ketones such as acetone, methyl ethyl ketone, methyl isobutyl ketone, or methyl amyl ketone; esters such as methyl acetate, ethyl acetate, butyl acetate, methyl lactate, ethyl lactate, or butyl lactate; monocarboxylic acid esters such as methyl 2-oxypropionate, ethyl 2-oxypropionate, propyl 2-oxypropionate, butyl 2-oxypropionate, methyl 2-methoxypropionate, ethyl 2-methoxypropionate, propyl 2-methoxypropionate, or butyl 2-methoxypropionate; polar solvents such as dimethylformamide, dimethylsulfoxide, or N-methylpyrrolidone; ethers such as methyl cellosolve, Cellosolve, butyl cellosolve, butylcarbitol, or ethyl cellosolve acetate; propylene glycols and esters thereof such as propylene glycol, propylene glycol monomethyl ether, propylene glycol monomethyl ether acetate, propylene glycol monomethyl ether acetate, or propylene glycol monobutyl ether acetate; halogen based solvents such as 1,1,1-tricholoethane or chloroform; ethers such as tetrahydrofuran or dioxane; aromatic compounds such as benzene, toluene, or xylene; and further, fluorinated inert liquid such as perfluoroctane or perfluoro-n-butylamine. Any of these is usable.

A drip polymerization method, in which polymerization is performed while monomers and initiators are dripped into a reaction vessel in response to polymerizability of each monomer, is effective to prepare uniform composition polymers. It is possible to remove unreacted monomers employing column filtration, re-precipitation purification, and solvent extraction. Alternatively, it is possible to remove low boiling point unreacted monomers employing stripping.

Other than the presence of solvents, it is possible to use polymer dispersion prepared by emulsion polymerization or suspension polymerization. Methods for preparing these polymers are described, for example, in Soichi Muroi, "Gosei Latex no Kagaku (Chemistry of Synthesized Latexes)", published by Kobunshi Kankokai, (1970).

The weight average molecular weight of polymers is preferably 3,000–200,000 in terms of a styrene conversion value determined by gel permeation chromatography (GPC), and is more preferably 5,000–100,000. When the molecular weight is at most 3,000, silver halide grains are not sufficiently dispersed, while when it is excessively large, the viscosity of the resultant dispersion increases excessively, whereby silver halide grains occasionally coagulate.

In the case in which the synthetic polymers of the present invention are acryl based polymers, in addition to common radical polymerization, it is possible to use various methods such as an ionic polymerization method or a living polymerization method. For example, it is possible to refer to "Kikan Kagaku Sosetsu 18 Seimitsu Jugo (Quarterly Chemical Review 18 Accurate Polymerization)", edited by Nihon Kagaku Kai, Planners and Editors; Tusneo Shimizu, Shohei Inoue, Yasuhiko Siroda, Shin Takushoku, and Toshinobu Higasimura. Employed as polymerization initiators and catalysts may be any of the materials known in the art.

Cited as shapes of silver halide grains may be cubic, octahedral and tetradecahedral grains, planar grains, spherical grains, rod-shaped grains, and roughly elliptical-shaped grains. Of these, cubic, and planar silver halide grains are particularly preferred.

When the aforesaid planar silver halide grains are employed, their average aspect ratio is preferably 100:1 to 2:1, is more preferably 50:1 to 3:1. Further, it is possible to preferably employ silver halide grains having rounded corners.

The crystal habit of the external surface of silver halide grains is not particularly limited. However, when spectral sensitizing dyes, which exhibit crystal habit (surface) selectiveness are employed, it is preferable that silver halide grains are employed which have the crystal habit matching their selectiveness in a relatively high ratio. For example, when sensitizing dyes, which are selectively adsorbed onto a crystal plane having a Miller index of (100), it is preferable that the ratio of the (100) surface on the external surface of silver halide grains is high. The ratio is preferably at least 50 percent, is more preferably at least 70 percent, and is most preferably at least 80 percent. Incidentally, it is possible to obtain a ratio of the surface having a Miller index of (100), based on T. Tani, J. Imaging Sci., 29, 165 (1985), utilizing adsorption dependence of sensitizing dye in a (111) plane as well as a (100) surface.

In the present invention, it is possible to incorporate iridium compounds into silver halide grains according to the present invention. Employed as water-soluble iridium compounds used in the present invention may be various iridium compounds. For example, listed are iridium(III) halide compounds, iridium(IV) halide compounds, iridium complexes having halogen, amines, or oxalate as a ligand, hexachloroiridum(III) or (IV) complexes, hexaamineiridium(III) or (IV) complexes, trioxalateiridium (III) or (IV) complexes, hexacyanoiridium, and pentachloronitrosylirridium. In the present invention, of these compounds, any of III valent compounds and any of IV valent compounds may optionally be combined and employed. These iridium compounds are dissolved in water or appropriate solvents and then employed. However, in order to stabilize iridium compound solutions, a commonly and frequently used method may be employed in which an aqueous hydrogen halide solution (for example, hydrochloric acid, hydrobromic acid, and hydrofluoric acid) or alkali halide (for example, potassium chloride, sodium chloride, potassium bromide, and sodium bromide) is added. Instead of using water-soluble iridium compounds, it is also possible to add other silver halide grains previously doped with iridium during preparations of silver halide to be dissolved.

In the present invention, it is possible to appropriately perform the addition of water-soluble iridium compounds at any time during production of silver halide emulsion grains or prior to coating a silver halide emulsion containing a liquid coating composition. Specifically, it is preferable that addition is carried out during formation of silver halide emulsion to be incorporated into silver halide grains.

The added amount of these water-soluble iridium compounds is preferably in the range of $1\times10^{-8}$14 $1\times10^{-3}$ mol per mol of silver halide, is more preferably in the range of $1\times10^{-8}$–$5\times10^{-5}$ mol, and is most preferably in the range of $5\times10^{-8}$–$5\times10^{-6}$ mol.

The light-sensitive silver halide grains according to the present invention can incorporate, other than iridium, metals which belong to Group VII or Group VIII (Group 7–10) in the periodic table or complexes thereof. Preferably listed as such central metals are rhodium, rhenium, ruthenium, and osmium. These metal complexes may be employed individually or in combinations of at least two types. The content is preferably in the range of $1\times10^{-9}$–$1\times10^{-3}$ mol per mol of silver, and is more preferably in the range of $1\times10^{-8}$–$1\times10^{-4}$. It is more practical to employ metal complexes which have the structures described in JP-A No. 7-225449.

Employed as rhodium compounds, used in the present invention, may be water-soluble rhodium compounds. For example, listed may be rhodium(III) halides, rhodium complexes having halogen, amines, or oxalato as a ligand such as hexachlororhodium(III) complex, pentachlororhodium (III) complex, tetrachlororhodium(III) complex, hexabromorhodium(III) complex, hexaaminerhodium(III) complex, and trioxalatorhodium(III) complex. These rhodium compounds are typically dissolved in water or suitable solvents and then employed. However, in order to stabilize the rhodium compound solution, it is possible to employ commonly employed methods, in which an aqueous hydrogen halide solution (e.g., hydrochloric acid, hydrobromic acid, hydrofluoric acid), or alkali halides (e.g., KCl, NaCl, KBr, and NaBr) are added. Instead of using water-soluble rhodium, it is possible to perform dissolution of rhodium by adding separately prepared silver halide grains which were previously doped with rhodium.

The added amount of these rhodium compounds is preferably in the range of $1\times10^{-8}$–$5\times10^{-6}$ mol per mol of silver halide, and is most preferably in the range of $5\times10^{-8}$–$1\times10^{-6}$ mol.

It is possible to add these compounds during production of silver halide emulsion grains or any stage prior to coating a liquid coating composition containing silver halide emulsions. However, it is particularly preferable that addition is carried out during formation of a silver halide emulsion to be incorporated in the silver halide grains.

Rhenium, ruthenium, and osmium employed in the present invention are added in the form of water-soluble complexes, which are described in JP-A Nos. 63-2042, 1-285941, 2-20852, and 2-20855. Listed as particularly preferred complexes are hexadentate complexes represented by the formula below.

$$[ML_6]^{n-}$$

wherein M represents Ru, Re, or Os, L represents a ligand, and n represents 1, 2, 3, or 4.

In this case, counter ions are of low importance, and ammonium or alkali metal ions are employed. Listed as preferred ligands are a halide ligand, a cyanide ligand, a cyanate ligand, a nitrosyl ligand, or a thionitrosyl ligand.

Specific complex examples employed in the present invention will now be described, however, the present invention is not limited thereto.

$[ReCl_6]^{3-}$, $[ReBr_6]^{3-}$, $[ReCl_5(NO)]^{2-}$, $[Re(NS)Br_5]^{2-}$, $[Re(NO)(CN)_5]^{2-}$, $[Re(O)_2(CN)^4]^{3-}$, $[RuCl_6]^{3-}$, $[RuCl_4(H_2O)_2]$—, $[RuCl_5(H_2O)]^{2-}$, $[RuCl_5(NO)]^{2-}$, $[RuBr_5(NS)]^{2-}$, $[Ru(CO)_3Cl_3]^{2-}$, $[Ru(CO)Cl_5]^{2-}$, $[Ru(CO)Br_5]^{2-}$, $[OsCl_6]^{3-}$, $[OsCl_5(NO)]^{2-}$, $[Os(NO)(CN)_5]^{2-}$, $[Os(NS)Br_5]^{2-}$, and $[Os(O)_2(CN)_4]^{4-}$.

The added amount of the above compounds is preferably in the range of $1\times10^{-9}$–$1\times10^{-5}$ mol per mol of silver halide, and is most preferably in the range of $1\times10^{-8}$–$1\times10^{-6}$ mol.

It is possible to add these compounds during production of silver halide emulsion grains or any stage prior to coating a liquid coating composition containing silver halide emulsions. However, it is particularly preferable that addition is carried out during formation of the silver halide emulsion to be incorporated in the silver halide grains.

In order to incorporate these compounds into silver halide grains while being added during formation of silver halide grains, the methods listed below are practical in which metal in an aqueous solution prepared by dissolving complex powder or with NaCl or KCl in water is added to a water-soluble salt, or a water-soluble halide solution which forms silver halide grains; when a silver salt solution and a halide solution are mixed employing a double jet method, addition is carried out as a third solution so that silver halide grains are formed employing a tripe jet method; or during formation of silver halide grains, an aqueous metal complex solution of a required amount is charged into a reaction vessel. The method is particularly preferred in which an aqueous solution prepared by dissolving powder, or powder with NaCl or KCl, is added to a water-soluble halide solution.

Addition to the surface of grains may be carried out by charging an aqueous solution of metal complexes at a required amount into a reaction vessel immediately after formation of silver halide grains, during or at the end of physical ripening, or during chemical ripening.

In addition, atoms of such metals as cobalt, iron, nickel, chromium, palladium, platinum, gold, thallium, copper, or lead may be incorporated in silver halide grains employed in the present invention. Furthermore, preferably employed as ruthenium compounds may be hexacyano metal complexes. Listed, but not limited to, as specific example are ferricyanate ions, ferrocyanate ions, hexacyanocobaltate ions, hexacyanochromate ions, and hexacyanoruthenate ions. Metal complexes may be uniformly incorporated in silver halide, may be incorporated in a core portion at a relatively high concentration, or may be incorporated in a shell at a relatively high concentration, on which no practical limitation is imposed.

The content of the above metal complexes is preferably $1\times10^{-9}$–$1\times10^{-4}$ mol per mol of silver halide. Further, in order to incorporate the above metal complexes, it is possible to add these in the form of metal salts such as a single salt, a double salt, or a complex salt during formation of the grains.

It is possible to desalt light-sensitive silver halide grains, employing washing methods known in the art such as a noodle method, a coagulation method, or electrodialysis. In addition, they may be desalted employing ultrafiltration. Polymers in the present invention, which incorporate carboxylic acid, are suitable for the coagulation process which is preferably employed. In the case in which silver halide grains are grown employing other polymers, occasionally, it is not possible to use the coagulation process. In such a case, it is possible to carry out desalting employing ultrafiltration.

Any conventional ultrafiltration method may be employed, as long as it is serves for desalting/concentration of silver halide emulsions. It is possible to refer to Research Disclosure Nos. 10208 (1972), 13122 (1975), and 16351 (1977). It is possible to select pressure difference and a flow rate which are important as operation conditions while referring to the characteristic curve, described on page 275 of Haruhiko Ohya, "Maku Riyou Kijutsu Handbook (Membrane Utilizing Technique Handbook)", published by Saiwai Shobo (1987). However, in order to minimize coagulation of grains, as well as to retard fogging, it is required to find optimal conditions. Further, a method in which solvents are replenished for solvents lost by membrane penetration, includes a constant-volume type in which solvents are continually added, and a batch type in which solvents are added intermittently. However, the constant-volume type is preferred since it results in a relatively shorter desalting time.

Employed as solvents replenished as above is pure water obtained by ion-exchange or distillation. In order to maintain the pH at the target value, pH control agents may be mixed with pure water or may be directly added to an organic silver salt dispersion.

Ultrafiltration membranes are commercially available in the form of a flat plate type incorporated as a module, a spiral type, a cylindrical type, a hollow yarn type, and a hollow fiber type which are available from Asahi Chemical Industry Co., Ltd., Dicel Chemical Industries, Ltd., Toray Industries, Inc., or Nitto Denko Corp. In view of the total membrane area or washing properties, preferred is a spiral type or a hollow yarn type. Further, the molecular weight cutoff which is an index of the threshold value of components which can penetrate the membrane is preferably at most ⅕ of the molecular weight of the employed polymer dispersing agent.

In the case of ultrafiltration, a single stage type may be employed. However, it is preferable that a multistage ultrafiltration apparatus is installed and salts dissolved in dispersion in the aforesaid mixer and/or the reaction vessel is continually removed. The multistage ultrafiltration apparatus, as described herein, is an apparatus in which a plurality of minute tube-shaped ultrafiltration membranes such as Viva Flow 50 (a trade name), produced by Saltrius AG are combined in a series and/or in a row and it is possible to efficiently perform desalting and concentration by passing the dispersion while adding dispersion media to this. It is possible to suitably set the flow rate of a dispersion passing though the ultrafiltration membranes, based on the concentration of the dispersion and the type of polymers incorporated in the dispersion. The flow rate is preferably 10–1,000 ml per channel of the ultrafiltration membrane, and is more preferably 100–500 ml. Desalting and dehydration may be performed only once, or may be repeated several times. Addition and removal of water may be performed continually and may also be performed individually. Desalting and dehydration are performed so that conductivity of finally dehydrated water reaches preferably at most about 300 μS/cm and more preferably at most about 100 μS/cm. In this case, the lower limit of the conductivity is not particularly limited but is commonly about 5 μS/cm.

It is also preferable that the silver halide emulsion according to the present invention undergoes chemical sensitization. In order to perform chemical sensitization, it is possible to use methods known as a sulfur sensitization method, a gold sensitization method, a selenium sensitization method, a tellurium sensitization method, and a noble metal sensitization method. The silver halide grains of the present invention are prepared in a water based system and subsequently re-dispersed into solvents. Chemical sensitization may be performed in a water based system or after being dispersed into solvents.

Sulfur sensitization, which is preferably carried out in the present invention, is performed in such a manner that commonly sulfur sensitizers are added, and subsequently the resultant silver halide emulsion is stirred for the specified time. Employed as sulfur sensitizers may be prior art compounds such as thiosulfate salts, thioureas, thiazoles, and rhodanines. Preferred sulfur compounds include thiosulfate salts and thiourea compounds. The added amount of sulfur sensitizers may vary depending on various conditions such as pH and temperature, as well as silver halide grain size during chemical ripening, but is $1\times10^{-7}$–$1\times10^{-2}$ mol per mol of silver halide, and is more preferably $1\times10^{-5}$–$10^{-3}$.

Employed as selenium sanitizers employed in the present invention are prior art selenium compounds. Namely, unstable type or non-unstable type selenium compounds are added and sensitization is performed by stirring the resultant silver halide emulsion for a specified time. Employed as unstable selenium compounds may be compounds described, for example, in Japanese Patent Publication Nos. 44-15748 and 43-13489, and also in JP-A Nos. 4-25832, 4-109240, and 4-324855. It is Particularly preferable to use compounds represented by General Formulas (VIII) and (IX) described in JP-A No. 4-324855.

The tellurium sensitizers employed in the present invention are compounds which form silver telluride on the surface or in the interior of silver halide grain, which are assumed to work as sensitization specks in the silver halide emulsion. It is possible to test the formation rate of silver telluride in a silver halide emulsion employing the method described, for example, in JP-A No. 5-313284. Employed as tellurium sensitizers may, for example, be diacyl tellurides, bis(oxycarbonyl)tellurides, bis(carbamoyl)tellurides, diacyltellurides, bis(oxycarbonyl)ditellurides, bis(carbamoyl)ditellurides, compounds having a P═Te bond, tellurocarboxylic acid salts, Te-organyltellurocarboxylic acid esters, di(poly)tellurides, tellurides, tellols, telluroacetals, telluro-sulfonates, compounds having a P═Te bond, Te containing heterocyclic compounds, tellurocarbonyl compounds, inorganic tellurium compounds, and colloidal tellurium. Specifically, it is possible to employ the compounds described in U.S. Pat. Nos. 1,623,499, 3,320,069, and 3,772,031; British Patent Nos. 235,211, 1,121,496, 1,295,462, and 1,396,696; Canadian Patent No. 800,958; JP-A Nos. 4-204640, and Japanese Patent Nos. 2654722, 2699029, 2811257; Journal of Chemical Society Chemical Communication, 635 (1980), ibid, 1102 (1979), ibid, 645 (1979); Journal of Chemical Society, Perkin Transaction 1, 2191 (1980); and Edited by S. Patai, The Chemistry of Organic Selenium and Tellurium Compounds, Vol. 1 (1986), and the same Vol. 2 (1987). The compounds represented by General Formulas (II), (III), and (IV) in JP-A No. 5-313284 are particularly preferred.

The amount of selenium or tellurium sensitizers employed in the present invention varies depending on the used silver halide grains as well as chemical ripening conditions, but is customarily $1\times10^{-8}$–$1\times10^{-2}$ mol per mol of silver halide, and is preferably about $1\times10^{-7}$–$1\times10^{-3}$ mol. Conditions for chemical sensitization in the present invention are not particularly limited. The pH is 5–8, and the pg is 6–11 and is preferably 7–10. The temperature is 40–95° C., and is preferably 45–85° C.

Gold sensitizers which are employed for applying gold sensitization to the silver halide emulsions according to the present invention may have an oxidation number of +1 or +3 in terms of valence, and it is possible to use the gold compounds which are commonly employed as a gold sensitizer. Listed as representative examples are chloroauric acid, potassium chloroaurate, auric trichloride, potassium auric thiocyanate, potassium iodoaurate, tetracyanoauric acid, ammonium aurothiocyanate, and pyridyl trichloroaurate.

The added amount of gold sensitizers varies depending on various conditions, but is commonly $1\times10^{-6}$–$5\times10^{-4}$ mol per mol of silver halide.

The silver halide emulsion according to the present invention can undergo gold sensitization together with other chemical sensitization. In the use of combinations of the gold sensitization method, examples of preferred combinations include a sulfur sensitization method and a gold sensitization method; a selenium sensitization method and a gold sensitization method; a sulfur sensitization method, a selenium sensitization method, and a gold sensitization method; a sulfur sensitization method, a tellurium sensitization method, and a gold sensitization method; and a sulfur sensitization method, a selenium sensitization method, a tellurium sensitization method, and a gold sanitization method.

During formation process of silver halide grains or physical ripening, cadmium salts, sulfite salts, and thallium salts may be present in the silver halide emulsions employed in the present invention.

In the present invention, it is possible to use reduction sensitization. In such reduction sensitization, employed as specific compounds may be ascorbic acid, thiourea dioxide, and other compounds such as stannous chloride, aminoiminomethanesulfinic acid, hydrazine derivatives, borane compounds, silane compounds, or polyamine compounds. Further, it is possible to perform reduction sensitization by ripening silver halide emulsion while maintaining the pH at 7 or more or the pAg at 8.3 or less. Still further, it is also possible to perform reduction sensitization by introducing a single addition part of silver ions during grain formation.

Thiosulfonic acid compounds may be added to the silver halide emulsions according to the present invention, employing the method shown in European Patent Publication Open to Public Inspection No. 293,917.

<Spectral Sensitization>

It is preferable that photosensitive silver halide in the present invention is adsorbed by spectral sensitizing dyes so as to result in spectral sensitization. Employed as spectral sensitizing dyes may be cyanine dyes, merocyanine dyes, complex cyanine dyes, complex merocyanine dyes, homopolar cyanine dyes, styryl dyes, hemicyanine dyes, oxonol dyes, and hemioxonol dyes. For example, employed may be sensitizing dyes described in JP-A Nos. 63-159841, 60-140335, 63-231437, 63-259651, 63-304242, and 63-15245, and U.S. Pat. Nos. 4,639,414, 4,740,455, 4,741,966, 4,751,175, and 4,835,096.

Useful sensitizing dyes, employed in the present invention, are described in, for example, Research Disclosure, Item 17645, Section IV-A (page 23, December 1978) and Item 18431, Section X (page 437, August 1978) and publications further cited therein. It is specifically preferable that those sensitizing dyes are used which exhibit spectral sensitivity suitable for spectral characteristics of light sources of various types of laser imagers, as well as of scanners. For example, preferably employed are compounds described in JP-A Nos. 9-34078, 9-54409, and 9-80679.

Silver halide emulsions incorporated in the heat developable materials according to the present invention may be composed of one type, or of at least two types (for example, types of different average grain sizes, different halide compositions, different crystal habits, and different chemical sensitization conditions).

In the present invention, in order to control tonal characteristic (gammer), it is preferable to use a plurality of types of light-sensitive silver halide emulsions. It makes it possible to obtain a plurality of types of light-sensitive silver halide emulsions by controlling grain size, shape, silver halide composition, adsorbed amount of sensitizing dyes, and the amount of chemical sensitizers so that the photographic speed of each of the emulsions differs. The number of employed silver halide emulsion types is 2–4 and is preferably 2–3. It is preferable that these emulsion types are used upon being mixed or being individually coated. It is preferable that difference in photographic speed among silver halide emulsions is at least 2 Log E and is more preferably at least 0.3 Log E. Log E, as described herein, refers to an index representing photographic speed, and is a value which is obtained in such a manner that in a characteristic curve prepared by plotting density on the ordinate and the exposure amount on the abscissa after exposure through an optical wedge, exposure amount (E) is represented by a logarithm.

Listed as references with regard to these techniques are JP-A Nos. 57-229341, 53-206125, 47-3929, 48-55730, 46-5187, 50-73627, and 57-150841. Incidentally, the upper limit of the above photographic speed difference is not particularly limited, but is commonly a maximum of about 1.0 Log E.

In the silver salt photothermographic dry imaging materials of the present invention, the number average diameter of organic silver salt particles is preferably 0.01–0.60 μm.

The average particle diameter, as described herein, refers to the diameter (equivalent circular diameter) of a circle which has the same area as the projected area of an organic silver salt particle. By employing a scanning type electron microscope, 1,000 particles are measured and the resultant values are averaged.

Light-insensitive aliphatic carboxylic acid silver salts (hereinafter also referred to as organic silver salts) according to the present invention are relatively stable for light. However, in the presence of exposed photo-catalysts (for example, latent images on light-sensitive silver halide) as well as reducing agents, when heated to at least 80° C., the above salts form silver images. Organic silver salts may be any of the organic substances containing sources capable of reducing silver ions. Such light-insensitive organic silver salts are described, for example, in JP-A Nos. 6-130543, 8-314078, 9-127643, paragraphs [0048]–[0049] of 10-62899, 10-94074, and 10-94075; line 24 on page 8—line 37 on page 19 of European Patent Publication Open to Public Inspection No. 0,803,764A1 and European Patent Publication Open to Public Inspection No. 1,004,930A2; JP-A Nos. 11-349591, 2000-7683, 2000-72711, 2000-112057, and 2000-155383. Silver salts of organic acids, especially silver salts of long chain aliphatic carboxylic acids having 10–30 carbon atoms, and preferably 15–28 carbon atoms, are preferred. Preferred examples of organic silver salts include silver behenate, silver arachidate, silver stearate, and mixtures thereof. Further, the content ratio of silver behenate is preferably 50–100 mol percent, and is most preferably 80–100 mol percent.

It is preferable that the organic silver salts according to the present invention are in the form of scale-shaped particles of a ratio of width to length of 1–9. When the ratio of width to length is in the range of 1–9, particles are not crushed during preparation of dispersion. As a result, image retention properties are improved.

In the present invention, scale-shaped organic silver salts as well as the ratio of width to length are defined as follows. Organic silver salts are observed via an electron microscope and the shape of an organic silver salt particle is approximated to a rectangle. Subsequently, values for x and y are obtained based on the following formulas.

$$x=b/a$$

$$y=c/b$$

wherein "a", "b", and "c" each represent the length of the side of the rectangle from the shortest to the longest, ("c" may be the same as "b").

Based on the above formula, x and y of approximately 200 particles are obtained and average x (average) is obtained. Particles which satisfy the relationship of $30 \geqq x$ (average) $\geqq 1$ are designated as scale shaped particles. The above relationship is preferably $30 \geqq x$ (average) $\geqq 1.5$, and is more preferably $20 \geqq x$ (average) $\geqq 2.0$. Further, average y (average) is defined as a ratio of the width to the length. The ratio of the width to the length of organic silver salt particles is preferably 1–9, is more preferably 1–6, and is most preferably 1–3.

In scale-shaped particles, it is possible to regard "a" as the thickness of a tabular particle having a plane composed with sides "b" and "c" as the primary plane. The average of "a" is preferably 0.01–0.23 μm, and is more preferably 0.1–0.20 μm.

In such scale-shaped particles, equivalent spherical diameter/"a" is defined as the aspect ratio. The aspect ratio of scale-shaped particles in the present invention is preferably 1.1–30. By controlling the aspect ratio to remain within such a range, coagulation in heat developable materials tends to not occur, whereby image retention properties are improved. At the time, the aspect ratio is preferably 1.1–15.

It is characterized that the number average particle diameter of the light-insensitive aliphatic carboxylic acid silver salts according to the present invention is preferably 0.01–0.60 μm in terms of equivalent spherical diameter, and is more preferably 0.20–0.50 μm. By doing so, coagulation in heat developable materials tends to not occur, whereby image retention properties are improved.

Further, to the inventors' surprise, in the case in which the diameter of employed silver halide grains was 0.01–0.06 μm, it was discovered that image density was markedly enhanced compared to the case in which the average grain diameter of organic silver salts was of the conventional value.

The particle size distribution of organic silver salts is preferably monodispersion. Monodispersion, as described herein, refers to a case in which percentage (variation coefficient) of the value obtained by dividing the standard deviation of the number average particle diameter of organic silver salt particles by the number average particle diameter is preferably at most 100 percent, is more preferably at most 80 percent, and is still more preferably at most 50 percent. A method is preferably employed in which the above distribution is obtained employing the particle size obtained from the determined equivalent circular diameter, employing an electron microscope.

In view of preparing particles of low minimum density, organic silver salt particles according to the present invention are prepared at a reaction temperature of at most 60° C. Added chemicals such as an aqueous organic acid alkaline metal solution may be employed at a relative high temperature such as at least 60° C. However, the temperature of a reaction bath, to which liquid reaction compositions are added, is preferably at most 60° C., is more preferably at most 50° C., and is most preferably at most 40° C.

It is possible to prepare organic silver salt particles according to the present invention by allowing a solution containing silver ion-forming salts such as silver nitrate to react with an organic acid alkaline metal salt solution or dispersion. However, it is preferable that the addition of at least 50 percent of the total added silver amount is simultaneously performed along with the addition of an organic alkaline metal salt solution or dispersion. Employable addition methods include a method in which addition is performed on the solution surface of a reaction bath, a method in which addition is performed into a solution, and a method in which addition is performed during a tightly sealed mixing step, and any of these may be employed. However, the method in which addition is performed during a tightly sealed mixing step is preferred.

The pH of a silver ion containing solution (such as an aqueous silver nitrate solution) is preferably 1–6, and is more preferably 1.5–4. To control the pH, it is possible to add acid and alkali to a solution containing silver ions. Types of acid and alkali are not particularly limited.

After completion of the addition of a silver ion containing solution (such as an aqueous silver nitrate solution)/and or an organic acid alkaline metal salt solution, the organic silver salts according to the present invention may undergo ripening upon increasing the reaction temperature. The ripening in the present invention is considered to be different from the reaction temperature described above. During ripening, none of the silver ion containing solutions and the organic acid alkaline metal salt solution or dispersion is added. Ripening is preferably performed at reaction temperature plus 1 to 20° C. and is more preferably at the reaction temperature plus 1 to 10° C. Incidentally, it is preferable that the ripening time is based on trial and error.

During preparation of the organic silver salts according to the present invention, an organic acid alkaline metal salt solution or dispersion may be added in 2–6 portions. By performing several additions such as addition to improve photographic performance or addition to vary the surface hydrophilicity, it is possible to provide particles with various functions. The number of the several additions is preferably 2–4. During such operations, since organic salts are solidified at a relatively low temperature, it is necessary to pay considerations such that a plurality of addition lines for the several additions is installed, or inventive circulation methods are used.

During preparation of organic silver salts according to the present invention, after completion of the addition of a silver ion containing solution in an amount of 0.5–30 mol percent of the total number of added moles of the organic acid alkaline metal salt solution or dispersion, individual addition may be carried out. Individual addition in an amount of 3–20 mol percent may preferably be performed. It is preferable that such an addition is performed as one of the several additions. When a tightly sealed mixing device is used, addition may be performed into the tightly sealed device or a reaction vessel, but addition to the reaction vessel is preferred. By achieving such addition, it is possible to enhance the surface hydrophilicity of organic silver salt particles, whereby film-forming properties of heat developable materials are improved and peeling is minimized.

Any silver ion concentration of the silver ion containing solution (such as an aqueous silver nitrate solution) may be employed, and is preferably 0.03–6.5 mol/L, and is more preferably 0.1–5 mol/L.

When the present invention is practiced, in order to form organic silver salt particles, it is preferable that organic solvents, in an amount capable of substantially making a solution transparent so that organic acid alkaline metal salts do not form string-shaped coalescence micelle, are added to at least one of the silver ion containing solution, to the organic acid alkaline metal salt solution or to the dispersion, or to solutions which are previously prepared for reaction.

In such solutions, it is preferable to use water, single organic solvent, or a mixture of water and organic solvents and more preferably to use a mixed solution of water and organic solvents.

Types of organic solvents used in the present invention are not particularly limited as long as they are water-soluble and exhibit the above desired properties. Obviously, those which adversely affect photographic performance are not preferred. Preferred solvents are those which are water-miscible alcohols and acetone. Tertiary alcohols having 4–6 carbon atoms are more preferred.

The preferred specific alkaline metal of organic acid alkaline metal salts employed in the present invention is potassium. Organic acid alkaline metal salts are prepared by adding potassium hydroxide to organic acid. At time, it is preferable that alkali is in an amount equal to or less than equivalent of organic acid so that unreacted organic acid remains. In such a case, the amount of remaining organic acid is customarily 3–50 mol percent with respect to the total organic acid, and is preferably 3–30 mol percent. Further, after adding more alkali than the desired amount, preparation may be performed by neutralizing an excessive alkali portion by the addition of acids such as nitric acid or sulfuric acid. In addition, it is possible to add to the silver ion containing solution and organic acid alkaline metal salt solution or the liquid composition added with both solutions in the tightly sealed mixing device of the present invention, for example, the compounds represented by General Formula (1) of JP-A No. 62-65035, the water-soluble group containing N heterocyclic compounds described in JP-A No. 62-150240, the inorganic peroxides described in JP-A No. 50-101019, the sulfur compounds described in JP-A No. 51-78319, and the disulfide compounds described in JP-A No. 57-643.

In the organic acid alkaline metal salt solution employed in the present invention, the amount of organic solvents is preferably 3–70 percent by volume with respect to the volume of water, and is more preferably 5–50 percent. In such a case, since the optimal organic solvent volume varies depending on reaction temperature, it is possible to decide the optimal volume by trial and error. The concentration of the organic acid alkaline metal salts employed in the present invention is customarily 5–50 percent by weight, is preferably 7–45 percent by weight, and is more preferably 10–40 percent by weight.

Temperature in a tightly sealed mixing device, as well as of an organic acid alkaline metal salt solution or a suspension is preferably 50–90° C., is more preferably 60–85° C., and is most preferably 65–85 ° C. for the purpose of maintaining the temperature which prevents crystallization and solidification of organic acid alkaline metal salts. Further, in order to maintain a constant reaction temperature, it is preferable that the temperature selected from the above range is controlled to be constant. By doing so, the rate of microcrystalline deposition due to rapid cooling of an organic acid alkaline metal solution, or a suspension at relatively high temperature in the tightly sealed mixing device, and the rate of formation of organic silver salts via reaction with a silver ion containing solution are preferably controlled, whereby in the dispersion or suspension of formed organic silver salts, it is possible to preferably control the crystal form, crystal size, and crystal size distribution of organic silver salts. Further, at the same time, it is possible to further enhance performance as heat developable materials, especially as silver salt photothermographic dry imaging materials.

In a reaction vessel, solvents may be placed prior to use. Water is preferably employed for the above previously placed solvents, and solvents mixed with an organic acid alkaline metal salt solution or a suspension are preferably employed.

It is possible to add water based medium soluble dispersing aids to an organic acid alkaline metal salt solution, to a silver ion containing solution, or to a reaction solution. Any dispersing aids may be employed as long as they make formed organic silver salts dispersible. Specific examples subject to the description of dispersing aids of organic silver salts are described below.

In methods for preparing organic silver salts, it is preferable to perform a desalting and dehydrating process after forming silver salts. The methods are not particularly limited and well known and customarily used methods are available. For example, preferably employed are prior art filtration methods such as centrifugal filtration, filtration under reduced pressure, ultrafiltration, and flocculation forming washing employing a flocculation method. Further, removal of supernatants employing centrifugal sedimentation is also preferably employed. Of these, ultrafiltration method is most-preferred.

Employed as an ultrafiltration method may be employed a method, which is used for desalting/concentrating of silver halide emulsions. It is possible to refer to Research Disclosure Nos. 10208 (1972), 13122 (1975), and 16351 (1977). It is possible to select pressure difference and a flow rate which are important as operation conditions while referring to the characteristic curve, described on page 275 of Haruhiko Ohya, "Maku Riyou Kijutsu Handbook (Membrane Utilizing Technique Handbook)", published by Saiwai Shobo (1987). However, in order to minimize coagulation of grains as well as fogging it is required to find the optimal conditions. Further, a method in which solvents are replenished for solvents lost by membrane penetration, includes a constant-volume type in which solvents are continually added, and a batch type in which solvents are added intermittently. However, the constant-volume type is preferred which results in a relatively shorter desalting time.

Employed as solvents replenished as above is pure water obtained by ion-exchange or by distillation. In order to maintain the pH at the target value, pH control agents may be mixed with pure water or may be directly added to an organic silver salt dispersion.

Ultrafiltration membranes are commercially available in the form of a flat plate type incorporated as a module, a spiral type, a cylindrical type, a hollow yarn type, and a hollow fiber type which are available form Asahi Chemical Industry Co., Ltd., Dicel Chemical Industries, Ltd., Toray Industries, Inc., or Nitto Denko Corp. In view of the total membrane area or washing properties, preferred is a spiral type or a hollow yarn type. Further, molecular weight cutoff, which is an index of the threshold value of components which can penetrate the membrane, is preferably at most ⅕ of the molecular weight of the employed polymer dispersing agents.

Further, in the case of ultrafiltration, a single stage may be employed. However, it is preferable that a multistage ultrafiltration apparatus is installed and salts dissolved in dispersion in the aforesaid mixer and/or the reaction vessel is continually removed. The multistage ultrafiltration apparatus, as described herein, is an apparatus in which a plurality of minute tube-shaped ultrafiltration membranes such as Viva Flow 50 (a trade name), produced by Saltrius AG are combined in a series and/or in a row and it is possible to efficiently perform desalting and concentration by passing the dispersion while adding dispersion media to this. It is possible to suitably set the flow rate of a dispersion passing though the ultrafiltration membranes, based on the concentration of the dispersion and the type of polymers incorporated in the dispersion. The flow rate is preferably 10–1,000 ml per channel of the ultrafiltration membrane, and is more preferably 100–500 ml. Desalting and dehydration may be performed only once, or may be repeated several times. Addition and removal of water may be performed continually and may be performed individually. Desalting and dehydration are performed so that conductivity of finally dehydrated water preferably reaches at most about 300 μS/cm and more preferably at most about 100 μS/cm. In this case, the lower limit of conductivity is not particularly limited but is commonly about 5 μS/cm, which is the same as for the case of silver halide grains.

It is preferable that in desalting employing ultrafiltration according to the invention, a liquid composition is previously dispersed prior to the process so that the particle size in terms of the volume weighted average reaches a factor of about two of the final particle size. It is possible to use any dispersion methods employing devices such as a high pressure homogenizer or the Microfluidizer described below.

It is preferable that a relatively low liquid temperature during the desalting operation after formation of particles is maintained. Reasons for this are as follows. At a state in which organic solvents, which are employed to dissolve organic acid alkaline metal salts, penetrate into formed organic silver salt particles, silver nuclei tend to be formed by a shearing field and a pressure field during liquid conveying operations and while passing through ultrafiltration membranes. Consequently, in the present invention, ultrafiltration is performed while maintaining the temperature of organic silver salt particle dispersion in the range of 1–50° C.

Further, in order to improve the coating surface of heat developable materials, especially silver salt photothermographic dry imaging materials, it is preferable that dispersing agents are further added to desalted and dehydrated organic silver salts, and the resultant mixture is re-dispersed to prepare more micronized particle dispersion.

It is possible to produce and disperse organic silver salts employed in the present invention employing prior art methods. It is possible, for example, to refer to aforesaid JP-A No. 8-234358 and 10-62899; European Patent Publication Open to Public Inspection Nos. 0,803,763A1 and 0,962,812A1; JP-A Nos. 11-349591, 2000-7683, 2000-72711, -2000-53682, 2000-75437, 2000-86669, 2000-143578, 2000-178278, and 2000-256254; Japanese Patent Application Nos. 11-348228-30, 11-203413, 11-115457, 11-180369, 11-297964. 11-157838, 11-202081, 2000-90093, 2000-195621, 2000-191226, 2000-213813, 2000-214155, and 2000-191226.

It is possible to mechanically disperse organic silver salts into minute particles in the presence of dispersing aids, employing prior art dispersing devices (such as a high speed mixer, a homogenizer, a high speed impact mill, a Banbury mixer, a Homomixer, a kneader, a ball mill, a vibration ball mill, a planetary ball mill, an attritor, a sand mill, a bead mill, a colloid mill, a jet mill, a roller mill, a tron mill, or a high speed stone mill).

In order to prepare a non-aggregated and uniform organic silver salt solid dispersion having a monodispersion particle size distribution and a minute particle size, it is preferable to apply relatively large force to organic silver salt particles employed as image forming media in the range in which the aforesaid particles are not damaged nor heated to a relatively high temperature. Consequently, a dispersion method is preferred in which after converting a dispersion consisting of organic silver salts and a dispersing agent solution to a high speed flow, pressure is lowered. Dispersion media employed in the above operation are not particularly limited as long as they are composed of solvents in which dispersing aids function. They are preferably composed of only water. However, organic solvents may be incorporated if the proportion is at most 20 percent by weight. Further, when light-sensitive silver salts coexist during dispersion, fog increases and photographic speed markedly decreases. As a result, it is more preferable that during dispersion, light-sensitive silver salts are substantially not incorporated. In the present invention, the amount of light-sensitive silver salts in a dispersion is 0.1 mol percent per mol of the silver salts in the dispersion. It is preferable that light-sensitive silver salts are not added.

Homogenizers and techniques which are employed to practice the re-dispersing methods as described above are detailed, for example, on pages 357–403 of Toshio Kajiuchi and Yoki Usui, "Bunsankei Rheology to Bunsanka Gijutsu (Dispersion Based Rheology and Dispersing Technology)", 1991, Shinzansha Shuppnan Co., Ltd., as well as on pages 184–185 of "Kagakukogaku no Shinpo Dai 24 Shu (Progress of Chemical Engineering, No. 24)", (edited by Shadan Hojin Kagakukogaku Gakkai Knato Shibu, 1990, Maki Shobo); JP-A No. 59-49832; U.S. Pat. No. 4,533,254; and JP-A Nos. 8-137044, 8-238848, 2-261525, and 1-94933. In the dispersion method of the present invention, it is preferable that after a dispersion containing at least organic silver salts is conveyed into a piping upon being pressed by a high pressure pump, it is allowed to pass through minute slits arranged in the piping and thereafter, the dispersion is subjected to a rapid pressure drop, whereby more minute dispersion is performed.

In high pressure homogenizers, it is generally considered that uniform and efficient dispersion is performed by resulting in no variation of (a) "shearing force" which is formed by passing a dispersoid through a narrow gap (about 75–about 350 μm) at high pressure and high speed, and (b) impact force which is formed by liquid-liquid impact or impact onto a wall surface in a narrow space under high pressure and thereafter further enhancing the cavitation force due to pressure drop. Listed as a homogenizer of this type may be a conventional Gaulin homogenizer. In this apparatus, liquid to be dispersed conveyed under high pressure is converted to a high speed flow in a narrow space on a cylindrical surface and is allowed to impact the surrounding wall surface at such high speed, whereby the resulting impact force achieves emulsification and dispersion. Listed as the above liquid-liquid impact are the Y type chamber of the Microfluidizer and a spherical chamber utilizing a spherical type check valve described in JP-A No. 8-103642. In order to enhance dispersion efficiency, a device has been invented in which impact frequency is increased by shaping the high speed flow portion as saw teeth. Listed as representative examples of such homogenizers are a Gaulin homogenizer, a Microfluidizer, produced by Microfluidics International Corporation, a Microfluidizer, produced by Mizuho Kogyo Co., Ltd., and Nanomizer, produced by Tokushu Kika Kogyo Co., Ltd. Further, such homogenizers are described in JP-A Nos. 8-238848 and 8-103642, as well as U.S. Pat. No. 4,533,254.

It is possible to disperse organic silver salts at a desired particle size by controlling the flow rate, the pressure difference during a pressure drop, and the frequency of processing. In view of photographic characteristics and particle size, it is preferable that flow rate is in the range of 200–600 m/second, and the pressure difference during a pressure drop is in the range of 9–30 MPa, and it is more preferable that flow rate is in the range of 300–600 m/second, and pressure difference during a pressure drop is in the range of 15–30 MPa. It is possible to select the frequency of dispersion processing as required. The frequency is commonly selected to be in the range of 1–10 times, while in view of productivity, a range of 1–about 4 is selected. In view of dispersibility and photographic performance, it is not preferable to heat such dispersion to a relatively high temperature under high pressure. At temperature of 90° C. or higher, the particle size tends to increase and simultaneously, fog also tends to increase. Accordingly, a cooler(s) is commonly installed in the process before enabling aforesaid high pressure and high flow rate, the process after dropping pressure, or both processes. Subsequently, temperature during dispersion is maintained in the range of 5–90° C., employing the cooling process, preferably in the range of 5–80° C., and most preferably in the range of 5–65° C. Particularly, during dispersion under high pressure in the range of 15–30 MPa, it is effective to install the above cooling apparatus. In response to the required heat exchange capacity, it is possible to select, as a cooler, any of those employing a double tube or a triple tube method with a static mixer, a multiple tube heat exchanger, or a helical heat exchanger. Further, in order to enhance the heat exchange efficiency, upon considering the used pressure, suitable tube diameter, wall thickness, and materials may be chosen. Employed as coolants used in these coolers may be well water at 20° C. and cold water at 5–10° C. processed by a chiller or coolants such as ethylene glycol/water at −30° C., depending on the desired heat exchange capacity.

When organic silver salts are converted into minute solid particles employing dispersing agents, suitably selected and employed are, for example, synthetic anion polymers such as polyacrylic acid, acrylic acid copolymers, maleic acid copolymers, maleic acid monoester copolymers, or acryloylmethylpropane sulfonic acid copolymers; semi-synthetic anion polymers such as carboxymethylstarch or carboxymethylcellulose; anion polymers such as alginic acid or pectic acid; anionic surface active agents described in JP-A No. 52-92716 and No. WO88/04794; compounds described in Japanese Patent Application No. 7-350753; prior art anionic, nonionic, and cationic surface active agents; prior art polymers such as polyvinyl alcohol, polyvinylpyrrolidone, carboxymethyl cellulose, hydroxypropyl cellulose, and hydroxypropylmethylcellulose; and natural polymers such as gelatin. In cases in which solvents are employed as the dispersion medium, preferably employed are polyvinyl butyral, butylethylcellulose, methacrylate copolymers, maleic anhydride ester copolymers, polystyrene, and butadiene-styrene copolymers.

In a common method, prior to dispersion, dispersing aids are mixed with organic silver salt powder or organic silver salts into a wet cake state and conveyed to a homogenizer. Alternatively, in advance, they may be mixed with organic silver salts and subjected to heat processing, or processing employing solvents to form organic silver salt powder or a wet cake. Prior to, after dispersion or during dispersion, the pH may be controlled employing appropriate pH control agents.

Other than performing mechanical dispersion, silver salts may be coarsely dispersed into solvents by controlling the pH and thereafter may be converted into minute particles in the presence of dispersing aids while adjusting the pH. During such an operation, fatty acid solvents may be employed as solvents for coarse dispersion.

In the present invention, it is possible to produce heat developable materials employing a mixture which is prepared by mixing a water-based organic silver salt dispersion as well as a water-based light-sensitive silver salt dispersion. It is also possible to select the mixing ratio of the organic silver salts to the light-sensitive silver salts based on the purpose. The ratio of the light-sensitive silver salts to the organic silver salts is preferably in the range of 1–30 mol percent, is more. preferably in the range of 3–20 mol percent, and is most preferably in the range of 5–15 mol percent. When mixed, mixing of at least two types of organic silver salt dispersions with at least two types of light-sensitive silver salt dispersions is the preferably employed method for controlling desired photographic characteristics.

In the present invention, it is possible to use those having, as a light-insensitive organic silver salt, at least two reducible silver (I) ions in the molecule. Employed as specific compounds may be those described in Japanese Patent Application No. 2001-251399. Further, silver salts of acrylic acid containing polymers may also be employed.

It is possible to use the desired amount of organic silver salts according to the present invention depending on the purpose. The amount is preferably 0.1–5 g/m$^2$ in terms of silver weight, and is more preferably 0.5–2 g/m$^2$.

It is preferable that the silver salt photothermographic dry imaging materials of the present invention contain polymers having at least one repetition unit of an aliphatic monomer having a halogen radical releasing group.

Polymers having repetition units of the aliphatic monomer-having a halogen radical releasing group may be prepared in advance in such a manner that monomers having a halogen radical releasing group are synthesized and the resultant monomers are polymerized. Alternatively, polymers having a group capable of being substituted with another group are prepared, and subsequently, a halogen radical releasing group is introduced.

In the present invention, it is preferable that aliphatic monomers having a halogen radical releasing group are those represented by General Formula (1) below.

General Formula (1)

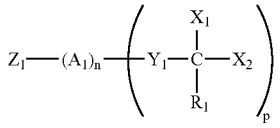

In General Formula (1), $X_1$ and $X_2$ independently represent a halogen atom; $R_1$ represents a hydrogen atom or a halogen atom; $Y_1$ represents a divalent linking group; p represents an integer of 1–3; $A_1$ represents an alkylene group, a cyclo-alkylene group, an alkenylene group, or an alkynylene group; n represents 0 or 1; and $Z_1$ represents an ethylenic unsaturated group, an ethyleneimino group, or an epoxy group.

Halogen atoms represented by $X_1$ and $X_2$ may be fluorine atoms, chlorine atoms, bromine atoms, or iodine atoms, which may be the same or different. However, a chlorine atom, a bromine atom, or an iodine atom is preferred; a chlorine atom or a bromine atom is more preferred, and a bromine atom is most preferred.

$R_1$ represents a hydrogen atom or a halogen atom, and is preferably a chlorine atom, a bromine atom, or an iodine atom, and is more preferably a chlorine atom or a bromine atom, and is most preferably a bromine atom.

$Y_1$ represents a linking group. Listed as linking groups are, for example, —$SO_2$—, —$N(R_6)CO$—, and —OCO—, wherein $R_6$ represents a substituent. Listed as substituents represented by $R_6$ are, for example, a halogen atom, an alkyl group, a cycloalkyl group, an alkenyl group, a cycloalkenyl group, an alkynyl group, an acyloxy group, an alkylthio group, a carboxyl group, an acylamino group, an acyl group, and a trifluoromethyl group, while p represents an integer of 1–3.

$A_1$ represents an alkyl group, a cycloalkyl group, an alkenyl group, or an alkynyl group. These groups may have a substituent. The above substituents include a halogen atom (e.g., a fluorine atom, a chlorine atom, and a bromine atom), an alkyl group (e.g., a methyl group, an ethyl group, a propyl group, a butyl group, a pentyl group, an iso-pentyl group, a 2-ethyl-hexyl group, an octyl group, and a decyl group), a cycloalkyl group (e.g., a cyclohexyl group and a cycloheptyl group), an alkenyl group (e.g., an ethenyl-2-propenyl group, a 3-butenyl group, a 1-methyl-3-propenyl group, a 3-pentenyl group, and a 1-methyl-3-butenyl group), a cycloalkenyl group (e.g., a 1-cycloalkenyl group and a 2-cycloalkenyl group), an alkynyl group (e.g., an ethynyl group and a 1-propinyl group), an alkoxy group (e.g., a methoxy group, an ethoxy group, and a propoxy group), an alkylcarbonyloxy group (e.g., an acetyloxy group), an alkylthio group (e.g., a methylthio group and a trifluoromethylthio group), a carboxyl group, an alkylcarbonylamino group (e.g., an acetylamino group), a ureido group (e.g., a methylaminocarbonylamino group), an alkylsulfonylamino group (e.g., a methanesulfonylamino group), an alkylsulfonyl group (e.g., a methanesulfonyl group and trifluoromethanesulfonyl group), a carbamoyl group (e.g., a carbamoyl group, an N,N-dimethylcarbamoyl group, and an N-morpholinocarbonyl group), a sulfamoyl group (e.g., a sulfamoyl group, an N,N-dimethylsulfamoyl group, or a morpholinosulfamoyl group), a trifluoromethyl group, a hydroxyl group, a nitro group, a cyano group, an alkylsulfonamido group (e.g., a methanesulfonaamido group and A butanesulfonamido group), an alkylamino group (e.g., an amino group, an N,N-dimethylamino group, and an N,N-diethylamino group), a sulfo group, a phosphono group, a sulfite group, a sulfino group, an alkylsulfonylaminocarbonyl group (e.g., a methanesulfonylaminocarbonyl group and an ethanesulfonylaminocarbonyl group), an alkylcarbonylaminosulfonyl group (e.g., an acetamidosulfonyl group and a methoxyacetamidosulfonyl group), an alkynylaminocarbonyl group (e.g., an acetamidocarbonyl group and a methoxyacetamidocarbonyl group), an alkylsulfinylaminocarbonyl group (e.g., a methanesulfinylaminocarbonyl group) and an ethanesulfinylaminocarbonyl group). Further, in cases in which at least two substituents are present, they may be the same or different. However, there is no case in which an aryl group or a heteroaryl group is incorporated as a part of those substituents. "n" represents 0 or 1.

$Z_1$ represents an ethylenic unsaturated group, an ethyleneimine group, or an epoxy group. Listed as ethylenic unsaturated groups are, for example, a methylene group and a propylene group. Ethylenic unsaturated groups are preferred, while a methylene group is more preferred.

Specific examples represented by General Formula (1) are described below, however the present invention is not limited thereto.

1-1

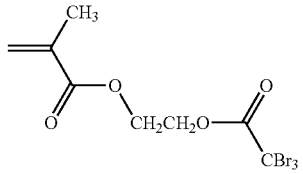

1-2

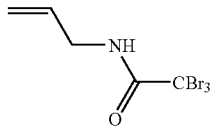

1-3

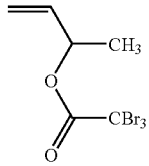

1-4

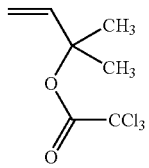

-continued
1-5
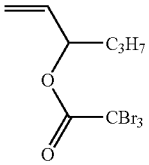
1-6
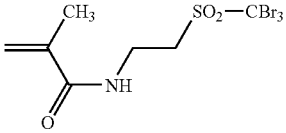
1-7
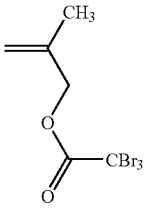
1-8
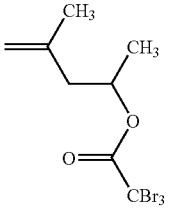
1-9
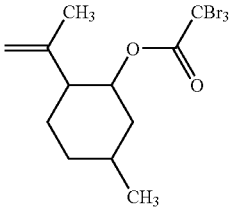
1-10
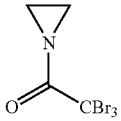
1-11
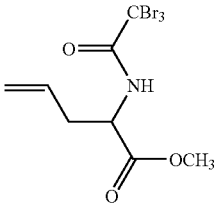
1-12
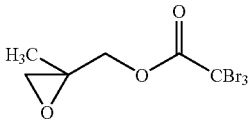
1-13
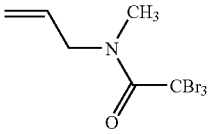
-continued
1-14
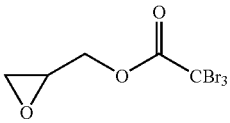
1-15
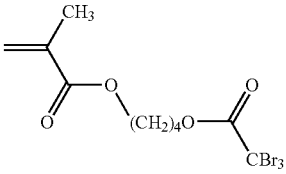
1-16
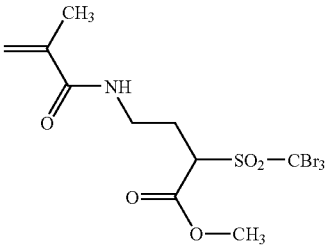
1-17
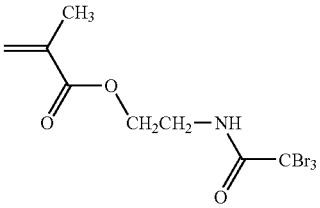
1-18
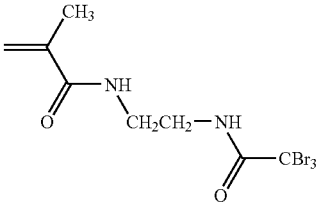
1-19
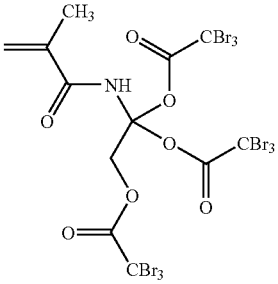
1-20
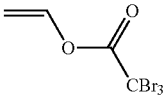
1-21
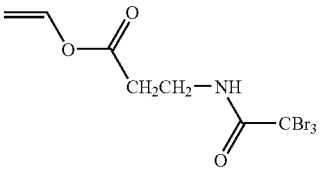

-continued 1-22

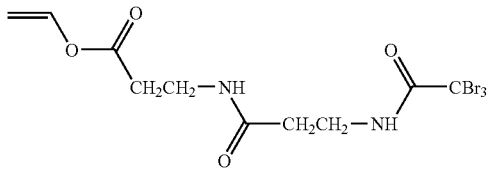

Further, in the present invention, it is preferable that aliphatic monomers having a halogen radical releasing group are those represented by General Formula (2) below.

General Formula (2)

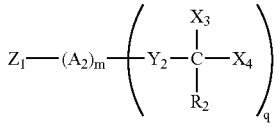

In General Formula (2), the halogen atoms represented by $X_3$ and $X_4$ are fluorine atoms, chlorine atoms, bromine atoms or iodine atoms, any of which may be the same or different. Of these, a chlorine atom, a bromine atom, and an iodine atom is preferred; a chlorine atom and a bromine atom are more preferred; and a bromine atom is most preferred.

$R_2$ represents a halogen atom or a substituent. Listed as substituents are those which are the same as $R_6$ of aforesaid General Formula (1).

$Y_2$ represents —N($R_3$)CO— or —OCO—, while $R_3$ represents a substituent. Listed as substituents represented by $R_3$ are those which are the same as $R_6$ of aforesaid General Formula (1).

"q" represents an integer of 1–3.

$A_2$ represents an aromatic group or a heterocyclic group. As used herein, the term "aromatic group" refers to a single ring or condensed ring aryl group preferably having 6–30 carbon atoms and more preferably 6–20 carbon atoms, and still more preferably a phenyl group or a naphthyl group. Listed as hetero rings are, for example, a pyridyl group, a pyradinyl group, a pyrimidyl group, a benzothiazole group, a benzimidazole, group, a thiadiazoryl group, a quinolyl group, and an isoquinolyl group. These aromatic groups or a heterocyclic group may have a substituent. Listed as substituents are a halogen atom (e.g., a fluorine atom, a chlorine atom, and a bromine atom), an alkyl group (e.g., a methyl group, an ethyl group, a propyl group, a butyl group, a pentyl group, an isopentyl group, a 2-ethyl-hexyl group, an octyl group, and a decyl group), a cycloalkynyl group (e.g., a cyclohexyl group and a cycloheptyl group), an aryl group (e.g., a phenyl group and a carboxyphenyl group), a heterocyclic group (e.g., an imidazolyl group, a thiazolyl group, a benzoxazolyl group, a pyridyl group, a pyrrolyl group, an indolyl group, and a pyrimidinyl group), an alkenyl group (e.g., an ethenyl-2-propenyl group, a 3-butenyl group, a 1-methyl-3-propenyl group, a 3-pentenyl group, and a 1-methyl-3-butenyl group), a cycloalkenyl group (e.g., a 1-cycloalkenyl group and a 2-cycloalkenyl group), an alkynyl group (e.g., an ethynyl group and a 1-propynyl group), an alkoxy group (e.g., a methoxy group, an ethoxy group, and a propoxy group), an acyloxy group (e.g., an acetyloxy group and a benzoyloxy group), an aryloxy group (e.g., a phenoxy group and a p-tolyloxy group), a heteroaryloxy group (e.g., a 2-pyridyloxy group and a pyrrolyloxy group), an alkylthio group (e.g., a methylthio group and a trifluoromethyl group), an arylthio group (e.g., a phenylthio group and a 2-naphthylthio group), a heteroarylthio group (e.g., a 3-trhienylthio group and a 3-pyrrolylthio group, an aralkyl group (e.g., a benzyl group and a 3-chlorobenzyl group), a carboxyl group, an acylamino group (e.g., an acetylamino group and a benzoylamino group), an acyloxycarbonylamino group (e.g., an acetyloxycarbonylamino group, a benzoyloxycarbonylamino group), a ureido group (e.g., a methylaminocarbonylamino group and a phenylaminocarbonylamino group), a sulfonylamino group (e.g., a metahnesulfonylamino group and a benzenesulfonylamino group), an acyl group (e.g., an acetyl group and a benzoyl group), a sulfonyl group (e.g., a methanesulfonyl group and a trifluoromethanesulfonyl group), a carbsamoyl group (e.g., a carbamoyl group, an N,N-dimethylcarbsamoyl group, and an N-morpholinocarbonyl group), a sulfamoyl group (a sulfamoyl group, an N,N-dimethylsulfamoyl group, and a morpholonosulfamoyl group), a trifluroromethyl group, a hydroxyl group, a styryl group, a nitro group, a cyano group, a sulfonamide group (e.g., a metahnesulfonamido group and a butanesulfonamido group), an amino group (e.g., a amino group, an N,N-dimethylamino group, an N,N-diethylamino group), a sulfo group, a phosphono group, a sulfite group, a sulfino group, a sulfonylaminocarbonyl group (e.g., a methanesulfonylaminocarbonyl group, an ethanesulfonylaminocarbonyl group), an acylaminosulfonyl group (e.g., an acetamidosulfonyl group, and a methoxyacetamidosulfonyl group), an acylaminocarbonyl group (e.g., an acetamidocarbonyl group and a methoxyacetamidocarbonyl group), a sulfinylaminocarbonyl group (e.g., a methanesulfinylaminocarbonyl group), and a sulfinylaminocarbonyl group (e.g., a methanesulfinylaminocarbonyl group and an ethanesulfinylaminocarbonyl group). Further, in the case of the presence of at least two substituents, they may be the same or different. "m" represents 0 or 1.

$Z_2$ represents an ethylenic unsaturated group, an ethyleneimino group, or an epoxy group. Listed as ethylenic unsaturated groups are, for example, a methylene group and a propylene group. Of these, an ethylene unsaturated group is more preferred, and an ethylene group is still more preferred.

Specific examples of the compounds represented by General Formulas (2) are listed below, however the present invention is not limited thereto.

2-1

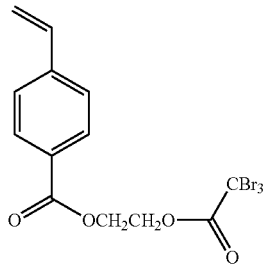

2-2

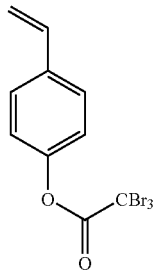

-continued 2-3

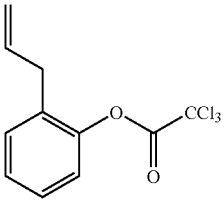

2-4

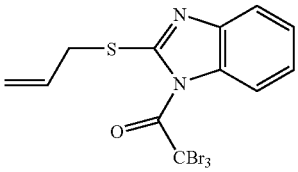

2-5

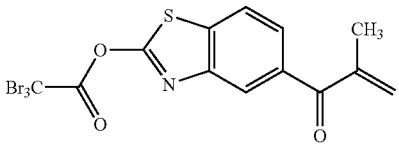

2-6

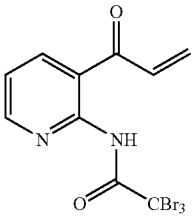

2-7

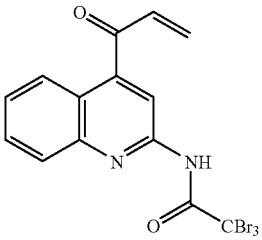

2-8

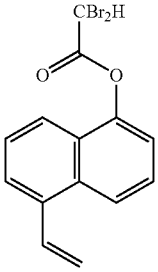

2-9

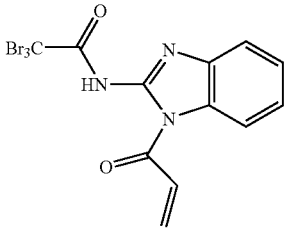

-continued 2-10

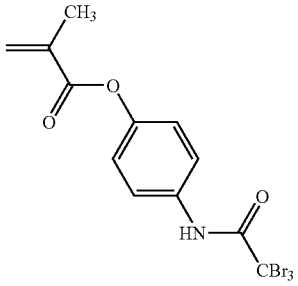

2-11

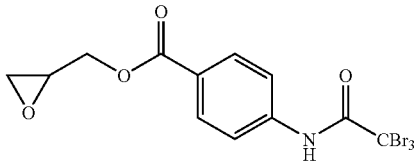

2-12

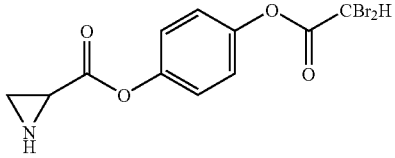

2-13

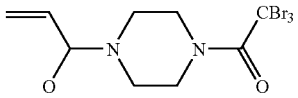

2-14

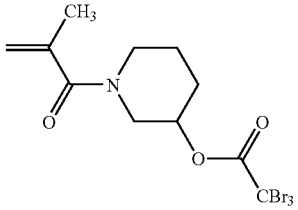

2-15

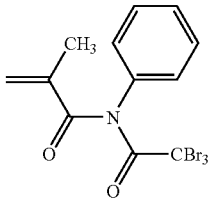

Specific examples of copolymerized polymers having a repeated unit derived from the compounds represented by General Formula (1) or (2) will now be listed, however, the present invention is not limited thereto.

TABLE 1

| Exemplified Compound No. | Monomer (a) Represented by General Formula (1) or (2) | Copolymerization Monomer (b) | Content Ratio of Monomer Unit (a) (weight percent) | Number Average Molecular Weight |
|---|---|---|---|---|
| P-1 | 1-1 | — | 100 | 5000 |
| P-2 | 1-1 | B | 25 | 8000 |
| P-3 | 1-17 | — | 100 | 4000 |
| P-4 | 1-17 | E | 40 | 7000 |
| P-6 | 1-20 | B | 34 | 10000 |

TABLE 1-continued

| Exemplified Compound No. | Monomer (a) Represented by General Formula (1) or (2) | Copolymerization Monomer (b) | Content Ratio of Monomer Unit (a) (weight percent) | Number Average Molecular Weight |
|---|---|---|---|---|
| P-7 | 1-20 | E | 48 | 8000 |
| P-8 | 2-2 | — | 100 | 3000 |
| P-9 | 2-2 | E | 63 | 6000 |
| P-10 | 2-8 | E | 42 | 11000 |
| P-11 | 2-8 | B | 13 | 50000 |
| P-12 | 2-10 | — | 100 | 5000 |
| P-13 | 2-10 | B | 35 | 4500 |

The content ratio of monomer unit (a) shown in Table 1 is the value obtained employing the formula described below.

$$\text{Content Ratio of monomer unit } (a) = absP/absM \times 100 \text{ (in percent)}$$

wherein absM represents absorbance per mg at 254 nm of the compound represented by General Formula (1) or (2), while absP represents absorbance per mg at 254 nm of the polymer having a repeated unit derived from the monomer represented by General Formula (1) or (2).

Polymers having a repeated unit derived from the monomer of the compound represented by General] Formula (1) or (2) used in the present invention may be employed individually or in combinations of at leapt two types.

It is easy to synthesize compounds having an ethylenic unsaturated group, an ethyleneimino group, or an epoxy group, and polymers thereof, employing the methods described, for example, in Shin Jikken Kagsaku Koza (New Experimental Chemistry Lectures) (Maruzen).

Synthetic examples of the compounds represented by General Formula (1) or (2) and polymers having a repeated unit which are derived from monomers thereof are described below, however, the present invention is not limited thereto.

SYNTHETIC EXAMPLE 1

Synthesis of Exemplified Compound 1-1

Mixed successively were 5.8 g of triethanolamine, 25 ml of dichloromethane, and 5.0 g of 2-hydroxyethyl methacrylate. While cooled with iced water, a solution prepared by dissolving 12.1 g of tribromoacetyl chloride in 10 ml of dichloroethane, was dripped into the resulting mixture. After dripping, the resultant mixture was stirred at room temperature for three hours, and then 100 ml of ethyl acetate was added. Thereafter, the resultant organic layer was washed successively with 50 ml of 1 mol/L hydrochloric acid, 50 ml of a saturated sodium hydrogencarbonate solution, and 50 ml of a saturated sodium chloride solution. Dehydration was performed employing magnesium sulfate, and after filtration, concentration under reduced pressure was carried out, whereby crude crystals were obtained. The resultant crystals were recrystallized employing ethanol, whereby targeted Exemplified Compound 1-1 (11.0 g) was obtained.

SYNTHETIC EXAMPLE 2

Synthesis of Exemplified Compound 2-2

Mixed successively were 6.3 g of triethanolamine, 25 ml of dichloromethane, and 5.0 g of 4-vinylphenol. While cooled with iced water, a solution prepared by dissolving 14.4 g of tribromoacetyl chloride in 10 ml of dichloroethane, was dripped into the resulting mixture. After dripping, the resultant mixture was stirred at room temperature for three hours, and then 100 ml of ethyl acetate was added. Thereafter, the resultant organic layer was washed successively with 50 ml of 1 mol/L hydrochloric acid, 50 ml of a saturated sodium hydrogencarbonate solution, and 50 ml of a saturated sodium chloride solution. Dehydration was performed employing magnesium sulfate, and after filtration, concentration under reduced pressure was carried out, whereby crude crystals were obtained. The resultant crystals were recrystallized employing ethanol, whereby targeted Exemplified Compound 2-2 (13.2 g) was obtained.

SYNTHETIC EXAMPLE 3

Synthesis of Homopolymer Having a Repeated Unit of Exemplified Compound 1-1

Mixed successively were 10 g of above Exemplified Compound 1-1, 80 ml of dehydrated tetrahydrofuran, and 0.3 g of boron trifluoride-diethyl ether complex, and the resultant mixture was refluxed for ten hours while heated. After cooling, concentration under reduced pressure was performed. The resultant residues were dissolved in tetrahydrofuran and purified employing repeated precipitation employing methanol, whereby 5 g of a homopolymer of a number average molecular weight of 5,000 was obtained.

SYNTHETIC EXAMPLE 4

Synthesis of Copolymer Having a Repeated Unit of Exemplified Compound 1-20

Mixed successively were 10 g of Denka Butyral (#$^2$000-L, having a degree of polymerization of approximately 300), 300 ml of toluene, and 2.5 g of pyridine. While cooled with iced water, a solution prepared by dissolving 18 g of tribromoacetyl chloride in 20 ml of toluene was dripped into the resulting mixture. After dripping, the resultant mixture was stirred at room temperature for three hours, and 500 ml of ethyl acetate was added. Thereafter, the resultant organic layer was washed successively with 50 ml of 1 mol/L hydrochloric acid, 50 ml of a saturated sodium hydrogencarbonate solution, and 50 ml of a saturated sodium chloride solution. Dehydration was performed employing magnesium sulfate, and after filtration, concentration under reduced pressure was carried out. The resultant residues were dissolved in methyl ethyl ketone and purified employing repeated precipitation employing hexane, whereby 19 g of a copolymer of a number average molecular weight of 20,000 was obtained. After determining absorbance of the resultant copolymer at 254 nm, it was confirmed that the content ratio of the tribromovinyl acetate unit was 21 percent by weight.

It is possible to add polymers having a repeated unit derived from monomers of the compounds represented by General Formula (1) or (2) to any of the light-sensitive layers containing silver halide emulsions and the light-insensitive layer. However, it is preferable that the above polymers are added to the light-sensitive layer or the light-insensitive layer adjacent to a light-sensitive layer. Further, the added amount is not particularly limited in cases in which polymers having a repeated unit derived from monomers of the compounds represented by General Formula (1) or (2) are added to heat developable materials. However, the above added amount is customarily in the range of $1\times10^{-4}$–1.0 mol by monomer unit (a) per mol of silver halide, and is preferably in the range of $1\times10^{-3}$–0.3 mol.

It is possible to use the polymers having a repeated unit derived from monomers of the compounds represented by General Formula (1) or (2) according to the present invention by dissolving them in suitable organic solvents such as alcohols (e.g., methanol, ethanol, propanol, or fluorinated alcohol), ketones (e.g., acetone or methyl ethyl ketone), dimethylformamide, dimethylsulfoxide, and methyl cellosolve. Further, it is also possible to incorporate those employing conventionally well known emulsification dispersing methods. For example, dissolution is performed employing high boiling point organic solvents such as dibutyl phthalate, tricresyl phosphate, or glyceryl triacetate, as well as auxiliary solvents such as ethyl acetate or cyclohexane. Subsequently, emulsion dispersion is prepared by mechanical dispersion, and it is possible to incorporate the resultants dispersion into any of the desired constituting layers.

Further, by employing a method known as a solid dispersion method, it is possible to disperse the polymers having a repeated unit derived from monomers of the compounds represented by General Formula (1) or (2) according to the present invention into a water based minute particle dispersion, employing dispersing devices such as a ball mill, a colloid mill or an ultrasonic homogenizer. Subsequently, it is possible to add the resultant dispersion in an optional manner.

It is preferable that the silver salt photothermographic dry imaging materials of the present invention incorporate at least one of the compounds represented by following General Formula (3) as a stabilizer.

General Formula (3)

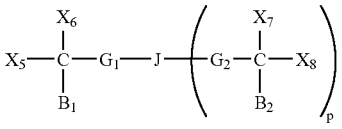

In above General Formula (3), the halogen atoms represented by $X_5$, $X_6$, $X_7$, and $X_8$ are fluorine atoms, chlorine atoms, bromine atoms and iodine atoms which may be the same or different. Of these, a chlorine atom, a bromine atom, and an iodine atom are preferred; a chlorine atom and a bromine atom are more preferred; while a bromine atom is most preferred.

$B_1$ and $B_2$ each independently represent a hydrogen atom, a halogen atom, or a substituent. Listed as substituents are, for example, an alkynyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfonyl group, a cyano group, and a heterocyclic group.

"q" represents an integer of 1, 2, or 3.

$G_1$ and $G_2$ each independently represent a linking group. Listed as linking groups are, for example, —$SO_2$—, —CO—, —NHCO—, —OOC—, and —$N(R_8)SO_2$— wherein $R_8$ represents a substituent. Further, linking groups may be formed while bonded to the group selected from —S—, —NH—, —CO—, and —O— via an alkyl group. Listed as substituents represented by $R_8$ are, for example, a halogen atom, an alkyl group, a cycloalkyl group, an alkenyl group, a cycloalkenyl group, an alkynyl group, an acyloxy group, an alkylthio group, a carboxyl group, an acylamino group, an acyl group, and a trifluoromethyl group. $G_1$ and $G_2$ may be the same or different. When both $G_1$ and $G_2$ represent —$SO_2$—, "p" represents an integer of 2 or 3.

J represents an alkylene group, a cycloalkylene group, an alkenylene group, or an alkynylene group having p+1 valence. Preferred are an alkylene group and a cycloalkylene group having a total number of carbon atoms of 2–20. Of these, particularly preferred are an alkylene group and a cycloalkylene group having a total number of carbon atoms of 2–10. These substituents may further have a substituent. Examples of the above substituents include a halogen atom (e.g., a fluorine atom, a chlorine atom, and a bromine atom), an alkyl group (e.g., a methyl group, an ethyl group, a propyl group, a butyl group, a pentyl group, an iso-pentyl group, a 2-ethyl-hexyl group, an octyl group, and a decyl group), a cycloalkyl group (e.g., a cyclohexyl group and a cycloheptyl group), an alkenyl group (e.g., an ethenyl-2-propenyl group, a 3-butenyl group, a 1-methyl-3-propenyl group, a 3-pentenyl group, and a 1-methyl-3-butenyl group), a cycloalkenyl group (e.g., a 1-cycloalkenyl group and a 2-cycloalkenyl group), an alkynyl group (e.g., an ethynyl group and a 1-propinyl group), an alkoxy group (e.g., a methoxy group, an ethoxy group, and a propoxy group), an alkylcarbonyloxy group (e.g., an acetyloxy group), an alkylthio group (e.g. a methylthio group and a trifluoromethylthio group), a carboxyl group, an alkylcarbonylamino group (e.g., an acetylamino group), a ureido group (e.g., a methylaminocarbonylamino group), an alkylsulfonylamino group (e.g., a methanesulfonylamino group), an alkylsulfonyl group (e.g., a methanesulfonyl group and trifluoromethanesulfonyl group), a carbamoyl group (e.g., a carbamoyl group, an N,N-dimethylcarbamoyl group, and an N-morpholinocarbonyl group), a sulfamoyl group (e.g., a sulfamoyl group, an N,N-dimethylsulfamoyl group, and a morpholinosulfamoyl group), a trifluoromethyl group, a hydroxyl group, a nitro group, a cyano group, an alkylsulfonamido group (e.g., a methanesulfonaamido group and a butanesulfonamido group), an alkylamino group (e.g., an amino group, an N,N-dimethylamino group, and an N,N-diethylamino group), a sulfo group, a phosphono group, a sulfite group, a sulfino group, an alkylsulfonylaminocarbonyl group (e.g., a methanesulfonylaminocarbonyl group and an ethanesulfonylaminocarbonyl group), an alkylcarbonylaminosulfonyl group (e.g., an acetamidosulfonyl group and a methoxyacetamidosulfonyl group), an alkynylaminocarbonyl group (e.g., an acetamidocarbonyl group and a methoxyacetamidocarbonyl group), an alkylsulfinylaminocarbonyl group (e.g., a methanesulfinylaminocarbonyl group and an ethanesulfinylaminocarbonyl group). Further, in the case in which at least two substituents are present, they may be the same or different. However, there is no case in which an aryl group or a heteroaryl group is incorporated as a part of those substituents.

Specific examples of the compounds represented by General Formula (3) will now be listed below, however, the present invention is not limited thereto.
AF-1
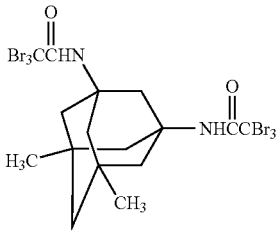
AF-2
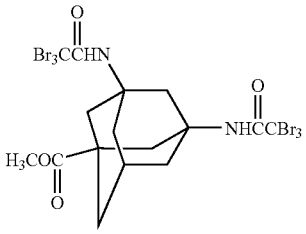
AF-3
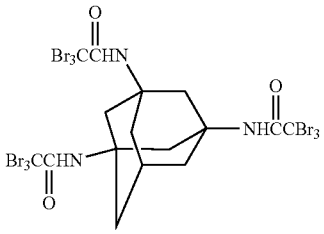
AF-4
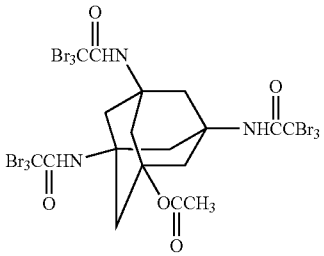
AF-5
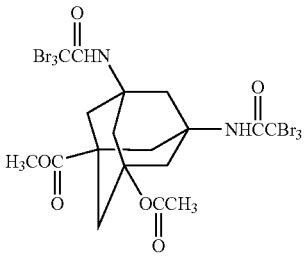
AF-6
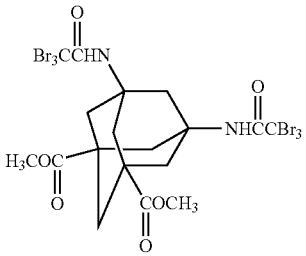
-continued
AF-7
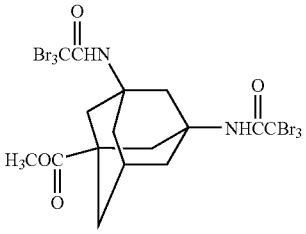
AF-8
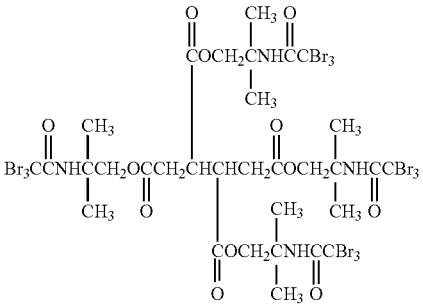
AF-9
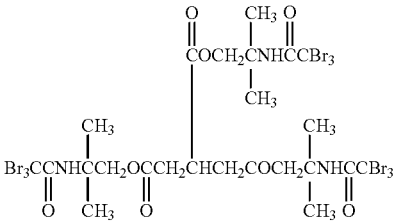
AF-10
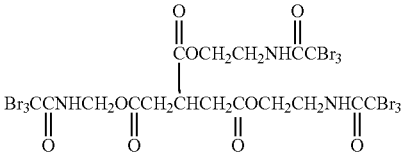
AF-11
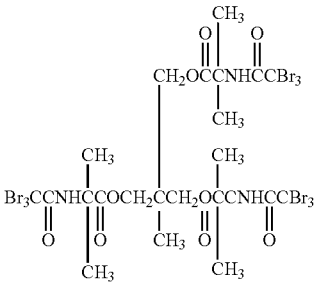
AF-12
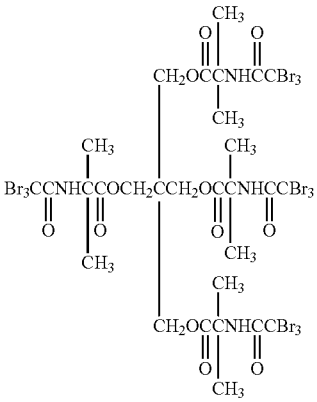

-continued

AF-13

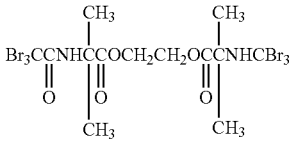

AF-14

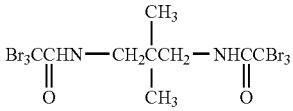

AF-15

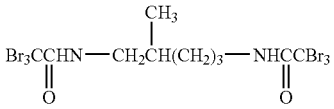

AF-16

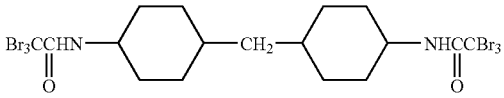

AF-17

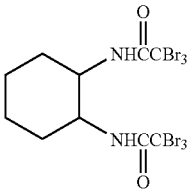

AF-18

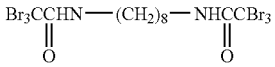

AF-19

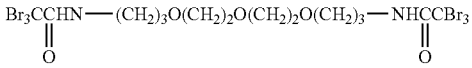

AF-20

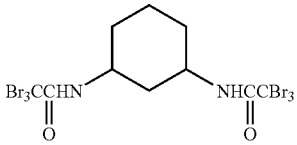

AF-21

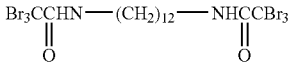

AF-22

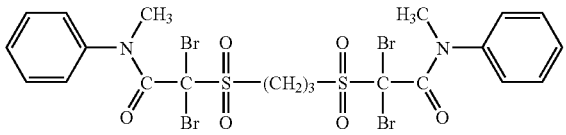

AF-23

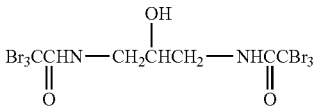

AF-24

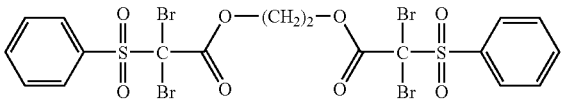

-continued

AF-25

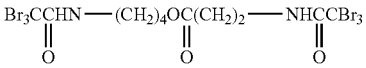

AF-26

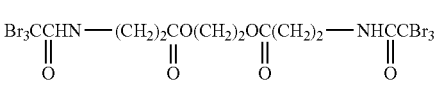

AF-27

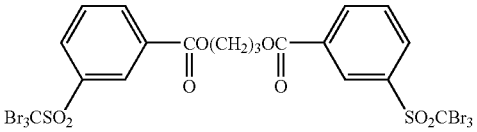

AF-28

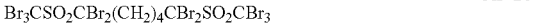

AF-29

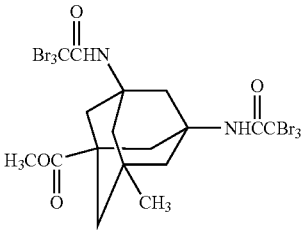

AF-30

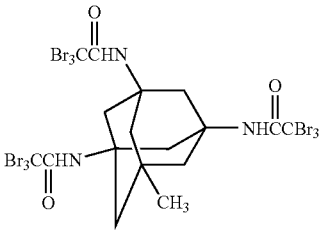

AF-31

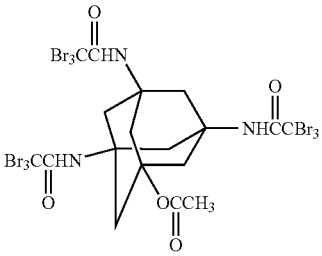

It is possible to add the compounds represented by General Formula (3) to any of the light-sensitive layers containing silver halide emulsions and the light-insensitive layers. However, it is preferable that those compounds are added to the light-sensitive layers or the light-insensitive layers adjacent to the light-sensitive layer. Further, the amount of the compounds represented by General Formula (3) added to heat developable materials is commonly in the range of about $1\times10^{-4}$–about 0.1 mol per mol of silver halide, and is particularly preferably in the range of $1\times10^{-3}$–0.3 mol.

One of the features of the silver salt photothermographic dry imaging materials of the present invention is that silver ion reducing agents are incorporated in the light-sensitive layer. The types of employed reducing agents are not particularly limited. However, in the present invention, a reducing agent is preferably one selected from the compounds represented by General Formulas (A-1)–(A-3) below.

General Formula (A-1)

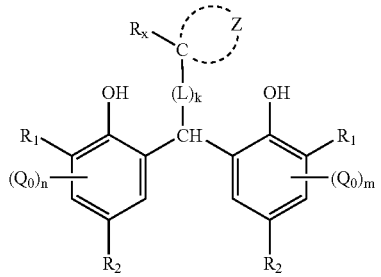

General Formula (A-2)

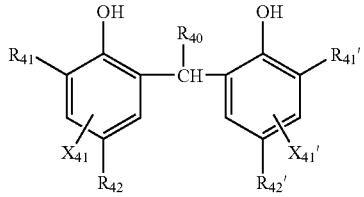

General Formula (A-3)

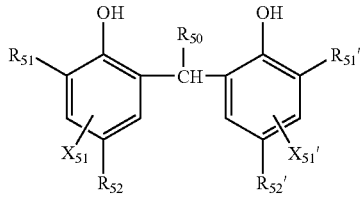

General formula (A)

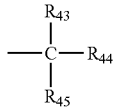

In General Formula (A-1), Z represents a group of atoms which is required to form a 3- to 10-membered ring together with carbon atoms, and is preferably a 3- to 10-membered non-aromatic ring or a 5- to 6-membered aromatic ring, and is more preferably a 3- to 10-membered non-aromatic ring. Specific examples of the above rings include cyclopropyl, aziridyl, and oxiranyl as a 3-membered ring; cyclobutyl, cyclobutenyl, oxetanyl, and azetidinyl as a 4-membered ring; cyclopentyl, cyclopentenyl, cyclopentadienyl, tetrahydrofuranyl, pyrrolidinyl, and tetrahydrothienyl as a 5-membered ring; cyclohexyl, cyclohexenyl, cyclohexadienyl, tetrahydropyranyl, pyranyl, pieridinyl, dioxanyl, tetrahydrothiopyranyl, norcholanyl, norpynanyl, and nonbornyl as a 6-membered ring; cycloheptyl, cycloheptinyl, and cycloheptadienyl as an 8-membered ring; cyclonanonyl, cyclononenyl, cyclonadienyl, and cyclononatrienyl as a 9-membered ring; and cyclodecanyl, cyclodedecenyl, cyclodecadienyl, and cyclodecateienyl as a 10-membered ring.

Of these, a 3- to 6-membered ring is preferred; a 5- to 6-membered ring is more preferred; while a 6-membered ring is most preferred. Of 6-membered rings, a hydrocarbon ring containing no heteroatom is preferred. The above ring may form a spiro bond with another ring via a spiro atom and may form a condensed ring with another ring containing an aromatic ring in any manner. It is further possible to have any substituent on the ring. It is particularly preferred that the above hydrocarbon ring contains an alkenyl structure and an alkynyl structure having —C═C— as well as —C≡C—.

Specific substituents include a halogen atom (e.g., a fluorine atom, a chlorine atom, and a bromine atom), an alkyl group (e.g., a methyl group, an ethyl group, a propyl group, a butyl group, a pentyl group, an iso-pentyl group, a 2-ethyl-hexyl group, an octyl group, and a decyl group), a cycloalkyl group (e.g., a cyclohexyl group and a cycloheptyl group), an alkenyl group (e.g., an ethenyl-2-propenyl group, a 3-butenyl group, a 1-methyl-3-propenyl group, a 3-pentenyl group, and a 1-methyl-3-butenyl group), a cycloalkenyl group (e.g., a 1-cycloalkenyl group and a 2-cycloalkenyl group), an alkynyl group (e.g., an ethynyl group and a 1-propinyl group), an alkoxy group (e.g., a methoxy group, an ethoxy group, and a propoxy group), an alkylcarbonyloxy group (e.g., an acetyloxy group), an alkylthio group (e.g., a methylthio group and a trifluoromethylthio group), a carboxyl group, an alkylcarbonylamino group (e.g., an acetylamino group), a ureido group (e.g., a methylaminocarbonylamino group), an alkylsulfonylamino group (e.g., a methanesulfonylamino group), an alkylsulfonyl group (e.g., a methanesulfonyl group and trifluoromethanesulfonyl group), a carbamoyl group (e.g., a carbamoyl group, an N,N-dimethylcarbamoyl group, and an N-morpholinocarbonyl group), a sulfamoyl group (e.g., a sulfamoyl group, an N,N-dimethylsulfamoyl group, and a morpholinosulfamoyl group), a trifluoromethyl group, a hydroxyl group, a nitro group, a cyano group, an alkylsulfonamido group (e.g., a methanesulfonamido group and A butanesulfonamido group), an alkylamino group (e.g., an amino group, an N,N-dimethylamino group, and an N,N-diethylamino group), a sulfo group, a phosphono group, a sulfite group, a sulfino group, an alkylsulfonylaminocarbonyl group (e.g., a methanesulfonylaminocarbonyl group and an ethanesulfonylaminocarbonyl group), an alkylcarbonylaminosulfonyl group (e.g., an acetamidosulfonyl group and a methoxyacetamidosulfonyl group), an alkynylaminocarbonyl group (e.g., an acetamidocarbonyl group and a methoxyacetamidocarbonyl group), an alkylsulfinylaminocarbonyl group (e.g., a methanesulfinylaminocarbonyl group and an ethanesulfinylaminocarbonyl group). Further, in the case in which at least two substituents are present, they may be the same or different. Of these, the particularly preferred substituents is an alkyl group.

A case in which Z represents a 5- to 6-membered ring-shaped group will now be described. An aromatic carbon ring may be a single ring or a condensed ring, and is preferably a single ring or a double ring having 6–30 carbon atoms such as aromatic carbon rings (e.g., a benzene ring and a naphthalene ring). Of these, a benzene ring is preferably employed. Further, preferred as aromatic heterocycles are those which are 5- to 6-membered aromatic heterocycles which may have a condensed ring. Preferred as such heterocycles are imidazole, pyrazole, thiophene, furan, pyrrole, pyridine, pyrimidine, pyrazine, pyridazine, triazole, triazine, indole, indazole, purine, thiadiazole, oxazole, oxadiazole, quinoline, phthalazine, naphthylizine, quinoxaline, quinazoline, cinnoline, pteridine, acridine, phenanthroline, phenoazine, tetrazole, thiazole, oxazole, benzimidazole, benzoxazole, benzothiazole, indolenine, or tatraazaindene. Of these, more preferred are imidazole, pyrazole, thiophene, furan, pyrrole, triazole, thiadiazole, tetrazole, thiazole, benzimidazole, and benzothiazole, and particularly preferred are thiophene, furan, and thiazole. The above ring may form without limitation, a condensed ring with another ring. Further, it is possible to have any of the above substituents on the ring. Listed as substituents may be same ones as on the 3- to 10-membered non-aromatic ring-shaped group described above. In the case in which Z is a 5- to 6-membered aromatic ring shaped group, it is most preferable that Z is a 5-membered aromatic heterocyclic group.

$R_1$ and $R_2$ are each preferably a hydrogen atom, an alkyl group, an alkenyl group, an alkynyl group, an aryl group, or a heterocyclic group. Preferably as an alkyl group, an alkenyl group, and an alkenyl group are those having 1–10 carbon atoms. Specific examples of alkyl groups include a methyl group, an ethyl group, a propyl group, a butyl group, a hexyl group, a cyclohexyl group, and a butyl group. Specific examples of alkenyl groups include a vinyl group, an allyl group, a butenyl group, a hexenyl group, a cyclohexenyl group, a hexadienyl group, an ethenyl-2-propenyl group, a 3-butenyl group, a 1-methyl-3-propenyl group, a 3-pentenyl group, and a 1-methyl-3-butenyl group. Specific examples of alkynyl groups include an ethynyl group and a 1-propynyl group. Specific examples of aryl groups include a benzene ring and a naphthalene ring. Specific examples of heterocyclic groups include a thiophene group, a furan group, an imidazole group, a pyrazole group, and a pyrrole group.

Preferably listed as $R_1$ are a methyl group, an ethyl group, an isopropyl group, a t-butyl group, a cyclohexyl group, and a 1-methylcyclohexyl group. Of these, more preferred are a methyl group, a t-butyl group, and a 1-methylcyclohexyl group, and most preferred are a t-butyl group and a 1-methylcyclohexyl group. Preferably listed as $R_2$ are a methyl group, an ethyl group, an isopropyl group, a t-butyl group, a cyclohexyl group, a 1-methylcyclohexyl group, and a 2-hydroxyethyl group. Of these, more preferred are a methyl group and a 2-hydroxyethyl group. Specifically listed as the aryl groups represented by $R_1$ and $R_2$ are a phenyl group, a naphthyl group, and an anthranyl group. Specifically listed as the heterocyclic groups represented by $R_1$ and $R_2$ are aromatic heterocyclic groups such as a pyridine group, a quinoline group, an isoquinoline group, an imidazole group, a pyrazole group, a triazole group, an oxazole group, a thiazole group, an,oxadiazole group, a thiadiazole group, or a tetrazole group, as well as non-aromatic heterocyclic groups such as a piperidino group, a morpholino group, a tetrahydrofuryl group, a tetrahydrothienyl group, or a tetrahydropyranyl group. These groups may further have a substituent. Listed as such substituents may be those on the ring described above.

The most preferred combinations of $R_1$ and $R_2$ are that $R_1$ is a tertiary alkyl group (e.g., a butyl group and a 1-methylcyclohexyl getup) and $R_2$ is a primary alkyl group (e.g., a methyl group and a 2-hyrsoxyethyl group).

$R_X$ is preferably a hydrogen atom, an alkyl group, an alkenyl group, an alkynyl group, an aryl group, or a heterocyclic group. Preferably as an alkyl group, an alkenyl group, and an alkenyl group are those having 1–10 carbon atoms. Specific examples of alkyl groups include a methyl group, an ethyl group, a propyl group, a butyl group, a hexyl group, a cyclohexyl group, and a butyl group. Specific examples of alkenyl groups include a vinyl group, an allyl group, a butenyl group, a hexenyl group, a cyclohexenyl, group, a hexadienyl group, an ethenyl-2-propenyl group, a 3-butenyl group, a 1-methyl-3-propenyl group, a 3-pentenyl group, and a 1-methyl-3-butenyl group. Specific examples of alkynyl groups include an ethynyl group and a 1-propynyl group. Specific examples of aryl groups include a benzene ring and a naphthalene ring. Specific examples of heterocyclic groups include a thiophene group, a furan group, an imidazole group, a pyrazole group, and a pyrrole group. More preferably listed are a methyl group, an ethyl group, and an isopropyl group. $R_X$ is preferably a hydrogen atom.

$Q_o$ represents a group capable of being substituted on a benzene ring. Listed as specific groups may be an alkyl group having 1–25 carbon atoms (a methyl group, an ethyl group, a propyl group, an isopropyl group, a t-butyl group, a pentyl group, a hexyl group, and a cyclohexyl group); a halogenated alkyl group (a trifluoromethyl group and a perfluorooctyl group); a cycloalkyl group (a cyclohexyl group and a cyclopentyl group); an alkynyl group (a propalgyl group); a glycidyl group; an acrylate group; a methacrylate group; an aryl group (a phenyl group), a heterocyclic group (a pyridyl group, a thiazolyl group, an oxazolyl group, an imidazolyl group, a furyl group, a pyrolyl group, a pyradinyl group, a pyrimidinyl group, a pyridadinyl group, a selenazolyl group, a sulforanyl group, a pyperidinyl group, a pyrazolyl group, and a tetrazoyl group); a halogen atom (a chlorine atom, a bromine atom, an iodine atom, and a fluorine atom); an alkoxy group (a methoxy group, an ethoxy group, a propyloxy group, a pentyloxy group, a cyclopentyloxy group, a hexyloxy group, and a cyclohexyloxy group); an aryloxy group (a phenoxy group); an alkoxycarbonyl group (a methyloxycarbonyl group, an ethyloxycarbonyl group, and a butyloxycarbonyl group); an aryloxycarbonyl group (a phenyloxycarbonyl group), a sulfonamido group (a methanesulfonamido group, an ethanesulfonamido group, a butanesulfonamido group, a hexanesulfonamido group, a cyclohexanesulfonamido group, and a benzenesulfonamido group); a sulfamoyl group (an aminosulfonyl group, a methylaminosulfonyl group, a dimethylaminosulfonyl group, a butylaminosulfonyl group, a hexylaminosulfonyl group, a cyclohexylaminosulfonyl group, a phenylaminosulfinyl group, and a 2-pyridylaminosulfonyl group); a urethane group (a methylureido group, an ethylureido group, a pentylureido group, a cyclohexylureido group, a phenylureido group, and a 2-pyridylureido group); an acyl group (an acetyl group, a propionyl group, a butanoyl group, a hexanoyl group, a cyclohexanoyl group, a benzoyl group, and a pyridinoyl group); a carbamoyl group (an aminocarbonyl group, a methylaminocarbonyl group, a dimethylaminocarbonyl group, a propylaminocarbonyl group, a pentylaminocarbonyl group, a cyclohexylaminocarbonyl group, a phenylaminocarbonyl group, and a 2-pyridylaminocarbonyl group); an amido group (an acetamido group, a propionamido group, a butaneamido group, a hexaneamido group, and a benzamido group); a sulfonyl group (a methylsulfonyl group, an ethylsulfonyl group, a butylsulfonyl group, a cyclohexylsulfonyl group, a phenylaulfonyl group, and a 2-pyridylsulfonyl group); an amino group (an amino group, an ethylamino group, a diethylamino group, a butylamino group, a cyclopentylamino group, an anilino group., and a 2-pyridylamino group; a cyano group, a nitro group, a sulfone group, a carboxyl group, a hydroxyl group, and an oxamoyl group. Further, these groups may be substituted with any of these groups. "n" and "m" each represent an integer of 0–2, and the most preferred case is that both represent 0.

L represents a divalent linking group and is preferably an alkylene group such as a methylene group or a ethylene group. The number of carbon atoms is preferably 1–20, and is more preferably 1–5. "k" represents 0 or 1 and the case in which "k" is 0 is most preferred.

The reducing agents represented by General Formula (A-2) or (A-3) will now be described.

In above General Formula (A-2), $R_{40}$ represents aforesaid General Formula (A), and $R_{43}$–$R_{45}$ each represent a hydrogen atom or a substituent. Listed as the substituents represented by $R_{43}$–$R_{45}$ are, for example, an alkyl group (a methyl group, an ethyl group, a propyl group, an isopropyl group, a cyclopropyl group, a butyl group, a sec-butyl group, a cyclohexyl group, and a 1-methyl-cyclohexyl group); an alkenyl group (a vinyl group, a propenyl group, a butenyl group, a pentenyl group, an isohexenyl group, a cyclohexenyl group, a butenylidene group, and an isopentylidene group); an alkynyl group (an ethynyl group, and a propinylidene group); an aryl group (a phenyl group and a naphthyl group); a heterocyclic group (a furyl group, a thienyl group, a pyridyl group, and a tetrahydrofuranyl group); and others such as halogen, a hydroxyl group, an alkoxy group, an aryloxy group, an acyloxy group, a sulfonyloxy group, a nitro group, an amino group, an acylamino group, a sulfonylamino group, a sulfonyl group, a carboxyl group, an alkoxycarbonyl group, an aryloxycarbonyl group, a carbamoyl group, a sulfamoyl group, a cyano group, and a sulfo group.

In the case in which "C" of above General Formula (A) does not form a ring with any of $R_{43}$–$R_{45}$, $R_{40}$ incorporates an ethylene group (such as 2,6-dimethyl-5-butenyl or 1,5-dimethyl-4-hexenyl) capable of having at least one substituent, or an acetylene group (1-propinyl) capable of being substituted.

In the case in which "C" of above General Formula (A) forms a ring (such as phenyl, naphthyl, furyl, thienyl, pyridyl, cyclohexyl, or cyclohexenyl) with any of $R_{43}$–$R_{45}$, $R_{40}$ incorporates, in the exterior of the ring, an ethylene group (such as vinyl, propenyl, acryloxy, or mathacryloxy) capable of having at least one substituent or an acetylene group (such as ethynyl or acetylenecarbonyloxy) capable of being substituted.

$R_{41}$, $R_{41}'$, $R_{42}$, $R_{42}'$, $X_{41}$, and $X_{41}'$ each represent a hydrogen atom or a substituent. Listed as substituents are the same as those which are listed for describing $R_{43}$–$R_{45}$.

Preferably listed as $R_{41}$, $R_{41}'$, $R_{42}$, and $R_{42}'$ are alkyl groups. Specifically listed as those are the same alkyl groups which are listed for describing $R_{43}$–$R_{45}$.

In above General Formula (A-3), $R_{50}$ represents a hydrogen atom or a substituent. Listed as the substituents are the same as those which are listed for describing $R_{43}$–$R_{45}$ of General Formula (A-2). Preferred as $R_{50}$ are a hydrogen atom, an alkyl group, an alkenyl group, and an alkynyl group. Of these, a hydrogen atom and an alkynyl group are more preferred.

$R_{51}$, $R_{51}'$, $R_{52}$, $R_{52}'$, $X_{51}$, and $X_{51}'$ each represents a hydrogen atom and a substituent. Listed as the substituents are the same as those which are listed for describing $R_{43}$–$R_{45}$.

Preferably listed as $R_{51}$, $R_{51}'$, $R_{52}$, and $R_{52}'$ are alkyl groups, alkenyl groups, and alkynyl groups. Specifically listed as those which are alkyl groups which are listed for describing $R_{43}$–$R_{45}$.

However, at least one of $R_{51}$, $R_{51}'$, $R_{52}$, $R_{52}'$, $X_{51}$, and $X_{51}'$ incorporates an ethylene group (such as vinyl, allyl, or methacryloxymethyl) capable of being substituted, or an acetylene group (such as ethynyl, propagyl, or propagyloxycarbonyloxymethyl) capable of being substituted.

In the present invention, it is preferable to simultaneously use the compounds represented by aforesaid General Formula (A-1) and the compounds represented by General Formula (A-4) below. The combination ratio is preferably weight of the compounds represented by General Formula (A-1):weight of the compounds represented by General Formula (A-4)=99:5–55:45, and is more preferably 90:10–60:40.

General Formula (A-4)

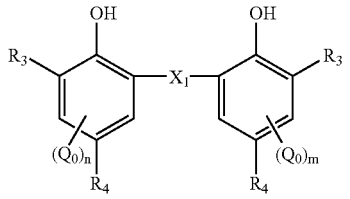

In above General Formula (A-4), $X_1$ represents a chalcogen atom or CHR. Listed as chalcogen atoms are sulfur, selenium, and tellurium. Of these, a sulfur atom is preferred. R in CHR represents a hydrogen atom, a halogen atom, and an alkyl group. Listed as halogen atoms are, for example, a fluorione atom, a chlorine atom, and a bromine atom. Preferred as alkyl groups are substituted or unsubstituted alkyl groups having 1–20 carbon atoms. Specific examples of alkyl groups include a methyl group, an ethyl group, a propyl group, a butyl group, a hexyl group, a heptyl group, a vinyl group, an allyl group, a butenyl group, a hexadienyl group, an ethenyl-2-propenyl group, a 3-butenyl group, a 1-methyl-3-propenyl group, a 3-pentenyl group, and a 1-methyl-3-butenyl group.

These groups may further have a substituent. Employed as the substituents are those described in General Formula (A-1). Further, in the case of the presence of at least two substituents, they may be the same or different.

$R_3$ represents an alkyl group and both $R_3$s may be the same or different. However, at least one of $R_3$ is a secondary or tertiary alkyl group. Preferred as alkyl groups are substituted or unsubstituted alkyl groups having 1–20 carbon atoms. Specific examples of alkyl groups include a methyl group, an ethyl group, a propyl group, an isopropyl group, a butyl group, an isobutyl group, a t-butyl group, a t-amyl group, a t-octyl group, a cyclohexyl group, a cyclopentyl group, a 1-methylcyclohexyl group, and a 1-methylcyclopropyl group.

Substituents of the alkoxy group are not particularly limited. Listed as the substituents are, for example, an aryl group, a hydroxyl group, an alkoxy group, an aryloxy group, an alkylthio group, an arylthiogroup, an acylamino group, a sulfonamido group, a sulfonyl group, a phosphoryl group, an acyl group, a carbamoyl group, an ester group, and a halogen atom. Further, a saturated ring may be formed with (Q0)n and (Q0)m. Any of $R_3$s is preferably a secondary or tertiary alkyl group having 2–20 carbon atoms. A tertiary alkyl group is more preferred, while a t-butyl group, a t-amyl group, and a 1-methylchclohexyl group are still more preferred, and a 1-methylcyclohexyl group is most preferred.

$R_4$ represents a hydrogen atom and a substituent capable of being substituted on a benzene ring. Listed as groups capable of being substituted on a benzene ring are for example, a halogen atom such as a fluorine atom, a chlorine atom, or a bromine atom, an alkyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfonyl group, a cyano group, and a heterocyclic group. A plurality of $R_3$ and $R_4$ may be the same or different.

The number of carbon atoms of $R_4$ is preferably 1–5, and is more preferably 1–2. These groups may further have a substituent. Employed as the substituents may be those described in General Formula (A-1). $R_4$ is preferably an alkyl group having 1–20 carbon atoms, and a methyl group is most preferred.

$Q_0$ is as defined for those in General Formula (A-1). Further, $Q_0$ may form a saturated ring with $R_3$ and $R_4$. $Q_0$ is preferably a hydrogen atom, a halogen atom, or an alkyl group, and is more preferably a hydrogen atom.

Specific example of the compounds represented by General Formulas (A-1)–(A-4) according to the present invention are listed below; however, the present invention is not limited thereto.

(1-1)

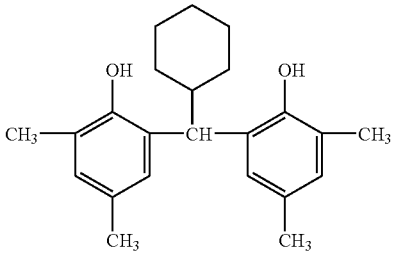

(1-2)

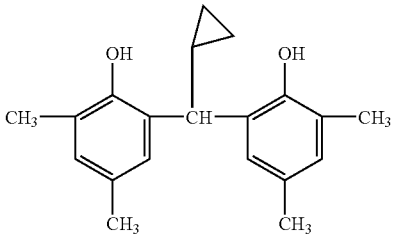

(1-3)

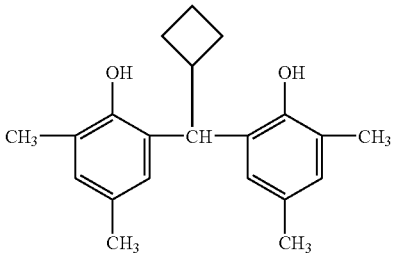

(1-4)

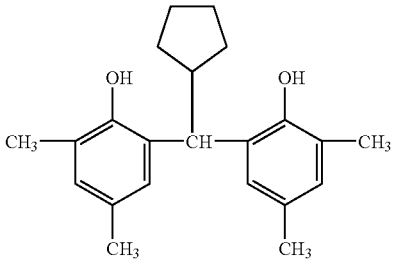

(1-5)

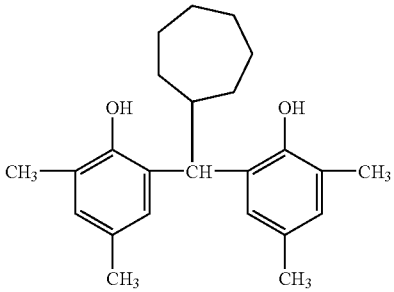

-continued (1-6)

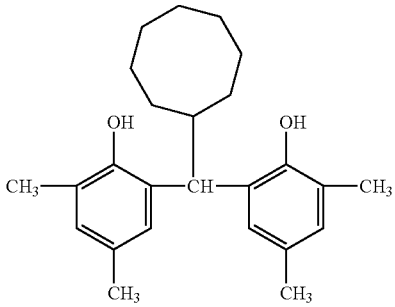

(1-7)

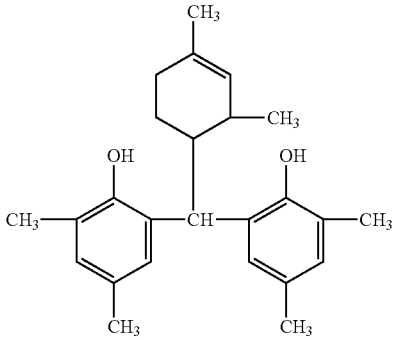

(1-8)

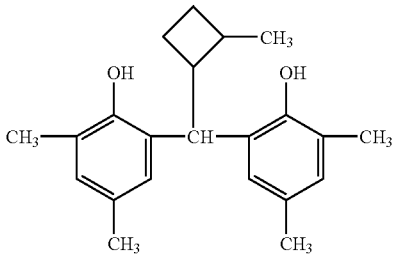

(1-9)

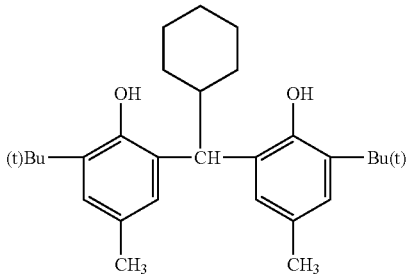

(1-10)

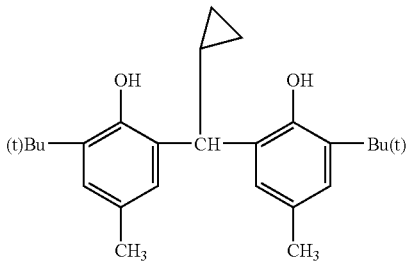

-continued
(1-11)
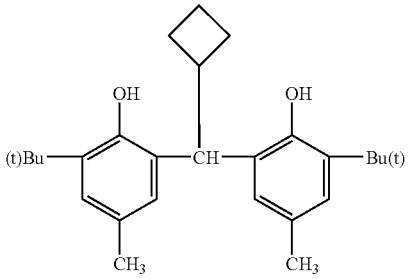
(1-12)
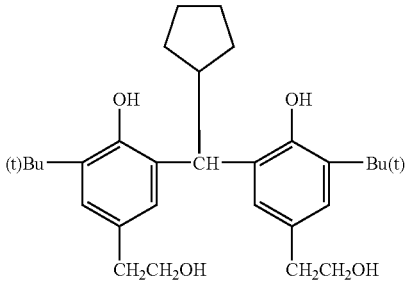
(1-13)
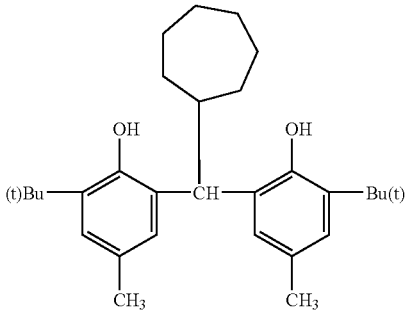
(1-14)
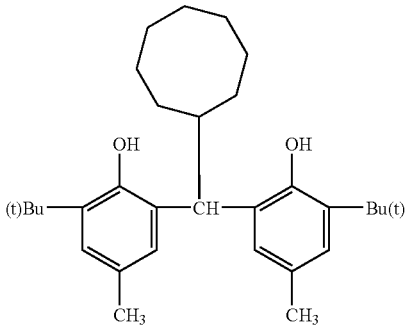
(1-15)
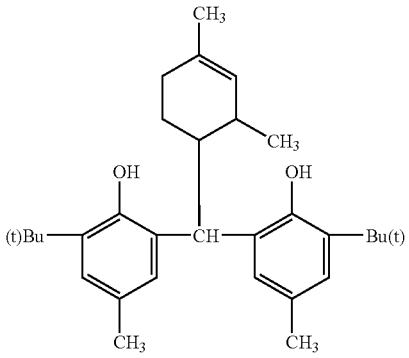
-continued
(1-16)
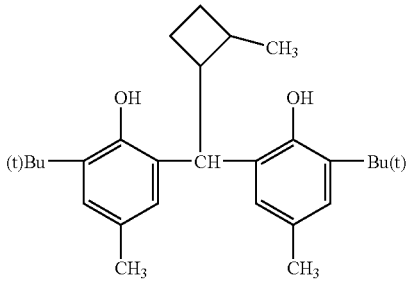
(1-17)
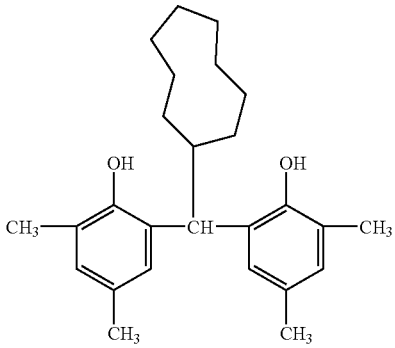
(1-18)
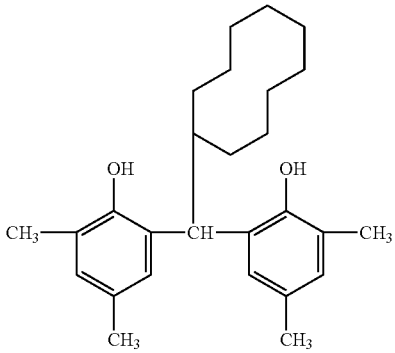
(1-19)
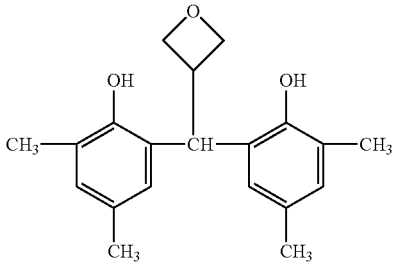
(1-20)
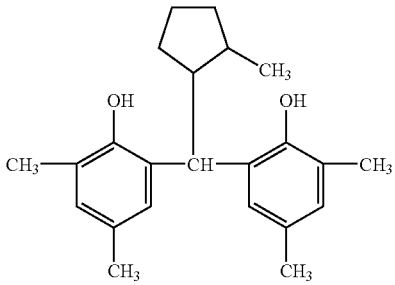

-continued
(1-21)
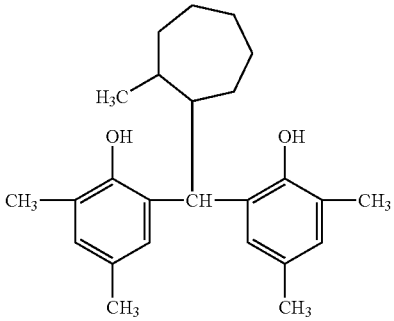
(1-22)
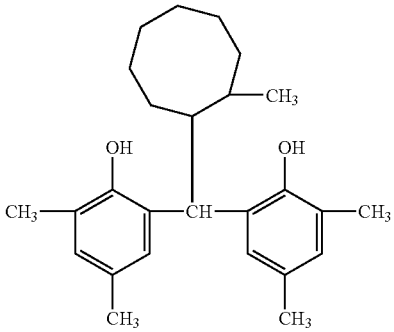
(1-23)
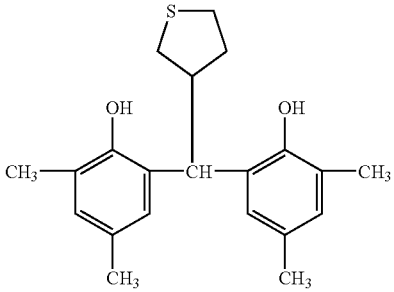
(1-24)
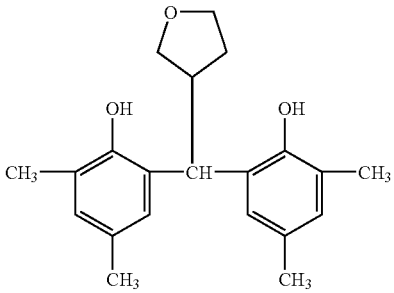
(1-25)
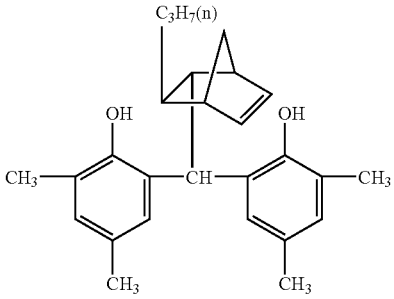
-continued
(1-26)
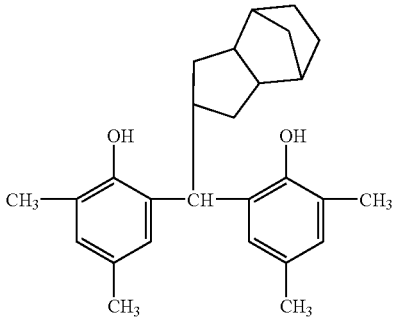
(1-27)
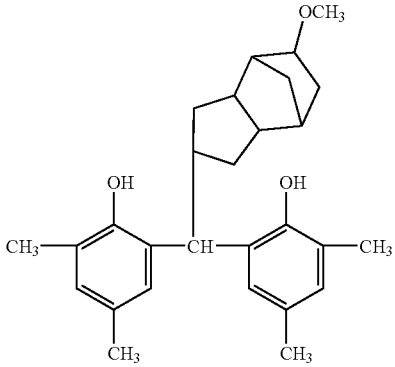
(1-28)
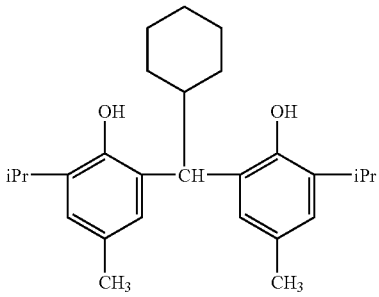
(1-29)
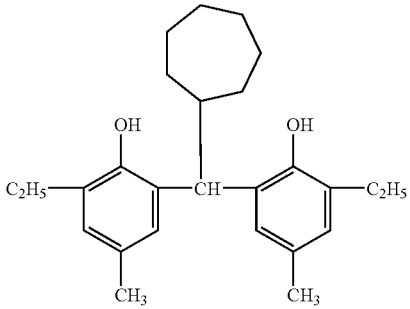
(1-30)
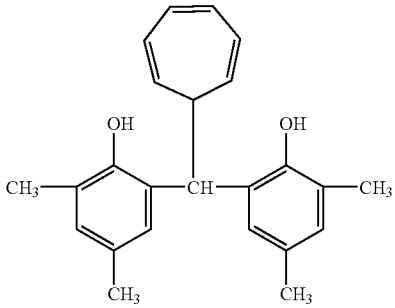

-continued
(1-31)
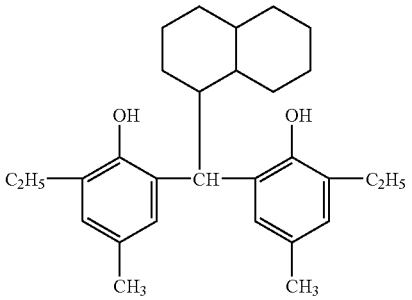
(1-32)
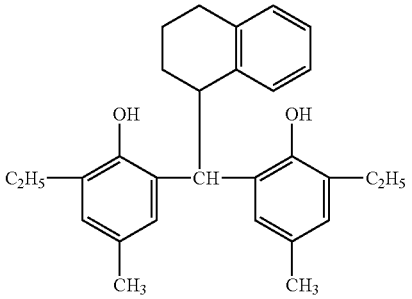
(1-33)
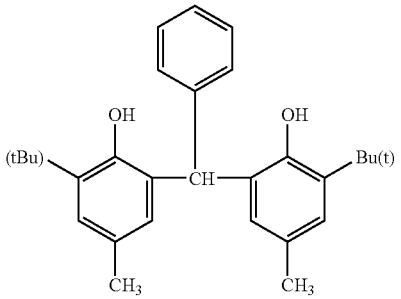
(1-34)
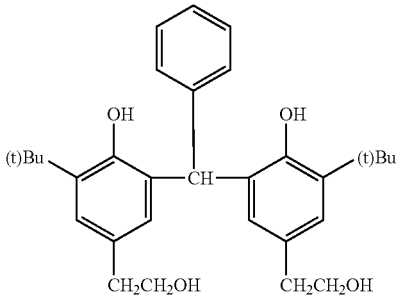
(1-35)
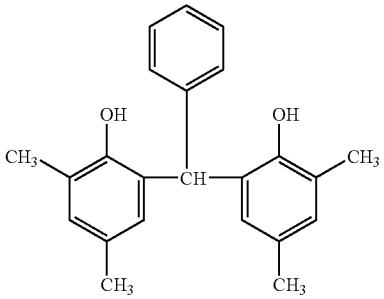
-continued
(1-36)
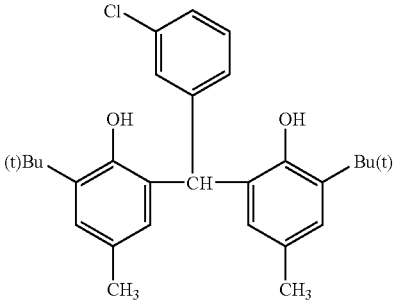
(1-37)
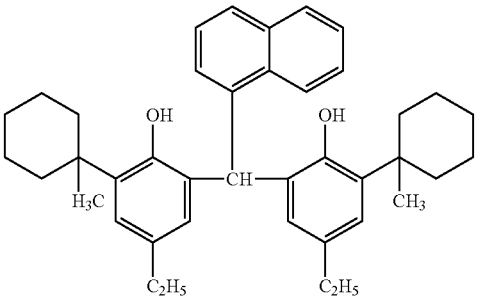
(1-38)
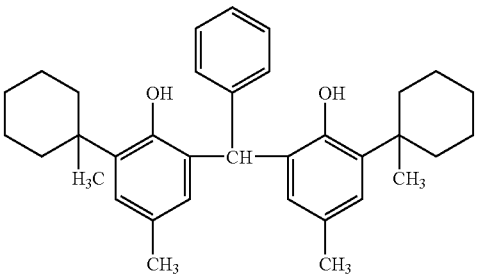
(1-39)
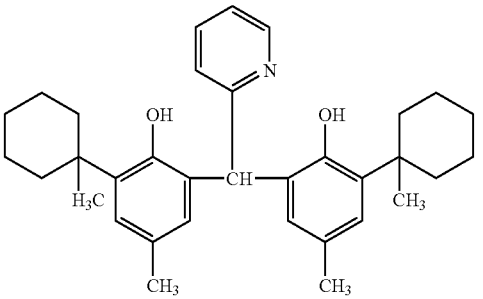
(1-40)
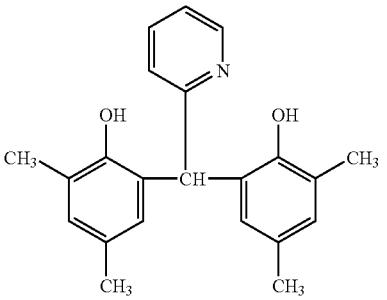

-continued
(1-41)
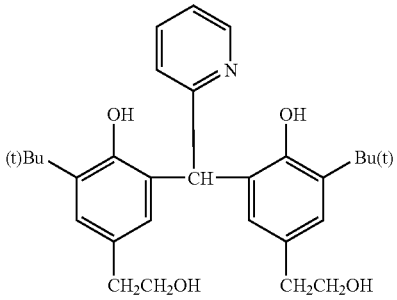
(1-42)
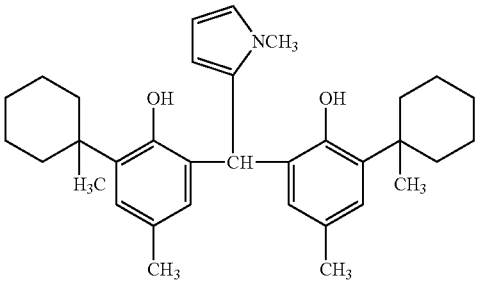
(1-43)
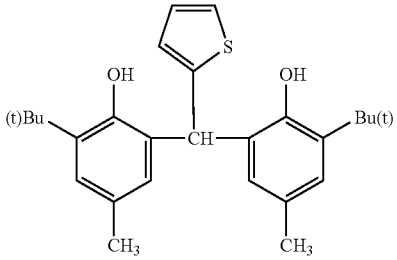
(1-44)
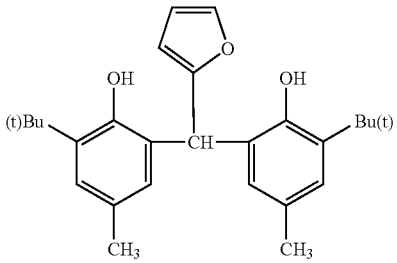
(1-45)
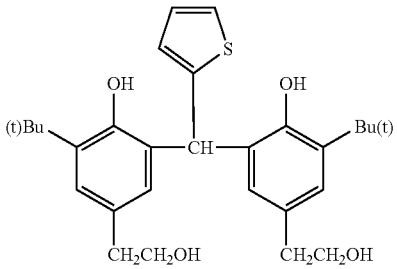
-continued
(1-46)
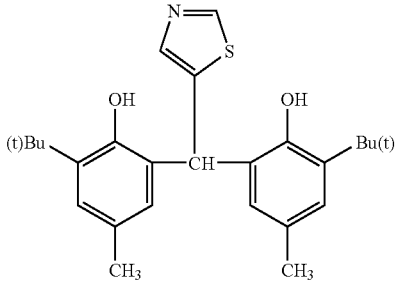
(1-47)
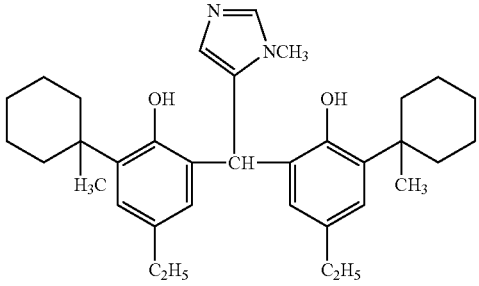
(1-48)
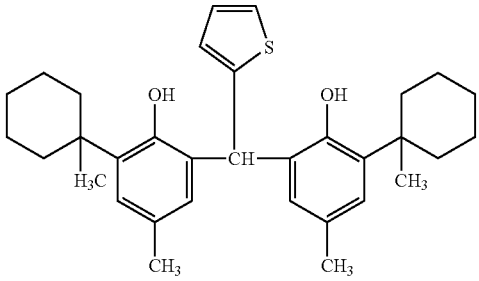
(1-49)
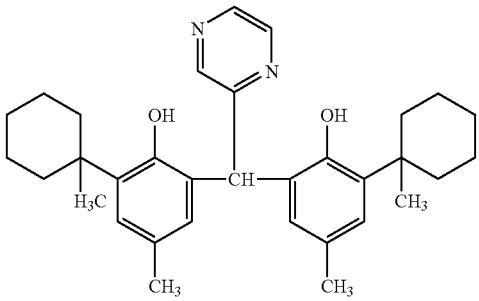
(1-50)
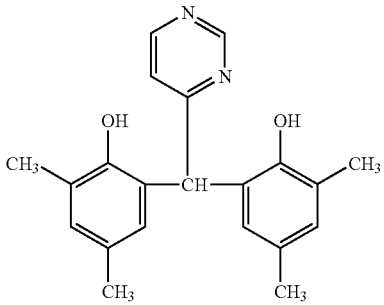

-continued
(1-51)
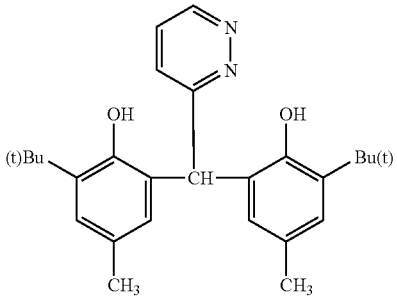
(1-52)
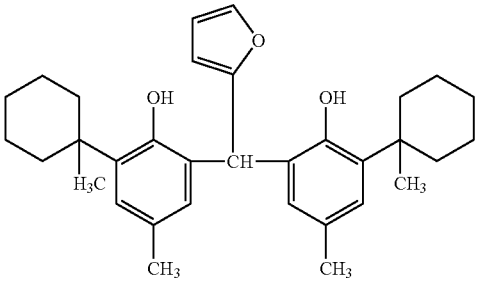
(1-53)
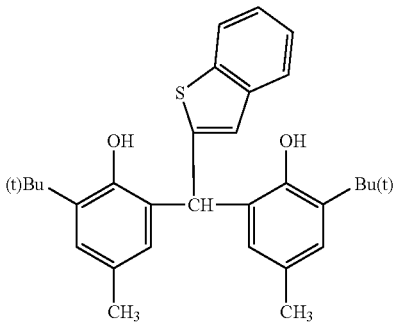
(1-54)
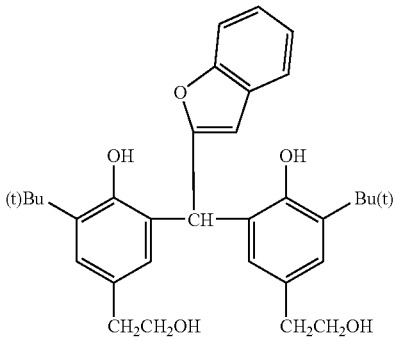
(1-55)
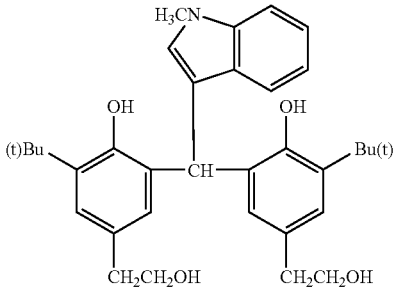
-continued
(1-56)
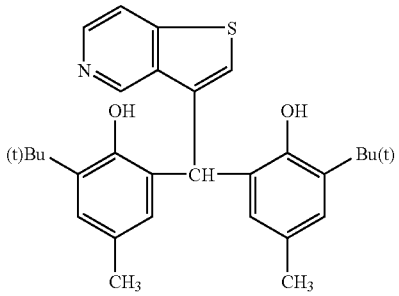
(1-57)
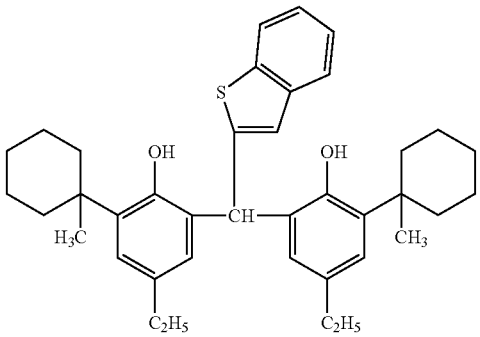
(1-58)
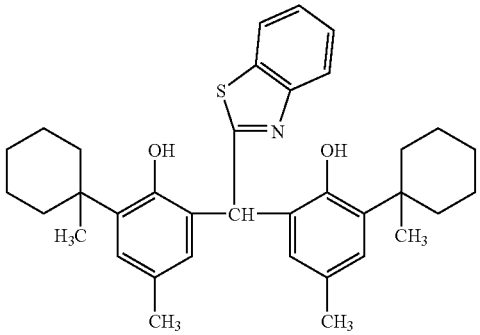
(1-59)
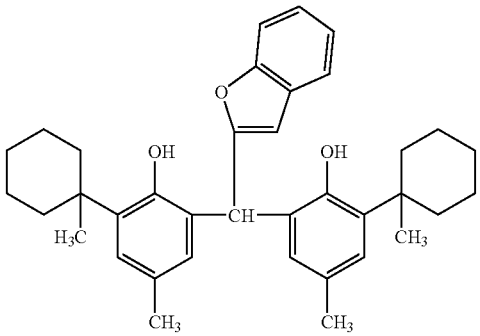

-continued
(1-60)
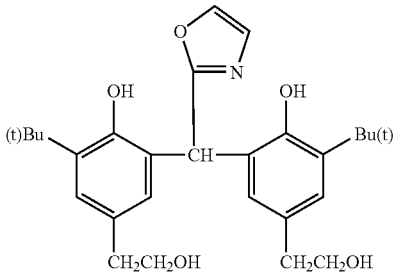
(1-61)
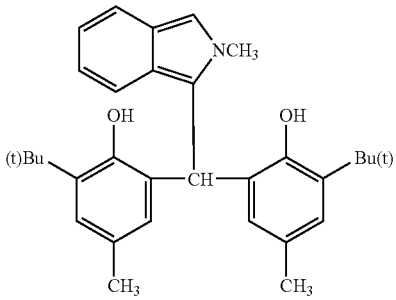
(1-62)
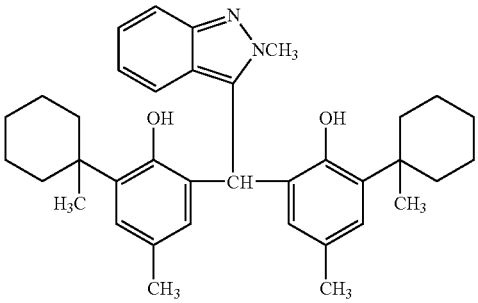
(1-63)
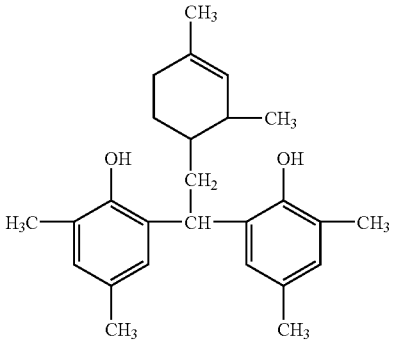
(1-64)
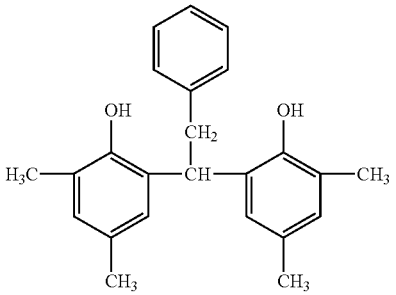
-continued
(1-65)
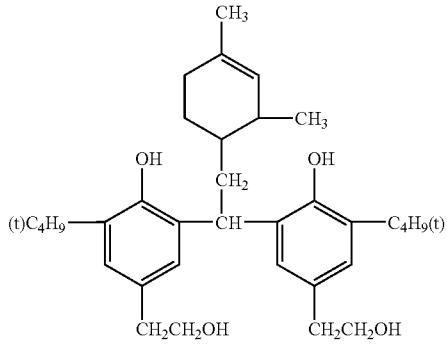
(1-66)
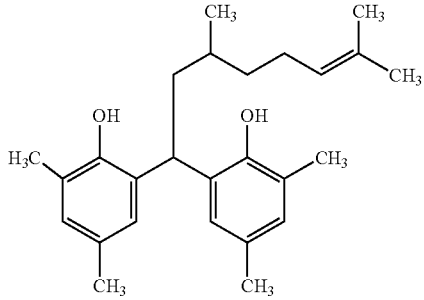
(1-67)
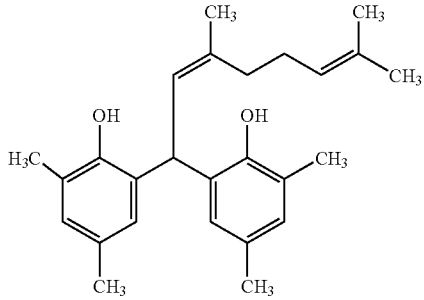
(1-68)
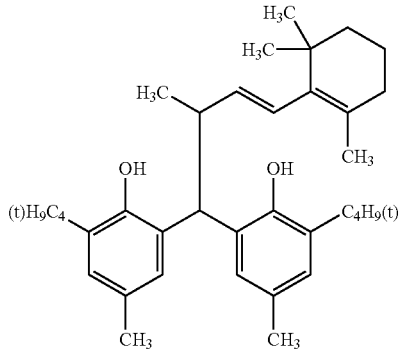

-continued
(1-69)
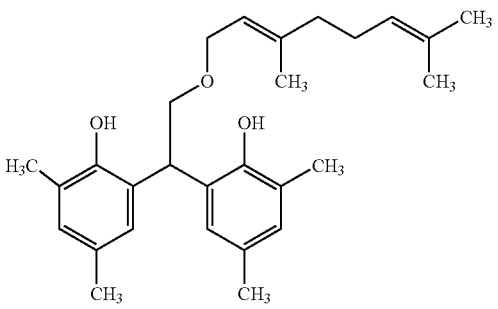
(1-70)
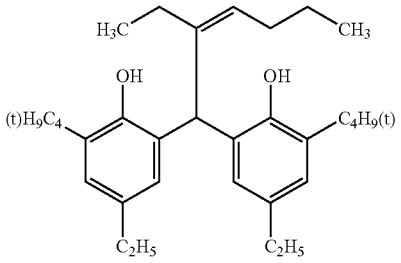
(1-71)
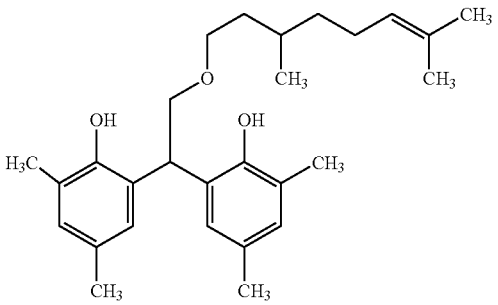
(1-72)
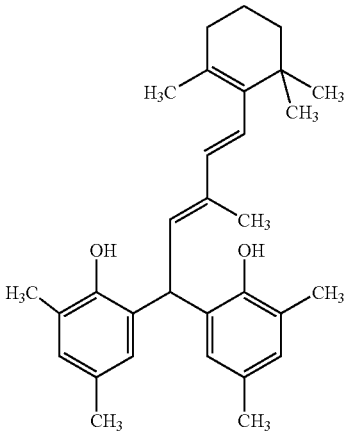
-continued
(1-73)
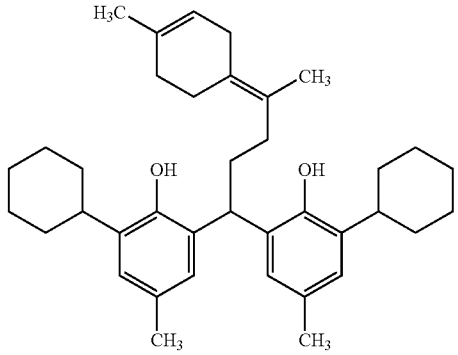
(1-74)
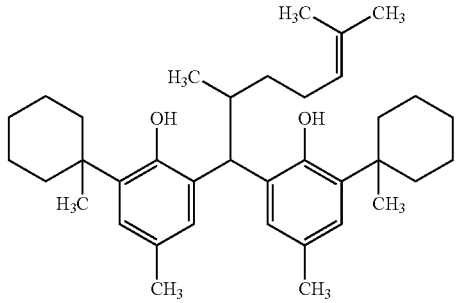
(1-75)
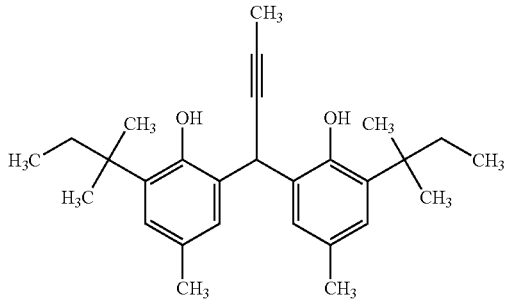
(1-76)
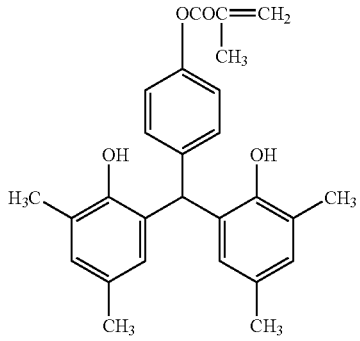

-continued
(1-77)
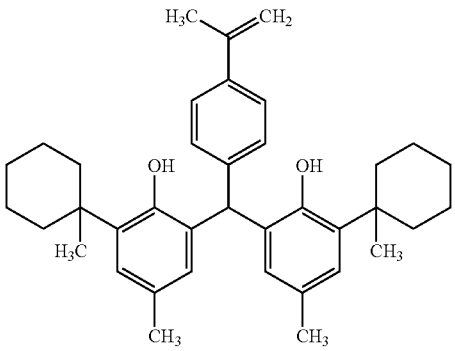
(1-78)
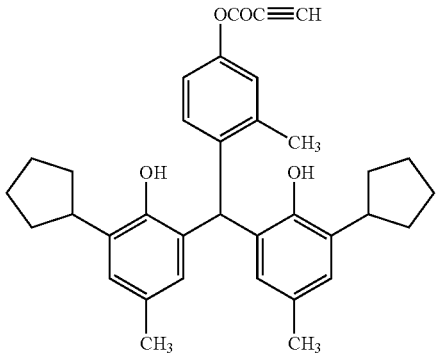
(1-79)
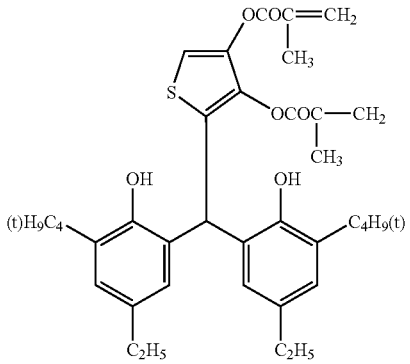
(1-80)
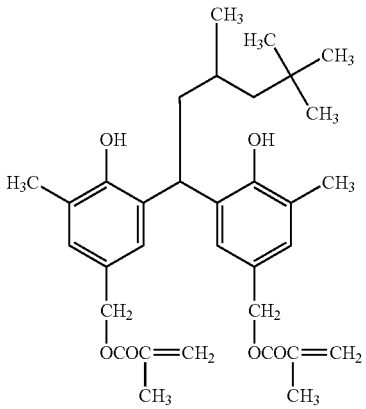
-continued
(1-81)
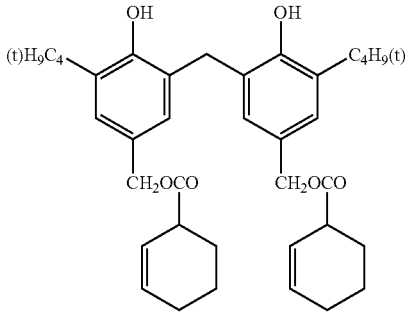
(1-82)
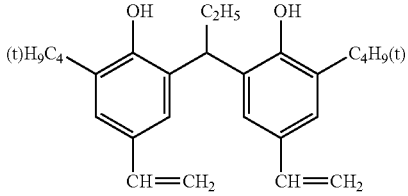
(1-83)
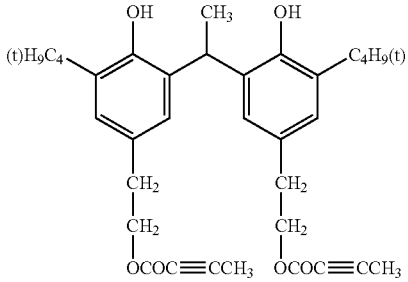
(1-84)
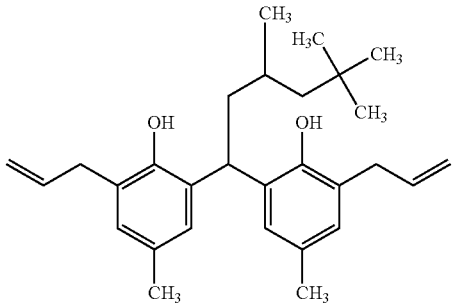
(1-85)
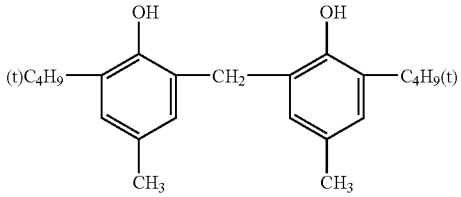
(1-86)
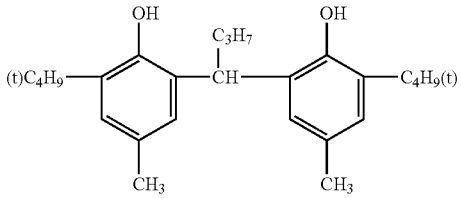

-continued (1-87)

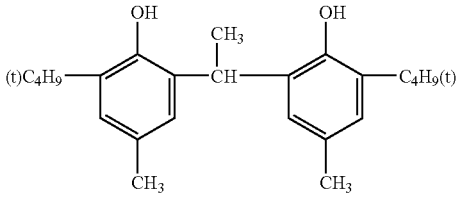

(1-88)

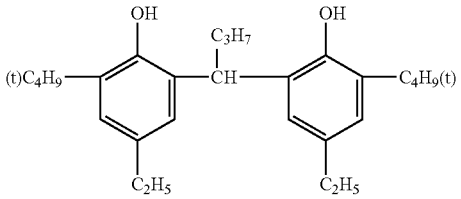

(1-89)

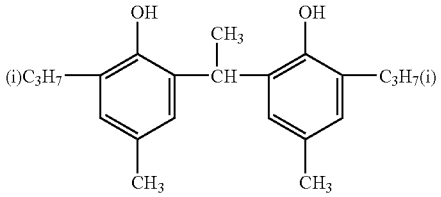

(1-90)

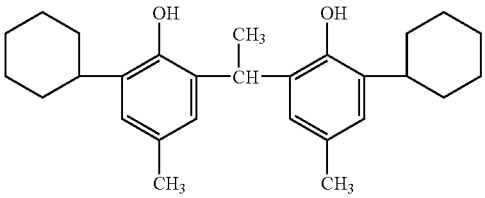

(1-91)

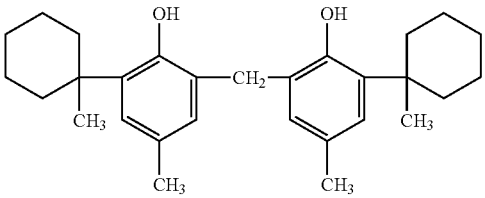

(1-92)

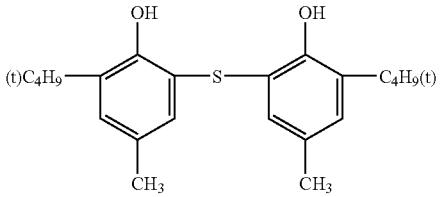

(1-93)

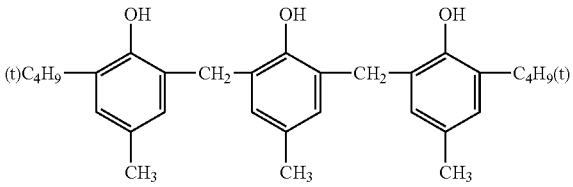

-continued (1-94)

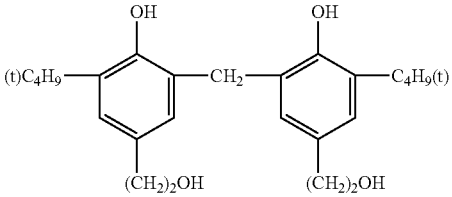

It is possible to readily synthesize the compounds represented by General Formulas (A-1) and (A-4) according to the present invention, employing conventional methods known in the art.

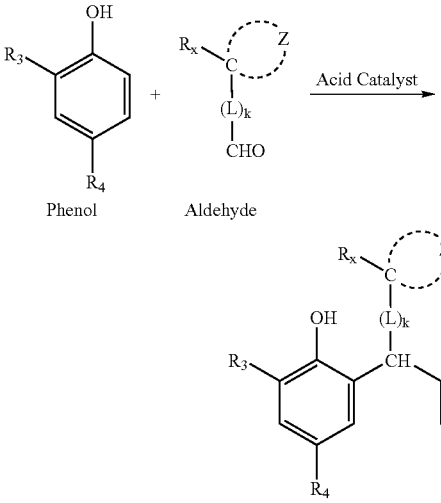

Namely, two equivalents of phenol and one equivalent of aldehyde are mixed in the absence of a solvent or are dissolved in suitable organic solvents and dispersed. Subsequently, acid in a catalytic amount is added, and the resulting mixture undergoes reaction preferably at −20 to 120° C. for 0.5 to 60.0 hours, whereby it is possible to prepare a target compound represented by General Formula (S) at the desired yield.

The aforesaid organic solvents are preferably hydrocarbon based organic solvents, and specifically include benzene, toluene, xylene, dichloromethane, and chloroform. Of these, toluene is preferred. However, from the viewpoint of achieving the desired yield, it is most preferable that the reaction is performed in the absence of solvents. Employed as acid catalysts may be all inorganic acids and organic acids. Of these, concentrated hydrochloric acid, p-toluenesulfonic acid and phosphoric acid are preferably employed. The catalyst is preferably employed in an amount of 0.001 to 1.500 equivalents with respect to the corresponding aldehyde. The reaction temperature is preferably near room temperature (15 to 25° C.) and the reaction time is preferably from 3 to 20 hours.

It is possible to synthesize the compounds represented by General Formulas (A-2) and (A-3) according to the present invention, employing the methods below.

Synthesis of (1–66)

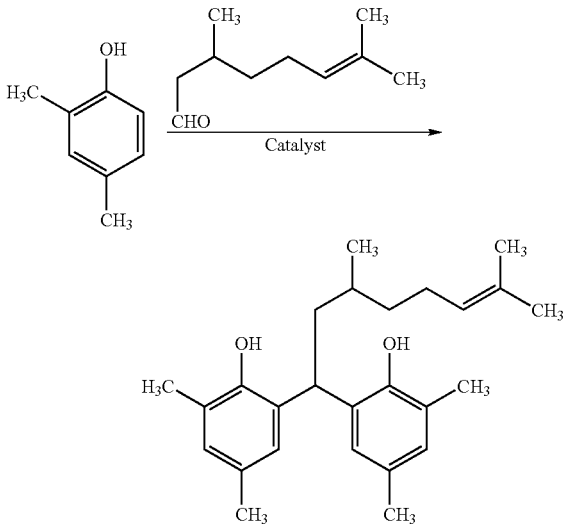

Synthesis of (1–76)

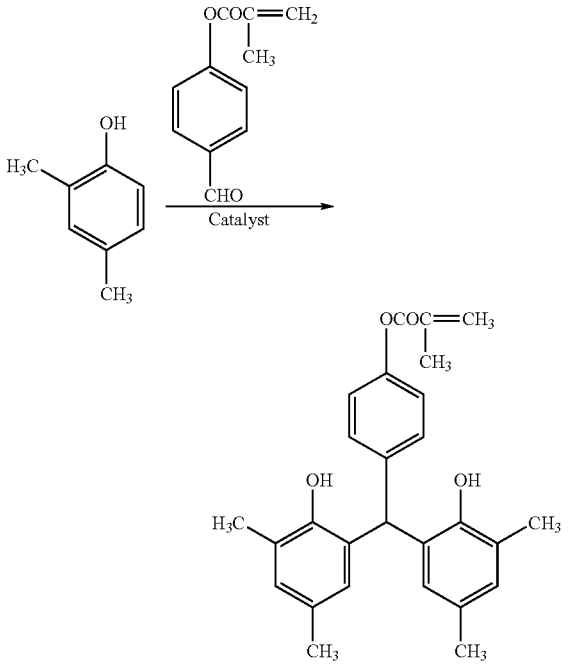

Based on the above scheme, it is possible to synthesize the compounds represented by General Formula (A-4) or (A-5) in solvents such as water, methanol, ethanol, acetonitrile, tetrahydrofuran, ethyl acetate, toluene, or N,N-dimethylformamide, employing phenol derivatives and aldehyde derivatives in the presence of catalysts.

Reducing agents incorporated in silver salt photothermographic dry imaging materials are those which reduce organic silver salts to form silver images. Reducing agents capable of being simultaneously employed with the reducing agents of the present invention are described, for example, in U.S. Pat. Nos. 3,770,448, 3,773,512, and 3,593,863,; RD 17029 and 29963; and JP-A Nos. 11-119372 and 2002-62616.

The used amount of the reducing agents represented by aforesaid General Formulas (A-1)–(A-4) is preferably $1\times10^{-2}$–10 mol per mol of silver, and is preferably $1\times10^{-2}$–1.5 mol.

In the silver salt photothermographic dry imaging materials of the present invention, constituting components, other than those described above will now be described.

<Tone of Image>

It has been pointed out that in regard to the output image tone for medical diagnosis, cold image tone tends to result in more accurate diagnostic observation of radiographs. The cold image tone, as described herein, refers to pure black tone or blue black tone in which black images are tinted to blue. On the other hand, warm image tone refers to warm black tone in which black images are tinted to brown. The tone is more described below based on an expression defined by a method recommended by the Commission Internationale de l'Eclairage (CIE) in order to define more quantitatively.

"Colder tone" as well as "warmer tone", which is terminology of image tone, is expressed, employing minimum density $D_{min}$ and hue angle $h_{ab}$ at an optical density D of 1.0. The hue angle $h_{ab}$ is obtained by the following formula, utilizing color specifications a* and b* of L*a*b* Color Space which is a color space perceptively having approximately a uniform rate, recommended by Commission Internationale de l'Eclairage (CIE) in 1976.

$$h_{ab}=\tan^{-1}(b^*/a^*)$$

In the present invention, $h_{ab}$ is preferably in the range of 180 degrees<$h_{ab}$<270 degrees, is more preferably in the range of 200 degrees<$h_{ab}$<270 degrees, and is most preferably in the range of 220 degrees<$h_{ab}$<260 degrees.

This finding is also disclosed in JP-A 2002-6463.

Diligent investigation was performed for the silver salt photothermographic imaging material according to the present invention. As a result, it was discovered that when a linear regression line was formed on a graph in which in the CIE 1976 (L*u*v*) color space or the (L*a*b*) color space, u* or a* was used as the abscissa and v* or b* was used as the ordinate, the aforesaid materiel exhibited diagnostic properties which were equal to or better than conventional wet type silver salt photosensitive materials by regulating the resulting linear regression line to the specified range. The condition ranges of the present invention will now be described.

(1) It is preferable that the coefficient of determination value $R^2$ of the linear regression line, which is made by arranging u* and v* in terms of each of the optical densities of 0.5, 1.0, and 1.5 and the minimum optical density, is also 0.998–1.000.

The value v* of the intersection point of the aforesaid linear regression line with the ordinate is −5–+5; and gradient (v*/u*) is 0.7–2.5.

(2) The coefficient of determination value $R^2$ of the linear regression line is 0.998–1.000, which is formed in such a manner that each of optical density of 0.5, 1.0, and 1.5 and the minimum optical density of the aforesaid imaging material is measured, and a* and b* in terms of each of the above optical densities are arranged in two-dimensional coordinates in which a* is used as the abscissa of the CIE 1976 (L*a*b*) color space, while b* is used as the ordinate of the same.

In addition, value b* of the intersection point of the aforesaid linear regression line with the ordinate is −5–+5, while gradient (b*/a*) is 0.7–2.5.

A method for making the above-mentioned linear regression line, namely one example of a method for determining u* and v* in the CIE 1976 color space, will now be described.

By employing a thermal development apparatus, a 4-step wedge sample including an unexposed portion and optical densities of 0.5, 1.0, and 1.5 is prepared. Each of the wedge density portions prepared as above is determined employing a spectral chronometer (for example, CM-3600d, manufactured by Minolta Co., Ltd.) and either u* and v* or a* and b* are calculated. Measurement conditions are such that an F7 light source is used as a light source, the visual field angle is 10 degrees, and the transmission measurement mode is used. Subsequently, either measured u* and v* or measured a* and b* are plotted on the graph in which u* or a* is used as the abscissa, while v* or b* is used as the ordinate, and a linear regression line is formed, whereby the coefficient of determination value $R^2$ as well as intersection points and gradients are determined.

The specific method enabling to obtain a linear regression line having the above-described characteristics will be described below.

In the present invention, by regulating the added amount of the aforesaid toning agents, developing agents, silver halide grains, and aliphatic carboxylic acid silver, which are directly or indirectly involved in the development reaction process, it is possible to optimize the shape of developed silver so as to result in the desired tone. For example, when the developed silver is shaped to dendrite, the resulting image tends to be bluish, while when shaped to filament, the resulting imager tends to be yellowish. Namely, it is possible to adjust the image tone taking into account the properties of shape of developed silver.

It is desirous to use toners in the silver salt photothermographic dry imaging materials of the present invention. Examples of appropriate toners are disclosed in Research Disclosure (hereinafter referred to as RD) 17029, as well as U.S. Pat. Nos. 4,123,282, 3,994,732, 3,846,136, and 4,021,249. Particularly preferred toners include phthalazinone or combinations of phthalazine with phthalic acids and phthalic anhydrides.

In the present invention, it is particularly preferable that carboxylic acid-containing compounds such as phthalic acid, 4-methylphthalic acid, 4-nitrophthalic acid, tetrachlorophthalic anhydride, benzoic acid, 4-methylbenzoic acid, 4-nitobenzoic acid, and pentachlorobenzdic acid are incorporated in a light-insensitive layer adjacent to a light-sensitive layer.

The amount of toners incorporated in the light-insensitive layer is preferably 0.005–0.20 mol per mol of Ag, and is more preferably 0.01–0.10 mol.

Other than such toners, it is preferable to control color tone employing couplers disclosed in JP-A No. 11-288057 and EP 1134611A2 as well as leuco dyes detailed below.

Especially, it is preferable to use a leuco dye.

Employed as leuco dyes may be any of the colorless or slightly tinted compounds which are oxidized to form a colored state when heated at temperatures of about 80–about 200° C. for about 0.5–about 30 seconds. It is possible to use any of the leuco dyes which are oxidized by silver ions to form dyes. Compounds are useful which are sensitive to pH and oxidizable to a colored state.

Representative leuco dyes suitable for the use in the present invention are not particularly limited. Examples include biphenol leuco dyes, phenol leuco dyes, indoaniline leuco dyes, acrylated azine leuco dyes, phenoxazine leuco dyes, phenodiazine leuco dyes, and phenothiazine leuco dyes. Further, other useful leuco dyes are those disclosed in U.S. Pat. Nos. 3,445,234, 3,846,136, 3,994,732, 4,021,249, 4,021,250, 4,022,617, 4,123,282, 4,368,247, and 4,461,681, as well as JP-A Nos. 50-36110, 59-206831, 5-204087, 11-231460, 2002-169249, and 2002-236334.

In order to control images to specified color tones, it is preferable that various color leuco dyes are employed individually or in combinations of a plurality of types. In the present invention, for minimizing excessive yellowish color tone due to the use of highly active reducing agents, as well as excessive reddish images especially at a density of at least 2.0 due to the use of minute silver halide grains, it is preferable to employ leuco dyes which change to cyan. Further, in order to achieve precise adjustment of color tone, it is further preferable to simultaneously use yellow leuco dyes as well as other leuco dyes which change to cyan.

It is preferable to appropriately control the density of the resulting color while taking into account the relationship with the color tone of developed silver itself. In the present invention, color formation is performed so that the sum of maximum densities at the maximum adsorption wavelengths of dye images formed by leuco dyes is customarily 0.01–0.30, is preferably 0.02–0.20, and is most preferably 0.02–0.10. Further, it is preferable that images be controlled within the preferred color tone range described below.

<Binder>

Suitable binders for the silver salt photothermographic material of the present invention are to be transparent or translucent and commonly colorless, and include natural polymers, synthetic resin polymers and copolymers, as well as media to form film. Examples are disclosed in JP-A No. 2001-330918, paragraph [0069].

Preferable binders for the photosensitive layer of the silver salt photothermographic dry imaging material of the present invention are poly(vinyl acetals), and a particularly preferable binder is poly(vinyl butyral), which will be detailed hereunder. Polymers such as cellulose esters, especially polymers such as triacetyl cellulose, cellulose acetate butyrate, which exhibit higher softening temperature, are preferable for an overcoating layer as well as an undercoating layer, specifically for a light-insensitive layer such as a protective layer and a backing layer. Incidentally, if desired, the binders may be employed in combination of at least two types.

The binders preferably contain at least one polar group selected from the group consisting of —COOM, $—SO_3M$, $—OSO_3M$, $—P{=}O(OM)_2$, $—O—P{=}O(OM)_2$ (wherein M represents a hydrogen atom or an alkali metal salt group), $—N(R_4)_2$, $—N^+(R_4)_3$ (wherein $R_{54}$ represents a hydrocarbon group, and a plurality of $R_{54}$ may be the same or different), an epoxy group, —SH, and —CN. Especially, inclusion of $—SO_3M$, or $—OSO_3M$ is preferred. The amount of such polar groups is commonly from $10^{-1}$ to $10^{-8}$ mol/g, and is preferably from $10^{-2}$ to $10^{-6}$ mol/g.

Such binders are employed in the range of a proportion in which the binders function effectively. Skilled persons in the art can easily determine the effective range. For example, preferred as the index for maintaining aliphatic carboxylic acid silver salts in a photosensitive layer is the proportion range of binders to aliphatic carboxylic acid silver salts of 15:1 to 1:2 and most preferably of 8:1 to 1:1. Namely, the binder amount in the photosensitive layer is preferably from 1.5 to 6 g/m$^2$, and is more preferably from 1.7 to 5 g/m$^2$. When the binder amount is less than 1.5 g/m$^2$, density of the unexposed portion markedly increases, whereby it occasionally becomes impossible to use the resultant material.

In the present invention, it is preferable that thermal transition point temperature of the photosensitive layer containing light-insensitive organic silver salt grains, photosensitive silver halide grains, a reducing agent for silver ions and a bind, after development is at higher or equal to 100° C., is from 46 to 200° C.

Thermal transition point temperature, as described in the present invention, refers to the VICAT softening point or the value shown by the ring and ball method, and also refers to the endothermic peak which is obtained by measuring the individually peeled photosensitive layer which has been thermally developed, employing a differential scanning calorimeter (DSC), such as EXSTAR 6000 (manufactured by Seiko Denshi Co.), DSC220C (manufactured by Seiko Denshi Kogyo Co.), and DSC-7 (manufactured by Perkin-Elmer Co.). Commonly, polymers exhibit a glass transition point, Tg. In silver salt photothermographic dry imaging materials, a large endothermic peak appears at a temperature lower than the Tg value of the binder resin employed in the photosensitive layer. The inventors of the present invention conducted diligent investigations while paying special attention to the thermal transition point temperature. As a result, it was discovered that by regulating the thermal transition point temperature to the range of 46 to 200° C., durability of the resultant coating layer increased and in addition, photographic characteristics such as speed, maximum density and image retention properties were markedly improved.

The glass transition temperature Tg of binders employed in the present invention is preferably 70–105° C. It is possible to determine Tg employing a differential scanning calorimeter. The intersection point of a base line with the slope of an endothermic peak is designated as the glass transition point.

The glass transition temperature (Tg) is determined employing the method, described in Brandlap, et al., "Polymer Handbook", pages from III-139 through III-179, 1966 (published by Wiley and Son Co.).

The Tg of the binder comprised of copolymer resins is obtained based on the following formula.

$$Tg \text{ of the copolymer (in ° C.)} = v_1 Tg_1 + v_2 Tg_2 + \ldots + v_n Tg_n$$

wherein $v_1$, $v_2$, . . . $v_n$ each represents the mass ratio of the monomer in the copolymer, and $Tg_1$, $Tg_2$, . . . $Tg_n$ each represents Tg (in ° C.) of the homopolymer which is prepared employing each monomer in the copolymer.

The accuracy of Tg, calculated based on the formula calculation, is ±5° C.

Since sufficient maximum density is obtained during image formation, it is preferable to use binders of a Tg of 70–105° C.

Binders according to the present invention are those which have a Tg of 70–105° C., a number average molecular weight of 1,000–1,000,000, being preferably 10,000–500,000, and a degree of polymerization of about 50–about 1,000.

Further, listed as polymers or copolymers containing ethylenic unsaturated monomers as constituting units are those described in paragraph [0069] of JP-A No. 2001-330918.

Of these, listed as preferable examples are alkyl methacrylates, aryl methacrylates, and styrenes. Of such polymers, those having an acetal group are preferably employed because they exhibit excellent compatibility with the resultant aliphatic carboxylic acid. Polyvinyl acetal having an acetoacetal structure is preferably used. Examples of them are disclosed in U.S. Pat. Nos. 2,358,836, 3,003,879, 2,828,204, and GB No. 771155.

Particularly preferred as polymers having an acetal group are the compounds represented by General Formula (V) described below.

General Formula (V)

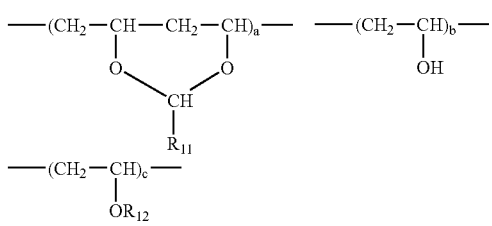

wherein $R_{11}$ represents a substituted or unsubstituted alkyl group, and a substituted or unsubstituted aryl group, however, groups other than the aryl group are preferred; $R_{12}$ represents a substituted or unsubstituted alkyl group, a substituted or unsubstituted aryl group, —$COR_{13}$ or —$CONHR_{13}$, wherein $R_{13}$ represents the same as defined above for $R_{11}$.

Polymers represented by aforesaid General Formula (V) of the present invention can be synthesized employing common synthetic methods described in "Sakusan Binihru Jushi (Vinyl Acetate Resins)", edited by Ichiro Sakurada (Kohbunshi Kagaku Kankoh Kai, 1962).

Employed as polyurethane resins usable in the present invention may be those, known in the art, having a structure of polyester polyurethane, polyether polyurethane, polyether polyester polyurethane, polycarbonate polyurethane, polyester polycarbonate polyurethane, or polycaprolactone polyurethane. It is preferable that the molecular terminal of the polyurethane molecule has at least one OH group and at least two OH groups in total. The OH group cross-links with polyisocyanate as a hardening agent so as to form a 3-dimensinal net structure. Therefore, the more OH groups which are incorporated in the molecule, the more preferred. It is particularly preferable that the OH group is positioned at the terminal of the molecule since thereby the reactivity with the hardening agent is enhanced. The polyurethane preferably has at least three OH groups at the terminal of the molecules, and more preferably has at least four OH groups. When polyurethane is employed, the polyurethane preferably has a glass transition temperature of 70 to 105° C., a breakage elongation of 100 to 2,000 percent, and a breakage stress of 0.5 to 100 M/mm$^2$.

Employed as polymerization initiators may be azo based polymer polymerization initiators and organic peroxides. Azo based polymer polymerization initiators include ABN-R (2,2'-azobisisobutyronitrile), ABN-V (2.2'-azobis(2,4-dimethylvaleronitrile); and ABN-E (2,2'-azobis(2-methylbutyronitrile, all produced by Japan Hydrazine Company, Inc. Further, listed as organic peroxides are benzoyl peroxide, dimethyl ketone peroxide, lauryl peroxide; Pertetra A, Perhexa HC, Perhexa TMH, Perhexa C, Perhexa V, Perhexa 22, Perhexa MC, Perbutyl H, Percumyl H, Percumyl P, Permenta H, Perocta H, Perbutyl C, Perbutyl D, Perhexyl D, Perloyl IB, Perloyl 355, Perloyl L, Perloyl S, Perloyl SA, Niper BW, Niper BMT-K40, Niper BMT-T40, Niper BMT-M, Perloyl IPP, Perloyl NPP, Perloyl TCP, Perloyl EEP, Perloyl MBP, Perloyl OPP, Perloyl SBP, Percumyl ND, Perocta ND, Percyclo ND, Perhexyl ND, Perbutyl ND, Perhexyl PV, Perhexa 250, Perocta O, Perhexyl O, Perbutyl O, Perbutyl IB, Perbutyl L, Perbutyl 355, Perhexyl I, Perbutyl I, Perbutyl E, Perhexa 25Z, Perhexa 25MT, Perbutyl A, Perhexyl Z, Perbutyl ZT, and Perbutyl Z, all produced by NOF Corp.

Further, listed as polymerization inhibitors are quinone based inhibitors such as hydroquinone or p-methoxyphenol. Further listed are phenothiazine, methoquinone, non-flex alba, MH (methylhydroquinone), TBH (tert-butylhydroquinone), PBQ (p-benzoquinone), toluquinone, TBQ (tert-butyl-p-benzoquinone), and 2,5-dipenyl-p-benzoquinone.

These polymers may be employed individually or in combinations of at least two types. The above polymers are employed in the light-sensitive layer according to the present invention as a primary binder. When the content ratio of one polymer is at least 50 percent by weight with respect to all the polymers, the polymer is designated as a primary binder. Accordingly, other polymers in a ratio of at most 50 percent by weight may be used upon being blended. These polymers are not particularly limited as long as the polymers of the present invention are soluble in solvents. Polyvinyl acetate, polyacryl resins, and urethane resins are more preferably listed.

In the present invention, organic gelling agents may be incorporated in the light-sensitive layer. Organic gelling agents, as described herein, refer to compounds which function in such a manner that addition of a compound such as polyhydric alcohol to an organic liquid provides a yield point to the system and diminishes or decreases fluidity of the system.

The preferred embodiment of the present invention is that a light-sensitive layer liquid coating composition contains polymer latexes which are subjected to water-based dispersion. In this case, it is preferable that at least 50 percent by weight of the total binders in the light-sensitive layer liquid coating composition is polymer latexes which are subjected to water-based dispersion.

Further, in the case in which the light-sensitive layer according to the present invention contain polymer latexes, it is preferable that at least 50 percent by weight of the total binders in the aforesaid light-sensitive layer is polymer latexes, and it is more preferable that at least 70 percent by weight of the same is polymer latexes.

"Polymer latexes" according to the present invention refer to those which are prepared by dispersing water-insoluble hydrophobic polymers into a water-soluble dispersion medium in the form of minute particles. Any of the dispersion states are acceptable in which polymers are emulsified in a dispersion medium, undergo emulsion polymerization or micelle dispersion, or the polymers have a partially hydrophilic structure in the molecule and the molecular chains themselves are subjected to molecular dispersion.

The average diameter of dispersion particles is preferably in the range of 1–50, 000 nm, and is more preferably in the range of about 5–about 1,000 nm. The size distribution of dispersion particles is not particularly limited, and particles having either a broad size distribution or a particle size distribution of monodispersion may be acceptable.

Employed as polymer latexes according to the present invention may be so-called core/shell latexes, other than polymer latexes, having a common uniform structure. In this case, occasionally, the core and shell type becomes preferable when the glass transition temperature is varied. The minimum filming temperature (MFT) is preferably −30–90° C., and is more preferably about 0–70° C. Further, in order to control the minimum filming temperature, filming aids may be added. Filming aids employed in the present invention are also called plasticizers which are organic compounds (commonly organic solvents) to lower the minimum filming temperature of polymer latexes and are described, for example, in Soichi Muroi, "Gosei Latex no Kagaku (Chemistry of Synthetic Latexes)", published by Kobunshi Kankokai (1970).

Polymer species employed in polymer latexes include acryl resins, vinyl acetate resins, polyester resins, polyurethane resins, rubber based resins, vinyl chloride resins, vinylidene chloride resins, and polyolefin resins, as well as copolymers thereof. Employed as polymers may be straight chain polymers, branched chain-polymers, or crosslinked polymers. Further, employed as polymers may be so-called homopolymers which are prepared by polymerizing a single monomer as well as copolymers prepared by polymerizing at least two types of monomers. In the case of copolymers, employed may be random copolymers as well as block copolymers. The molecular weight of polymers is commonly 5,000–1,000,000 in terms of number average molecular weight, and is preferably about 10,000–100,000. Those of excessively small molecular weight result in insufficient dynamical strength of the light-sensitive layer, while those of excessively large molecular weight results in undesired filming properties.

Polymer latexes are preferred which have an equilibrium moisture content of 0.01–2 percent by weight at 25° C. and 60 percent relative humidity and are more preferred which have the same of 0.01–1 percent by weight. In regard to the definition and determination methods of the equilibrium moisture content, it is possible to refer, for example, to "Kobunshi Kogaku Koza 14, Kobunshi Zairyo Jikken Ho (Polymer Engineering Lecture 14,. Polymer Material Test Methods)" edited by Kobunshi Gakkai, Chijin Shoikan.

Listed as specific examples of polymer latexes are those described in paragraph [0173] of JP-A No. 2002-287299.

These polymers may be employed individually, or if desired, in combinations of at least two types upon being blended. As polymer species of polymer latexes, preferred are those which incorporate carboxylic acid components such as acrylate or methacrylate components in an amount of 0.1–10 percent by weight.

Further, if desired, hydrophilic polymers such as gelatin, polyvinyl alcohol, methylcellulose, hydroxypropylcellulose, carboxymethylcellulose, or hydroxypropylmethylcellulose may be added in an amount of at most 50 percent by weight of the total binders. The added amount of these hydrophilic polymers is preferably at most 30 percent by weight of the total binders of the aforesaid light-sensitive layer.

During preparation of the light-sensitive layer liquid coating composition according to the present invention, the addition sequence of organic silver salts and polymer latexes which are subjected to water-based dispersion is not limited, and both may be simultaneously added. However, it is preferable that the polymer latexes are added later.

Further, it is preferable that prior to the addition of polymer latexes, organic silver salts and reducing agents are blended. Further, in the present invention, after mixing the organic silver salts and the polymer latexes, when temperature during storage is excessively low, problems occur in which the coating surface is degraded, while the temperature is excessively high, problems occur in which fog increases. Consequently, it is preferable that the liquid coating composition after mixing is left standing over the aforesaid period preferably in the range of 30–65° C., more preferably in the range of 35–60° C., and particularly preferably in the range of 35–55° C. In order to maintain such temperature, tanks for preparing liquid coating compositions may be heated.

The light-sensitive layer liquid coating composition according to the present invention is coated preferably 30 minutes–24 hours after blending the organic silver salts and the polymer latexes which are subjected to water-based dispersion, more preferably 60 minutes–12 hours after the blending, and most preferably 120 minutes–10 hours after the blending.

"After blending", as described herein, refers to after added components of organic silver salts and polymer latexes, which are subjected to water-based dispersion, are uniformly dispersed.

In the present invention, it is known that by employing cross-linking agents in the aforesaid binders, uneven development is minimized due to the improved adhesion of the layer to the support. In addition, it results in such effects that fogging during storage is minimized and the creation of printout silver after development is also minimized.

Employed as cross-linking agents used in the present invention may be various conventional cross-linking agents, which have been employed for silver halide photosensitive photographic materials, such as aldehyde based, epoxy based, ethyleneimine based, vinylsulfone based sulfonic acid ester based, acryloyl based, carbodiimide based, and silane compound based cross-linking agents, which are described in Japanese Patent Application Open to Public Inspection No. 50-96216. Of these, preferred are isocyanate based compounds, silane compounds, epoxy compounds or acid anhydrides, as shown below.

The aforesaid isocyanate based cross-linking agents are isocyanates having at least two isocyanate groups and adducts thereof. More specifically, listed are aliphatic isocyanates, aliphatic isocyanates having a ring group, benzene diisocyanates, naphthalene diisocyanates, biphenyl isocyanates, diphenylmethane diusocyanates, triphenylmethane diisocyanates, triisocyanates, tetraisocyanates, and adducts of these isocyanates and adducts of these isocyanates with dihydric or trihydric polyalcohols.

Employed as specific examples may be isocyanate compounds described on pages 10 through 12 of JP-A No. 56-5535.

Incidentally, adducts of isocyanates with polyalcohols are capable of markedly improving the adhesion between layers and further of markedly minimizing layer peeling, image dislocation, and air bubble formation. Such isocyanates may be incorporated in any portion of the silver salt photothermographic dry imaging material. They may be incorporated in, for example, a support (particularly, when the support is paper, they may be incorporated in a sizing composition), and optional layers such as a photosensitive layer, a surface protective layer, an interlayer, an antihalation layer, and a subbing layer, all of which are placed on the photosensitive layer side of the support, and may be incorporated in at least two of the layers.

Further, as thioisocyanate based cross-linking agents usable in the present invention, compounds having a thioisocyanate structure corresponding to the isocyanates are also useful.

The amount of the cross-linking agents employed in the present invention is in the range of 0.001 to 2.000 mol per mol of silver, and is preferably in the range of 0.005 to 0.500 mol.

Isocyanate compounds as well as thioisocyanate compounds, which may be incorporated in the present invention, are preferably those which function as the cross-linking agent. However, it is possible to obtain the desired results by employing compounds which have a v of 0, namely compounds having only one functional group.

Listed as examples of silane compounds which can be employed as a cross-linking agent in the present invention are compounds represented by General Formal (1) or General Formula (2), described in JP-A No. 2002-22203.

Compounds, which can be used as a cross-linking agent, may be those having at least one epoxy group. The number of epoxy groups and corresponding molecular weight are not limited. It is preferable that the epoxy group be incorporated in the molecule as a glycidyl group via an ether bond or an imino bond. Further, the epoxy compound may be a monomer, an oligomer, or a polymer. The number of epoxy groups in the molecule is commonly from about 1 to about 10, and is preferably from 2 to 4. When the epoxy compound is a polymer, it may be either a homopolymer or a copolymer, and its number average molecular weight Mn is most preferably in the range of about 2,000 to about 20,000.

Acid anhydrides are compounds which have at least one acid anhydride group having the structural formula described below.

—CO—O—CO—

The acid anhydrites are to have at least one such acid anhydride group. The number of acid anhydride groups, and the molecular weight are not limited.

These acid anhydrides may be employed individually or in combinations of at least two types. The added amount is not particularly limited, but is preferably in the range of $1\times10^{-6}$ to $1\times10^{-2}$ mol/m$^2$ and is more preferably in the range of $1\times10^{-6}$ to $1\times10^{-3}$ mol/m$^2$.

In the present invention, the acid anhydrides may be incorporated in optional layers on the photosensitive layer side on a support, such as a photosensitive layer, a surface protective layer, an interlayer, an ant-halation layer, or a subbing layer, and may be incorporated in at least two layers. Further, the acid anhydrides may be incorporated in the layer(s) in which the epoxy compounds are incorporated.

<Silver Saving Agent>

In the present invention, it is possible to increase the effect of the present invention by using of a silver saving agent.

The silver saving agents, used in the present invention, refer to compounds capable of reducing the silver amount to obtain a definite silver image density. Even though various mechanisms may be considered to explain functions regarding a decrease in the silver amount, compounds having functions to enhance covering power of developed silver are preferable. The covering power of developed silver, as described herein, refers to optical density per unit amount of silver.

Listed as preferred examples of silver saving agents are hydrazine derivatives, vinyl and quaternary onium compounds represented.

Listed as specific examples of hydrazine derivatives are Compounds H-1–H-29 described in columns 1–20 of U.S. Pat. No. 5,545,505, Compounds 1–12 described in columns 9–11 of U.S. Pat. No. 5,464,738, and Compounds H-1-1 to H-1-28, H-2-1 to H-2-9, H-3-1 to H-3-12, H-4-1 to H-4-21, and H-5-1 to H-5-5 described in JP-A No. 20021-27790.

Listed as specific examples of vinyl compounds are Compounds CN-01–CN-13 described in columns 13–14 of U.S. Pat. No. 5,545,515, Compounds HET-01–HET-02 described in column 10 of U.S. Pat. No. 5,635,339, Compounds MA-01–MA-07 described in columns 9–10 of U.S. Pat. No. 5,654.130, Compounds IS-01–IS-04 described in columns 9–10 of U.S. Pat. No. 5,705,324, and Compounds 1-1–218-2 described in paragraphs [0043]–[0088] of JP-A No. 2001-125224.

Listed as a specific example of quaternary onium compounds is triphenyltetrazolium.

Listed as specific examples of silane compounds are alkoxysilane compounds having at least two of the primary or secondary amino groups described in paragraphs [0027]–[0029] of JP-A No 2003-5324 and salts thereof.

The added amount of the aforesaid silver saving agents is in the range of $1\times10^{-5}$–1 mol per mol of the organic silver salts, and is preferably in the range of $1\times10^{-4}$–$5\times10^{-1}$ mol.

(Antifogging and Image Stabilizing Agents)

Antifogging and image stabilizing agents employed in the silver salt photothermographic dry imaging materials of the present invention will now be described.

Since reducing agents possessing protons such as bisphenols and sulfonamidophenols are primarily employed, it is preferable that compounds are incorporated which are capable of deactivating reducing agents by generating active species capable of extracting a hydrogen atom. Compounds as a colorless photo-oxidizing compound are preferred which are capable of forming free radicals during exposure as a reacting active species.

Accordingly, any compound is acceptable as long as it exhibits such functions, but organic free radicals composed of a plurality of atoms are preferred. Compounds having any structure are acceptable as long as they exhibit such functions and do not adversely affect the targeted functions of silver salt photothermographic dry imaging materials.

Further, it is preferable that these compounds, which generate free radicals, have a carbon ring type or a heterocyclic aromatic group to provide a generated free radical with stability in such a manner that the free radical has sufficient contact time to undergo reaction with reducing agents to become deactivated.

Listed as these representative compounds may be biimidazolyl compounds as well as iodonium compounds.

The added amount of the above biimidazolyl compounds or iodonium compounds is in the range of 0.001–0.1 mol/$m^2$, and is preferably in the range of 0.005–0.05 mol/$m^2$. Incidentally, it is possible to incorporate the aforesaid compounds in any of the constituting layers. However, it is preferable to incorporate them adjacent to reducing agents.

Further, known as antifogging and image stabilizing agents are many compounds capable of releasing a halogen atom as an active species.

The added amount of these compounds is preferably in a range in which an increase in print-out silver due to the formation of silver halide causes substantially no problem. The ratio to compounds which do not form active halogen radicals is at most 150 percent at maximum, but is more preferably at most 100 percent. Listed as specific examples of compounds which generate these active halogen atoms are compounds (III-1)–(III-23) described in paragraphs [0086]–[0087] of JP-A No. 2002-169249.

Antifogging agents, other than the above, which are preferably employed in the present invention, will now be described.

Listed as antifogging agents which are preferably employed in the present invention may be, for example, Compounds "a"–"j" described in paragraph [0012] of JP-A No. 8-314059, thiosulfonate esters A–K described in paragraph [0028] of JP-A No. 7-209797, Compounds Examples (1)–(44) described on page 14 of JP-A No. 55-140833, Compounds (I-1)–(I-6) described in paragraph [0063] and (C-1)–(C-3) described paragraph [0066] of JP-A No. 2001-13627, Compounds (III-1)–(III-108) described in paragraph (0027) of JP-A No. 2002-90937, Compounds VS-1–VS-7 and Compounds HS-1 HS-5, described in paragraph [0013] of JP-A No. 6-208192 as vinylsulfones and/or β-halosulfones, Compounds KS-1–KS-8 described in JP-A No. 2000-330235 as sulfonylbenztriazole compounds, and PR-01–PR-08 described in Japanese Patent Publication Open to Public Inspection (under PCT application) No. 2000-515995.

The above antifogging agents are commonly employed in an amount of at least 0.001 mol per mol of silver. However, the range is commonly 0.01–5 mol per mol of silver, but is preferably 0.02–0.6 mol.

Incidentally, other than the above compounds, compounds which have conventionally been known as antifogging agents may be incorporated in the silver salt photothermographic dry imaging materials of the present invention. Such compounds may be those capable of generating reactive species as above, as well as those which exhibits different antifogging mechanisms. Listed as such compounds are, for example, those described in U.S. Pat. Nos. 3,589,903, 4,546,075, and 4,452,885; JP-A No. 59-57234; U.S. Pat. Nos. 3,874,946 and 4,756,999; and JP-A Nos. 9-288328 and 9-90550. In addition, listed as other antifogging agents are compounds disclosed in U.S. Pat. No. 5,028,523 and European Patent Nos. 600,587, 605,981, and 631,176.

In the case in which the reducing agents employed in the present invention have an aromatic hydroxyl group (—OH), it is particularly preferable that in the case of bisphenols, non-reducible compounds having a group capable of forming a hydrogen bond with the above group are simultaneously employed.

Further, in this invention, specific examples of particularly preferable hydrogen bond forming compounds include Compounds (II-1)–(II-40) described in paragraphs [0061]–[0064] of JP-A No. 2002-90937.

The silver salt photothermographic dry imaging materials of the present invention form photographic images via a heat development process. It is preferable that, if desired, toners which control the color tone of silver are incorporated commonly in an (organic) binder matrix in a dispersed state.

Examples of appropriate toners employed in the present invention are disclosed in RD 17029, and U.S. Pat. Nos. 4,123,282, 3,994,732, 3,846,136, and 4,021,249. Examples are described below.

Imides (e.g, succinimide, phthalimide, naphthalimide, N-hydroxy-1,8-naphthalimide); mercaptans (e.g., 3-mercapto-1,2,4-triazole); phthalazinone derivatives or metal salts of these derivatives (e.g., phthalazinone, 4-(1-naphthyl) phthalazinone, 6-chlorophthalazinone, 5,7-dimethyloxyphthalazinone, and 2,3-dihydro-1,4-phthalazinedione); combinations of phthalazine and phthalic acids (e.g., phthalic acid, 4-methylphthalic acid, 4-nitrophthalic acid, and tetrachlorophthalic acid); combinations with at least one compound selected from phthalazine and maleic anhydride; and phthalic acid, 2,3-naphthalenedicarboxylic acid or o-phenylenic acid derivatives and its anhydrides (e.g., phthalic acid, 4-methylphthalic acid, 4-nitrophthalic acid, and tetrachlorophthalic anhydride). Particularly preferred toners include phthalazinone or combinations of phthalazine and phthalic acids or phthalic anhydrides.

(Fluorine Based Surface Active Agents)

It is preferable to employ the fluorine based surface active agents represented by following General Formula (SF) These compounds make it possible to improve transporting property of the film in the thermal processing apparatus and they tend to have less accumulating property in a living body.

$$(Rf\text{-}(L1)_{n1})_p\text{-}(Y)_{m1}\text{-}(A)_q \qquad \text{General Formula (SF)}$$

Wherein Rf represents a substituent containing a fluorine atom; L1 represents a divalent linking group; Y represents a linking group containing no fluorine atoms and having a (p+q) valence; A represents an anion group or a salt thereof; n1 and m1 each represents an integer of 0 or 1; p and q each represents an integer of 1–3, provided that when q is 1, both n1 and m1 are not 0 at the same time.

The fluorine based surface active agents represented by General Formula (SF) are prepared as follows. Alkyl compounds having 1–25 carbon atoms into which fluorine atoms are introduced (e.g., compounds having a trifluoromethyl group, a pentafluoroethyl group, a perfluorobutyl group, a perfluorooctyl group, or a perfluorooctadecyl group) and alkenyl compounds (e.g., a perfluorohexenyl group or a perfluorononenyl group) undergo addition reaction or condensation reaction with each of the trivalent—hexavalent alknaol compounds into which fluorine atom(s) are not introduced, aromatic compounds having 3–4 hydroxyl groups or hetero compounds. Anion group (A) is further introduced into the resulting compounds (including alknaol compounds which have been partially subjected to introduction of Rf) employing, for example, sulfuric acid esterification.

Listed as the aforesaid trivalent—hexavalent alkanol compounds are glycerin, pentaerythritol, 2-methyl-2-hydroxymethyl-1,3-propanediol, 2,4-dihydroxy-3-hydroxymethylpentane, 1,2,6-hexanetriol, 1,1,1-tris(hydroxymethyl) propane, 2,2-bis(butanol), aliphatic triol, tetramethylolmethane, D-sorbitol, xylitol, and D-mannitol.

Listed as the aforesaid aromatic compounds, having 3–4 hydroxyl groups and hetero compounds, are 1,3,5-trihydroxybenzene and 2,4,6-trihydroxypyridine.

It is possible to add the fluorine based surface active agents represented by General Formula (SF) to liquid coating compositions, employing any conventional addition methods known in the art. Namely, they are dissolved in solvents such as alcohols including methanol or ethanol, ketones such as methyl ethyl ketone or acetone, and polar solvents such as dimethylformamide, and then added. Further, they may be dispersed into water or organic solvents in the form of minute particles at a maximum size of 1 μm, employing a sand mill, a jet mill, or an ultrasonic homogenizer and then added. Many techniques are disclosed for minute particle dispersion, and it is possible to perform dispersion based on any of these. It is preferable that the aforesaid fluorine based surface active agents represented by General Formula (SF) are added to the protective layer which is the outermost layer.

The added amount of the aforesaid fluorine based surface active agents represented by General Formula (SF)is preferably $1\times10^{-8}$–$1\times10^{-1}$ mol per $m^2$. When the added amount is less than the lower limit, it is not possible to achieve desired charging characteristics, while it exceeds the upper limit, storage stability degrades due to an increase in humidity dependence.

It is preferable that the silver salt photothermographic dry imaging materials of the present invention satisfy the conditions of Lb/Le=1.5–10, wherein Le (in μm) represents the average particle diameter of the matting agents incorporated in the outermost layer on the substrate side having a light-sensitive layer, while Lb (in μm) represents the average particle diameter of the matting agents incorporated in the outermost layer on the side having a back coat layer. By controlling Lb/Le to be within the above range, it is possible to minimize uneven density during development.

(Surface Layer)

In the present invention, it is preferable that in order to achieve the purposes of the present invention as well as to control surface roughness, organic or inorganic powders as a matting agent are employed in the surface layer (on the light-sensitive layer side or the light-insensitive layer on the side opposite the light-sensitive layer beyond the support) of the silver salt photothermographic dry imaging material. Preferably employed as powders used in the present invention are those of a Morse hardness of at least 5. It is possible to use powders selected from prior art inorganic or organic powders. Listed as inorganic powders may, for example, be, titanium oxide, boron nitride, $SnO_2$, $SiO_2$, $Cr_2O_3$, $\alpha$-$Al_2O_3$, $\alpha$-$Fe_2O_3$, $\alpha$-FeOOH, SiC, cerium oxide, corundum, artificial diamond, garnet, mica, quartzite, silicon nitride, and silicon carbide. Listed as organic powders may, for example, be powders of polymethyl methacrylate, polystyrene, and Teflon (register trade name). Of these, preferred are inorganic powders such as $SiO_2$, titanium oxide, barium sulfate, $\alpha$-$Al_2O_3$, $\alpha$-$Fe_2O_3$, $\alpha$-FeOOH, $Cr_2O_3$, and mica. Of these, are preferred $SiO_2$ and $\alpha$-$Al_2O_3$, and $SiO_2$ is particularly preferred.

In the present invention, it is preferable that the above powders are subjected to a surface treatment employing Si compounds or Al compounds. The use of powders which are subjected to such surface treatment makes it possible to improve the surface state of the uppermost layer. As a content of the above Si or Al, Si is preferably 0.1–10 percent by weight with respect to the above powders and Al is preferably 0.1–10 percent by weight, and Si is more preferably 0.1–5 percent by weight and Al is more preferably 0.5–5 percent by weight, while Si is most preferably 0.1–2 percent by weight and Al is most preferably 0.1–2 percent by weight. Further, it is preferable that the weight ratio of Si is less than that of Al. It is possible to perform the surface treatment employing the method described in JP-A No. 2-83219. Incidentally, the average particle diameter of the powders in the present invention, as described herein, refers to the average diameter in the case of spherical particle powders, the average longer axis length in acicular particle powders, the average length of the maximum diagonal of tabular plane in the tabular particle powders. The above diameter is readily determined through measurement employing an electron microscope.

The average particle diameter of the above organic or inorganic powders is preferably 0.5–10 μm, and is more preferably 1.0–8.0 μm.

The average particle diameter of organic or inorganic powders incorporated in the outermost layer on the light-sensitive layer side is customarily 0.5–8.0 μm, is preferably 1.0–6.0 μm, and is more preferably 2.0–5.0 μm. The added amount is customarily 1.0–20 percent by weight with respect to the weight of binders (the weight of hardening agents is included in the weight of the binders), is preferably 2.0–15 percent by weight, and is more preferably 3.0–10 percent by weight. The average particle diameter of organic or inorganic powders incorporated in the outermost layer on the side opposite the light-sensitive layer side beyond the support is customarily 2.0–15.0 μm, is preferably 3.0–12.0 μn, and is more preferably 4.0–10.0 μm. The added amount is customarily 0.2–10 percent by weight with respect to the weight of binders (the weight of hardening agents is included in the weight of the binders), is preferably 0.4–7 percent by weight, and is more preferably 0.6–5 percent by weight.

Further, the variation coefficient of the particle size distribution of powders is preferably at most 50 percent, is more preferably at most 40 percent, and is most preferably at most 30 percent.

The variation coefficient of the particle size distribution, as described herein, refers to the value represented by the formula below.

{(standard deviation of particle diameter)/(average of particle diameter)}×100

Methods for adding organic or inorganic powders include one in which they are dispersed into a liquid coating composition and coated, and the other in which after coating a liquid coating composition, organic or inorganic powders are sprayed onto the coating prior to completion of drying. Both methods may be used in combination.

Listed as materials of the support employed in the silver salt photothermographic dry imaging material of the present invention are various kinds of polymers, glass, wool fabric, cotton fabric, paper, and metal (for example, aluminum). From the viewpoint of handling as information recording materials, flexible materials, which can be employed as a sheet or can be wound in a roll, are suitable. Accordingly, preferred as supports in the silver salt photothermographic dry imaging material of the present invention are plastic films (for example, cellulose acetate film, polyester film, polyethylene terephthalate film, polyethylene naphthalate film, polyamide film, polyimide film, cellulose triacetate film or polycarbonate film). Of these, in the present invention, biaxially stretched polyethylene terephthalate film is particularly preferred. The thickness of the supports is commonly from about 50 to about 300 μm, and is preferably from 70 to 180 μm.

In the present invention, in order to minimize static-charge buildup, electrically conductive compounds such as metal oxides and/or electrically conductive polymers may be incorporated in composition layers. The compounds may be incorporated in any layer, but are preferably incorporated in a subbing layer, a backing layer, and an interlayer between the photosensitive layer and the subbing layer. In the present invention, preferably employed are electrically conductive compounds described in columns 14 through 20 of U.S. Pat. No. 5,244,773.

Of these, in the present invention, it is preferable that electrically conductive metal oxides are incorporated in the surface protective layer on the backing layer side. By doing so, it was discovered that desirable effects (specifically, tracking properties during heat development) of the present invention were enhanced. Electrically conductive oxides, as described herein, refer to crystalline metal oxide particles. Those which contain oxygen defects and contain a small amount of foreign atoms which form a donor for employed metal oxides are particularly preferred since they exhibit high conductivity. The latter is particularly preferred since silver halide emulsion result in no fog. Examples of preferred metal oxides include ZnO, $TiO_2$, $SnO_2$, $Al_2O_3$, $In_2O_3$, $SiO_2$, MgO, BaO, $MoO_3$, and $V_2O_5$, and composite oxides thereof. Of these, ZnO, $TiO_2$, and $SnO_2$ are particularly preferred. Of examples containing foreign atoms, addition of Al or In to ZnO, addition of Sb, Nb, P, a halogen atom to $SnO_2$, or addition of Nb or Ta to $TiO_2$ is effective. The added amount of the above foreign atoms is preferably in the range of 0.01–30 mol percent, and is particularly preferable in the range of 0.1–10 mol percent. Further, in order to improve dispersibility of minute particles as well as transparency, silicon compounds may be added during preparation of the minute particles. Minute metal oxide particles employed in the present invention exhibit electrical conductivity. Their volume resistivity is at most $1\times10^7$ Ω·cm, and is specifically at most $1\times10^5$ Ω·cm. These oxides are described in JP-A Nos. 56-143431, 56-120519, and 58-62649. Further, as described in Japanese Patent Publication No. 59-62356, electrically conductive components may be employed which are prepared by allowing the above metal oxides to adhere to other crystalline metal oxide particles or fiber-shaped materials (for example, titanium oxide).

The available particle size is preferably at most 1 μm. When the particle size is at most 0.5 μm, stability after dispersion is enhanced, resulting in easier handling. In order to minimize light scattering, it is very preferable to use electrically conductive particles of a size of at most 0.3 μm, which make it possible to prepare transparent light-sensitive materials. Further, when electrically conductive metal oxides are acicular or fiber-shaped, the length and the diameter are preferably at most 30 μm and at most 1 μm, respectively, and are most preferably at most 10 μm and 0.3 μm, respectively. Further, the ratio of length/diameter is at least 3. Incidentally, $SnO_2$ is commercially available from Ishihara Sangyo Kaisha, Ltd. and it is possible to use SNS10M, SN-100P, SN-100D, and FSS10M.

The silver salt photothermographic dry imaging material of the present invention comprises a support having thereon at least one photosensitive layer. The photosensitive layer may only be formed on the support. However, it is preferable that at least one light-insensitive layer is formed on the photosensitive layer. For example, it is preferable that for the purpose of protecting a photosensitive layer, a protective layer is formed on the photosensitive layer, and in order to minimize adhesion between photosensitive materials as well as adhesion in a wound roll, a backing layer is provided on the opposite side of the support. As binders employed in the protective layer as well as the backing layer, polymers such as cellulose acetate, cellulose acetate butyrate, which has a higher glass transition point from the thermal development layer and exhibit abrasion resistance as well as distortion resistance are selected from the aforesaid binders.

For the purpose of increasing latitude, one of the preferred embodiments of the present invention is that at least two photosensitive layers are provided on the one side of the support or at least one photosensitive layer is provided on both sides of the support.

<Colorant>

In the silver salt photothermographic dry imaging material of the present invention, in order to control the light amount as well as the wavelength distribution of light which transmits the photosensitive layer, it is preferable that a filter layer is formed on the photosensitive layer side or on the opposite side, or dyes or pigments are incorporated in the photosensitive layer.

Employed as dyes may be compounds, known in the art, which absorb various wavelength regions according to the spectral sensitivity of photosensitive materials.

For example, when the silver salt photothermographic dry imaging material of the present invention is used as an image recording material utilizing infrared radiation, it is preferable to employ squarylium dyes having a thiopyrylium nucleus (hereinafter referred to as thiopyriliumsquarylium dyes) and squarylium dyes having a pyrylium nucleus (hereinafter referred to as pyryliumsquarylium dyes), as described in Japanese Patent Application No. 11-255557, and thiopyryliumcroconium dyes or pyryliumcroconium dyes which are analogous to the squarylium dyes.

Incidentally, the compounds having a squarylium nucleus, as described herein, refers to ones having 1-cyclobutene-2-hydroxy-4-one in their molecular structure. Herein, the hydroxyl group may be dissociated. Hereinafter, all of these dyes are referred to as squarylium dyes.

Incidentally, preferably employed as the dyes are compounds described in Japanese Patent Publication Open to Public Inspection No. 8-201959.

<Layer Structures and Coating Conditions>

It is preferable to prepare the silver salt photothermographic dry imaging material of the present invention as follows. Materials of each constitution layer as above are dissolved or dispersed in solvents to prepare coating compositions. Resultant coating compositions are subjected to simultaneous multilayer coating and subsequently, the resultant coating is subjected to a thermal treatment. "Simultaneous multilayer coating", as described herein, refers to the following. The coating composition of each constitution layer (for example, a photosensitive layer and a protective layer) is prepared. When the resultant coating compositions are applied onto a support, the coating compositions are not applied onto a support in such a manner that they are individually applied and subsequently dried, and the operation is repeated, but are simultaneously applied onto a support and subsequently dried. Namely, before the residual amount of the total solvents of the lower layer reaches 70 percent by weight, the upper layer is applied.

Simultaneous multilayer coating methods, which are applied to each constitution layer, are not particularly limited. For example, are employed methods, known in the art, such as a bar coater method, a curtain coating method, a dipping method, an air knife method, a hopper coating method, and an extrusion method. Of these, more preferred is the pre-weighing type coating system called an extrusion coating method. The aforesaid extrusion coating method is suitable for accurate coating as well as organic solvent coating because volatilization on a slide surface, which occurs in a slide coating system, does not occur. Coating methods have been described for coating layers on the photosensitive layer side. However, the backing layer and the subbing layer are applied onto a support in the same manner as above. Multilayer coating methods for the photothermographic materials are disclosed in detail in JP-A No. 2000-15173.

A silver coverage in the present invention may be chosen to be a preferable amount in accordance with the purpose of the photothermographic material. For the purpose of medical imaging use, it is preferably 0.3 to 1.5 g/m$^2$, more preferably, 0.5,to 1.5 g/m$^2$. Among the amount of the silver coverage, silver derived form silver halide is preferably 2 to 18 wt %, and more preferably, 5 to 15 wt %.

Further, in the present invention, the number of coated silver halide grains, having a grain diameter (being a sphere equivalent grain diameter) of at least 0.01 μm, is preferably from $1\times10^{14}$ to $1\times10^{18}$ grains/m$^2$, and is more preferably from $1\times10^{15}$ to $1\times10^{17}$.

Further, the coated weight of aliphatic carboxylic acid silver salts of the present invention is from $10^{-17}$ to $10^{-15}$ g per silver halide grain having a diameter (being a sphere equivalent grain diameter) of at least 0.01 μm, and is more preferably from $10^{-16}$ to $10^{-14}$ g.

When coating is carried out under conditions within the aforesaid range, from the viewpoint of maximum optical silver image density per definite silver coverage, namely covering power as well as silver image tone, desired results are obtained.

In the present invention, it is preferable that silver salt photothermographic dry imaging materials contain solvents in an amount of 5–1,000 mg/m$^2$ during development. It is more preferable to control the amount of solvents in the range of 100–500 mg/m$^2$. By doing so, silver salt photothermographic dry imaging materials result in higher photographic speed, lower fog, and higher maximum density.

Listed as solvents are those described in paragraph [0030] of JP-A No. 2001-264930. However, solvents are not limited thereto. Further, these solvents may be employed individually or in combinations of several types.

Incidentally, it is possible to control the content of the above solvents in the silver salt photothermographic dry imaging material by varying conditions such as temperature conditions in the drying process after the coating process. Further, it is possible to determine the content of the aforesaid solvents, employing gas chromatography, under proper conditions, to detect incorporated solvents.

(Packages)

In the case in which the silver salt photothermographic dry imaging material of the present invention is stored, in order to minimize density variation and fog formation during storage, it is preferable that the aforesaid material is packaged and stored. The void ratio in the package is commonly 0.01–10 percent, and is preferably 0.02–5 percent. Further, it is preferable that nitrogen gas is sealed in the packages. The particle pressure of nitrogen in the package is to be controlled to at least 80 percent, and preferably at least 90 percent.

<Exposure Conditions>

When the silver salt photothermographic dry imaging material of the present invention is exposed, it is preferable to employ an optimal light source for the spectral sensitivity provided to the aforesaid photosensitive material. For example, when the aforesaid photosensitive material is sensitive to infrared radiation, it is possible to use any radiation source which emits radiation in the infrared region. However, infrared semiconductor lasers (at 780 nm and 820 nm) are preferably employed due to their high power, as well as ability to make photosensitive materials transparent.

In the present invention, it is preferable that exposure is carried out utilizing laser scanning. Employed as the exposure methods are various ones. For example, listed as a firstly preferable method is the method utilizing a laser scanning exposure apparatus in which the angle between the scanning surface of a photosensitive material and the scanning laser beam does not substantially become vertical.

"Does not substantially become vertical", as described herein, means that during laser scanning, the nearest vertical angle is preferably from 55 to 88 degrees, is more preferably from 60 to 86 degrees, and is most preferably from 70 to 82 degrees.

When the laser beam scans photosensitive materials, the beam spot diameter on the exposed surface of the photosensitive material is preferably at most 200 μm, and is more preferably at most 100 mm, and is more preferably at most 100 μm. It is preferable to decrease the spot diameter due to the fact that it is possible to decrease the deviated angle from the verticality of laser beam incident angle. Incidentally, the lower limit of the laser beam spot diameter is 10 μm. By performing the laser beam scanning exposure, it is possible to minimize degradation of image quality according to reflection light such as generation of unevenness analogous to interference fringes.

Further, as the second method, exposure in the present invention is also preferably carried out employing a laser scanning exposure apparatus which generates a scanning laser beam in a longitudinal multiple mode, which minimizes degradation of image quality such as generation of unevenness analogous to interference fringes, compared to the scanning laser beam in a longitudinal single mode.

The longitudinal multiple mode is achieved utilizing methods in which return light due to integrated wave is employed, or high frequency superposition is applied. The longitudinal multiple mode, as described herein, means that the wavelength of radiation employed for exposure is not single. The wavelength distribution of the radiation is commonly at least 5 nm, and is preferably at least 10 nm. The upper limit of the wavelength of the radiation is not particularly limited, but is commonly about 60 nm.

Further, as the third embodiment, it is preferable to form images under scanning exposure, employing at least two laser beams.

In the above image recording methods utilizing a plurality of laser beams, in order to meet demands for forming highly detailed images and increasing printing speed, a technique which is used in laser printers and digital copiers is available in which an image is written employing a plurality of lines during scanning. The above technique is disclosed, for example, in JP-A No. 60-166916. This method is one in which a laser beam irradiated from a beam source unit is subjected to deflection scanning employing a polygonal mirror, and is then focused on a photoreceptor via an fθ lens. This is a laser scanning optical device which utilizes the same principles as in laser imagers.

For the use in which an image is written employing a plurality of lines during one scanning, focusing of a laser beam on a photoreceptor in the image writing device of laser printers as well as digital copiers is performed in such a manner that the subsequent laser beam is focused while being shifted by one line of scanning from the focusing position of one laser beam. Specifically, two light beams are to be adjacent to each other at an interval of an order of several 10 μm on the image in the secondary scanning direction. At a printing density of 400 dpi (dpi, as described herein, represents the number of dots per inch or 2.54 cm), secondary scanning direction pitch of two beams is 63.5 μm, while at a printing density of 600 dpi, the pitch is 42.3 μm. Differing from the method in which shift equivalent to resolution is performed in the scanning direction, in the present invention, it is preferable that an image is written in such a manner that at least two laser beams are focused on the same position of the exposure surface while varying incident angle. During this operation, it is preferable to satisfy the range represented by $0.9\times E \leqq En \leqq 1.1\times E$, wherein E represents the exposure energy on the exposure surface when written by a common single line laser beam (wavelength λ in nm) and En represents the exposure energy of one of "n" laser beams, assuming that in this case, all "n" laser beams have the same energy. By doing so, energy is secured on the exposure surface, and reflection of each laser beam on the light-sensitive layer decreases due to low exposure energy of the laser beam, whereby interference fringes are minimized.

Incidentally, in the above, the wavelength of a plurality of laser beams is used to be the same as λ. However, laser beams of different wavelengths may also be employed. In this case, for λ (in nm), it is preferable that the range is controlled to hold the formula of $(\lambda-30)<\lambda 1, \lambda 2, \ldots \lambda n \leqq (\lambda+30)$.

Incidentally, in the recording methods of the aforesaid first and second embodiments, it is possible to suitably select any of the following lasers employed for scanning exposure, which are generally well known, while matching the use. The aforesaid lasers include solid lasers such as a ruby laser, a YAG laser, and a glass laser; gas lasers such as a HeNe laser, an Ar ion laser, a Kr ion laser, a $CO_2$ laser a CO laser, a HeCd laser, an $N_2$ laser, and an excimer laser; semiconductor lasers such as an InGaP laser, an AlGaAs laser, a GaASP laser, an InGaAs laser, an InAsP laser, a $CdSnP_2$ laser, and a GaSb laser; chemical lasers; and dye lasers. Of these, from the viewpoint of maintenance as well as the size of light sources, it is preferable to employ any of the semiconductor lasers having a wavelength of 600 to 1,200 nm.

The beam spot diameter of lasers employed in laser imagers, as well as laser image setters, is commonly in the range of 5 to 75 μm in terms of a short axis diameter and in the range of 5 to 100 μm in terms of a long axis diameter. Further, it is possible to set a laser beam scanning rate at the optimal value for each photosensitive material depending on the inherent speed of the silver salt photothermographic dry imaging material at laser transmitting wavelength and the laser power.

(Heat Development Processor)

A heat development processor, as described in the present invention, is composed of a film supplying section represented by a film tray, a laser image recording section, a heat development section which supplies uniform and stable heat onto the entire surface of heat developable materials, and a conveying section which discharges, to the exterior of the apparatus, a silver salt photothermographic dry imaging material on which an image is formed by heat development via laser beam recording from the film supplying section. FIG. 1 shows the specific example of heat development processor in the above embodiment.

Heat development apparatus 100 is composed of feeding section 100 which feeds each of film F, exposure section 120 which exposes fed film F, development section 110 which develops exposed film F, cooling section 150 which terminates development, and accumulating section 160, paired feeding rollers 140 which are used to feed film F from the feeding section, paired feeding rollers 144 which convey the film to the development section, and a plurality of paired rollers such as paired conveying rollers 141, 142, 143, and 145 which smoothly convey film F between sections. The development section is composed of heat drum 1 having a plurality of counter rollers 2 capable of being heated as a heating device to develop film F, which are held while almost being brought into contact with the outer peripheral surface and separating claw 6.

Incidentally, the conveying rate of a silver salt photothermographic dry imaging material is preferably in the range of 10–200 mm/second.

The development conditions of the silver salt photothermographic dry imaging materials of the present invention vary depending on employed devices, apparatus or means. Typically, However, an exposed image heat developable material is developed upon being heated at a suitable high temperature. A latent image formed by exposure is developed by heating the latent image bearing heat developable material at a medium high temperature (about 80–200° C., and preferably about 100–about 200° C.) for a sufficient time (commonly about 1 second–about 2 minutes).

When the heating temperature is less than 80° C., it is not possible to achieve desired density over a short time. On the other hand, when the temperature exceeds 200° C., binders melt and are transferred onto rollers, whereby images themselves as well as tracking properties and the processor are adversely affected. Heating undergoes oxidation-reduction reaction between organic silver salts (which function as an oxidizing agent) and reducing agents to form silver images. This reaction proceeds without supplying any processing liquid, such as water, from the exterior.

Heating may be carried out employing typical heating means such as hot plates, irons, hot rollers and heat generators employing carbon and white titanium. When the protective layer-provided silver salt photothermographic dry imaging material of the present invention is heated, from the viewpoint of uniform heating, heating efficiency, and workability, it is preferable that heating is carried out while the surface of the side provided with the protective layer comes into contact with a heating means, and thermal development is carried out during the transport of the material while the surface comes into contact with the heating rollers.

EXAMPLES

The present invention will now be detailed with reference to examples, however the present invention is not limited thereto. Incidentally, "%" in the examples is "% by weight", unless otherwise specified.

<<Polymer Synthesis>>

Placed int0 a 0.3-liter four-necked separable flask fitted with a dripping device, a thermometer, a nitrogen gas-inletting pipe, a stirring unit, and a reflux cooling pipe was 20 g of methyl ethyl ketone and heated to 70° C. A monomer (in g) of the component ratio described in Table 2 was collected and 2 g of lauryl peroxide was added. The resulting mixed solution was dripped into the flask over a period of two hours, and the resulting mixture underwent reaction for 5 hours at the same temperature. Thereafter, 80 g of methyl ethyl ketone was added and cooled, whereby a polymer solution at 50 Percent by weight of the polymer was obtained. As the molecular weight, the weight average molecular weight in terms of polystyrene was obtained employing GPC.

TABLE 2

| | R-1 | R-2 | R-3 | R-4 |
|---|---|---|---|---|
| Blenmer-PME-400 | 20 | 20 | 20 | 20 |
| Blenmer-PSE-400 | 20 | 20 | | |
| MMA | | | 10 | 10 |
| BMA | | | 10 | 10 |
| MAA | 10 | 10 | 10 | 10 |
| DAAM | 50 | 50 | 50 | 50 |
| Degree of Polymerization | 5125 | 52116 | 5500 | 655255 |
| Water Solubility (1%) | soluble | soluble | soluble | insoluble |
| Water Solubility (1%) at Semi-neutralization | soluble | soluble | soluble | soluble |
| MEK Solubility (5%) | soluble | soluble | soluble | soluble |

Blenmer PME-400: methacrylate having - $(EO)_m$-$CH_3$ ($m \approx 9$)
Blenmer PSE-400: methacrylate having - $(EO)_m$-$CH_3$ ($m \approx 9$)
(EO: ethyleneoxy group)
All the above compounds are produced by NOF Corp.
MMA: methyl methacrylate,
MAA: methacrylic acid,
BMA: butyl methacrylate, and TABLE 2-continued

| | R-1 | R-2 | R-3 | R-4 |
|---|---|---|---|---|

DAAM: diacetone acrylamide (all produced by Kyowa Hakko Kogyo Co., Ltd.
Water Solubility (1%): A test was conducted whether each of the polymers dissolved in water at 23° C. reached a concentration of 1%.
Water Solubility (1%) at Semi-neutralization: The same solubility as above, however, dissolution was performed together with sodium hydroxide in an amount which neutralized ½ equivalent of carboxylic acid contained in the polymers.
MEK solubility (5%): A test was similarly conducted whether the polymer dissolved in MEK (methyl ethyl ketone) at 25° C. reached 5%.

<<Preparation of Photosensitive Silver Halide Emulsion>>

(Preparation of Photosensitive Silver Halide Emulsion 1)

| | |
|---|---|
| (Solution A1) | |
| Phenylcarbamoyl-modified gelatin | 88.3 g |
| Compound (*1) (10% aqueous methanol solution) | 10 ml |
| Potassium bromide | 0.32 g |
| Water to make | 5429 ml |
| (Solution B1) | |
| 0.67 mol/L aqueous silver nitrate solution | 2635 ml |
| (Solution C1) | |
| Potassium bromide | 51.55 g |
| Potassium iodide | 1.47 g |
| Water to make | 660 ml |
| (Solution D1) | |
| Potassium bromide | 154.9 g |
| Potassium iodide | 4.41 g |
| $K_3IrCl_6$ (equivalent to $4 \times 10^{-5}$ mol/Ag) | 50.0 ml |
| Water to make | 1982 ml |
| (Solution E1) | |
| 0.4 mol/L aqueous potassium bromide solution | the following amount controlled by silver potential |
| (Solution F1) | |
| Potassium hydroxide | 0.71 g |
| Water to make | 20 ml |
| (Solution G1) | |
| 56 percent aqueous acetic acid solution | 18.0 ml |
| (Solution H1) | |
| Sodium carbonate anhydride | 1.72 g |
| Water to make | 151 ml |

(*1) Compound A: $HO(CH_2CH_2O)_n(CH(CH_3)CH_2O)_{17}(CH_2CH_2O)_mH$ ($m + N = 5$ through 7)

Upon employing a mixing stirrer shown in Japanese Patent Publication Nos. 58-58288 and 58-58289, ¼ portion of Solution B1 and whole Solution C1 were added to Solution A1 over 4 minutes 45 seconds, employing a double-jet precipitation method while adjusting the temperature to 30° C. and the pAg to 8.09, whereby nuclei were formed. After one minute, whole Solution F1 was added. During the addition, the pAg was appropriately adjusted employing Solution E1. After 6 minutes, ¾ portion of Solution B1 and whole Solution D1 were added over 14 minutes 15 seconds, employing a double-jet precipitation method while adjusting the temperature to 30° C. and the pAg to 8.09. After stirring for 5 minutes, the mixture was cooled to 40° C., and whole Solution G1 was added, whereby a silver halide emulsion was flocculated. Subsequently, while leaving 2000 ml of the flocculated portion, the supernatant was removed, and 10 L of water was added. After stirring, the silver halide emulsion was again flocculated. While leaving 1,500 ml of the flocculated portion, the supernatant was removed. Further, 10 L of water was added. After stirring, the silver halide emulsion was flocculated. While leaving 1,500 ml of the flocculated portion, the supernatant was removed. Subsequently, Solution H1 was added and the resultant mixture was heated to 60° C., and then stirred for an additional 120 minutes. Finally, the pH was adjusted to 5.8 and water was added so that the weight was adjusted to 1,161 g per mol of silver, whereby Silver Halide Emulsion 1 was prepared.

Silver Halide Emulsion 1, prepared as above, was composed of monodispersed cubic silver iodobromide grains of an average equivalent spherical diameter of 0.060 μm, a variation coefficient of the average equivalent spherical diameter of 12 percent, and a [100] plane ratio of 92 percent. The average equivalent spherical diameter as well as the variation coefficient of the equivalent spherical diameter was determined in such a manner that the diameter of each of 1,000 grains was determined employing an electron microscope, and the resultant values were averaged. Further, the [100] plane ratio of these grains was obtained employing the Kubelka-Munk method.

Incidentally, the ratio of silver halide grains in Silver Halide Emulsion 1, of an average grain diameter of 0.001–0.050 μm, was 61 percent by weight in terms of silver of the total silver halide grains.

(Preparation of Silver Halide Emulsions 2–7)

Silver Halide Emulsions 2–7 were prepared in the same manner as above, except that the phenylcarbamoylated gelatin of Solution Al was replaced with each of the synthetic polymers listed in Table 1, the pH was adjusted to 6.0 by the addition of NaOH, and the emulsion making temperature was altered as listed in Table 1.

(Phase Inversion of Silver Halide Emulsions 1–7 into MEK)

Each of Silver Halide Emulsions 1–8 was collected to reach 10 g and diluted at a factor of 500 employing MEK. Subsequently, moisture was removed via vacuum distillation employing a rotary evaporator. Light-sensitive MEK Emulsions 1–7 were prepared as above. The moisture content was determined employing the Karl-Fischer method. Dispersibility in MEK was visually observed and the degree of dispersion or coagulation was evaluated. The results were described in Table 3.

<<Preparation of Powdered Organic Silver Salts>>

(Preparation of Silver Halide Grain Containing Powdered Organic Silver Salt A-1)

Organic silver salt particles were prepared employing unpurified behenic acid (a commercially available reagent). The above behenic acid was analyzed employing the analytical method described below, resulting in a content ratio of behenic acid of 80 percent by weight. Since the residue consisted of arachidic acid as well as stearic acid, by employing each of the reagents of arachidic acid, stearic acid, and palmitic acid, organic acid reagents were mixed to reach 130.8 g of behenic acid, 67.7 g of arachidic acid, 43.6 g of stearic acid, and 2.3 g of palmitic acid. Thereafter, these organic acids were charged into 4,720 ml of pure water and dissolved at 80° C. Subsequently, 540.2 ml of a 1.5 mol/L aqueous sodium hydroxide solution was added and 6.9 ml of concentrated nitric-acid was then added. Thereafter, the resultant mixture was cooled to 55° C., whereby a sodium fatty acid mixed solution was obtained. In a light-shielding state (hereinafter, the light-shielding state was continued) while maintaining the sodium fatty acid mixed solution at 55° C., 45.3 g of aforesaid Silver Halide Emulsion and 450 ml of pure water were added and stirred for 5 minutes. Subsequently, 702.6 ml of a 1 mol/L aqueous silver nitrate solution was added over a period of two minutes, and stirred for 10 minutes, whereby Silver Halide Grain Containing Organic Silver Salt Particle Dispersion A-1 was obtained. Thereafter, resultant Silver Halide Grain Containing Organic Silver Salt Particle Dispersion A-1 was placed in a washing vessel. After adding deionized water while stirring, the resultant mixture was allowed to stand so that Silver Halide Grain Containing Organic Silver Salt Particles A-1 was separated via floating. The water-soluble salts in the lower portion od the washing vessel were removed. Thereafter, washing employing deionized water was repeated until the electrical conductivity of the effluent reached 2 μS/cm, and centrifugal dehydration was performed, whereby wet cake Silver Halide Grain Containing Organic Silver Salt Particles A-1 was obtained. Wet cake Silver Halide Grain Containing Organic Silver Salt Particles A-1 was dried until the moisture content reached 0.1 percent employing a fluidized-bed dryer (such as Mizet Dryer Type MDF-64, produced by Dalton Co.) under operation conditions of a nitrogen ambience and hot air temperature at an inlet of the dryer, whereby Silver Halide Grain Containing Powdered Organic Silver

TABLE 3

| Light-sensitive MEK Emulsion No. | Dispersion Binder | Emulsion Making Temperature (° C.) | Average Grain Diameter (μm) | Variation Coefficient (%) | Moisture Content (%) | MEK Dispersibility | |
|---|---|---|---|---|---|---|---|
| 1 | gelatin | 45 | 0.06 | 12 | 0.5 | coagulation | Comp. |
| 2 | gelatin | 25 | 0.035 | 21 | 0.5 | coagulation | Comp. |
| 3 | R-1 | 35 | 0.15 | 35 | 0.1 | dispersion | Comp. |
| 4 | R-2 | 35 | 0.06 | 17 | 0.1 | dispersion | Inv. |
| 5 | R-2 | 25 | 0.035 | 15 | 0.1 | dispersion | Inv. |
| 6 | R-2 | 10 | 0.018 | 14 | 0.1 | dispersion | Inv. |
| 7 | R-4 | 10 | 0.019 | 15 | 0.1 | coagulation | Comp. |

Comp.: Comparative Example

Inv.: Present Invention

Salt A-1 was obtained. The moisture content of Silver Halide Grain Containing Powdered Organic Silver Salt A-1 was determined employing an infrared moisture meter. The amount of behenic acid in the resultant Silver Halide Grain Containing Powdered Organic Silver Salt A-1 was quantitatively analyzed employing the analytical method below. The ratio of behenic acid contained in Silver Halide Grain Containing Powdered Organic Silver Salt Particles A-1 was 54 percent by weight. Incidentally, organic acids after mixing were analyzed, resulting in contained heavy metal in an amount of 5 ppm and an iodine value of 1.5.

<Method for Analyzing Organic Silver Salts>

The content ratio of silver behenate was determined as follows. Organic-silver salt in an amount of nearly 10 mg was collected, accurately weighed, and placed into a 200 ml ovoid flask. Subsequently, 15 ml of methanol and 3 ml of 4 mol/L hydrochloric acid were added and the resultant mixture was subjected to ultrasonic homogenization for one minute. Boiling tips made of Teflon (registered trade name) were placed and refluxing was performed over 60 minutes. After cooling, 5 ml of methanol was added onto the cooled material so that those adhered on the cooling pipe were washed into the ovoid flask (this was repeated twice). The resulting reaction liquid was subjected to ethyl acetate extraction (separation was performed twice by adding 100 ml of ethyl acetate and 70 ml of water). Vacuum drying was performed over 30 minutes. Subsequently, 1 ml of a benzanthrone solution (an internal standard) was placed into a 10 ml measuring flask. The sample was dissolved in toluene and adjusted to the specified volume by the addition of toluene. Subsequently, GC was measured and mol percent was determined based on the peak area of each organic acid and the weight percents were then obtained, whereby it was possible to determine the composition of all the organic acids.

Subsequently, free organic acids, which did not form organic acid salts, were quantitatively analyzed. An organic silver salt in an amount of nearly 20 mg was collected and accurately weighed. Subsequently, 10 ml of methanol was added. Thereafter, the resultant mixture was subjected to ultrasonic homogenization over one minute and then filtered. The resultant filtrate was evaporated to dryness to extract free organic acids. In the same manner as the case for total organic acids, it is possible to find the composition of the free organic acids as well as the ratio to the total organic acids via measurement employing GC. The value obtained by subtracting the weight of free organic acids from the weight of the tonal organic acids was designated as the weight of organic acids existing as organic liver salts.

(Preparation of Non-Silver Halide Particle Containing Powdered Organic Silver Salt A-2)

Non-Silver Halide Particle Containing Powdered Organic Silver Salt A-2 was prepared in the same manner as above Silver Halide Grain Containing Powdered Organic Silver Salt A-1, except that Silver Halide Emulsion 1 was replaced with water in the same amount. The ratio of silver behenate in above Non-Silver Halide Grain Containing Powdered Organic Silver Salt A-2 was 55 percent by weight.

<<Preparation of Light-sensitive Emulsion Dispersion A-1>>

Preliminary Dispersion A-1 was prepared in such a manner that 26.26 g of polyvinyl butyral (Butvar B-79, produced by Monsanto Co.) as a dispersion binder was dissolved in 2,000 g of methyl ethyl ketone, and while stirring the resultant solution employing Dissolver DISPERMAT Type CA-40M produced by VMA-GETZMANN Co., 500 g of above Silver Halide Grain Containing Powdered Organic Silver Salt A-1 was gradually and sufficiently mixed.

The above Preliminary Dispersion A-1 was fed by employing a pump to media type homogenizer DISPERMAT Type SL-C12EX (produced by VMA-GETZMANN Co.) filling 80 percent of the interior volume with 0.5 mm diameter zirconia beads (Toraycerum, produced by Toray Industries, Inc.) so that the retention time in the mill reached 1.5 minutes and dispersion was carried out at mill peripheral speed of 8 m/second, whereby Light-sensitive Emulsion Dispersion A-1 was prepared.

<<Preparation of Light-sensitive Emulsion Dispersion A-2>>

Light-sensitive Emulsion Dispersion A-2 was prepared in the same manner as above Light-sensitive Emulsion Dispersion A-1, except that Silver Halide Grain Containing Powdered Organic Silver Salt A-1 was replaced with Silver Halide Grain Containing Powdered Organic Silver Salt.

<<Preparation of Light-sensitive Emulsion Dispersion A-3>>

Preliminary Dispersion A-3 was prepared in such a manner that 26.26 g of polyvinyl butyral (Butvar B-79) as a dispersion binder was dissolved in 2,000 g of methyl ethyl ketone, and while stirring the resultant solution employing Dissolver DISPERMAT Type CA-40M produced by VMA-GETZMANN Co., 250 g of above Non-Silver Halide Grain Containing Powdered Organic Silver Salt A-2 was gradually added, and in addition, 12.5 g of Light-sensitive MEK Emulsion was gradually added and mixed.

The above Preliminary Dispersion A-3 was fed, employing a pump, to media type homogenizer DISPERMAT Type SL-C12EX (produced by VMA-GETZMANN Co.) filling 80 percent of the interior volume with 0.5 mm diameter zirconia beads (Toraycerum, produced by Toray Industries, Inc.) so that the retention time in the mill reached 1.5 minutes and dispersion was carried out at mill peripheral speed of 8 m/second, whereby Light-sensitive Emulsion Dispersion A-3 was prepared.

<<Preparation of Light-sensitive Emulsion Dispersion A-4>>

Preliminary Dispersion A-4 was prepared in such a manner that 26.26 g of polyvinyl butyral (Butvar B779) as a dispersion binder was dissolved in 2,000 g of methyl ethyl ketone, and while stirring the resultant solution employing Dissolver DISPERMAT Type CA-40M produced by VMA-GETZMANN Co., 250 g of above Non-Silver Halide Grain Containing Powdered Organic Silver Salt A-2 was gradually added and in addition, 12.5 g of Light-sensitive MEK Emulsion 6 was gradually added and then mixed.

Above Preliminary Dispersion A-4 was fed, employing a pump, to media type homogenizer DISPERMAT Type SL-C12EX (produced by VMA-GETZMANN Co.) filling 80 percent of the interior volume with 0.5 mm diameter zirconia beads (Toraycerum, produced by Toray Industries, Inc.) so that the retention time in the mill reached 1.5 minutes and dispersion was carried out at mill peripheral speed of 8 m/second, whereby Light-sensitive Emulsion Dispersion A-4 was prepared.

<<Preparation of Supports>>

After-applying corona discharge treatment of 0.5 k·V·A·minute/$m^2$ onto one side surface of a 175 μm thick polyethylene terephthalate blue tinted film at a density of 0.170, Sublayer "a" was applied onto the above surface employing Liquid Subbing Coating Composition A, described below, to result in a coated layer thickness of 0.2 μm. Further, after applying corona discharge treatment of 0.5 kV·A·minute/$m^2$ onto the other surface, Sublayer "b" was applied onto the above surface employing Liquid Subbing Coating Composition B, described below, to result in a coated layer thickness of 0.1 μm. Thereafter, thermal treatment was performed at 130° C. for 15 minutes in a heat processing type oven fitted with a film conveying device composed of a plurality of grouped rollers.

(Sublayer Liquid Coating Composition A)

Initially, 270 g of a copolymer latex liquid composition (solids 30 percent) of butyl acrylate/t-butyl acrylate/styrene/2-hydroxyethyl acrylate (30/20/25/25 in percent), 0.6 g of surface Active Agent (YL-1), and 0.5 g of methylcellulose were blended. Further, a dispersion was added which was prepared in such a manner that 1.3 g of silica particles (Siloid 350, produced by Fuji Silysia Chemical Ltd.) was added to 100 g of water and the resultant mixture was dispersed for 30 minutes employing an ultrasonic homogenizer (Ultrasonic Generator at a frequency of 25 kHz and 600 W), produced by ALEX Corporation. The resultant mixture was made to 1,000 ml by the addition of water, and was designated as Subbing Liquid Coating Composition A.

(Sublayer Liquid Coating Composition B)

Blended were 37.5 g of the colloidal tin oxide dispersion, 3.7 g of a copolymer latex liquid composition (solids 30 percent) of butyl acrylate/t-butyl acrylate/styrene/2-hydroxyethyl acrylate (20/30/25/25 in percent), 14.8 g of a copolymer latex liquid composition (solids 30 percent) of butyl acrylate/styrene/glycidyl methacrylate (40/20/40 in percent), and 0.1 g of Surface Active Agent (UL-1). The resultant mixture was made to 1,000 ml by the addition of water, and designated as Subbing Liquid Coating Composition B.

A solution was prepared by dissolving 65 g of stannic chloride hydrate in 2,000 ml of a water/ethanol mixture solution. Subsequently, the resultant solution was boiled to form co-precipitates. The resultant precipitates were collected employing decantation and washed several times with distilled water. Subsequently, a silver nitrate solution was dripped into the distilled water which was used to wash the precipitates, and it was confirmed that chloride ions did not undergo reaction. Thereafter, distilled water was added to the washed precipitates and the total volume was made to 2,000 ml. Further, 40 ml of 30 percent ammonia water and the resultant mixture was concentrated by evaporation so that the volume reached 470 ml, whereby a colloidal tin oxide dispersion was prepared.

UL-1

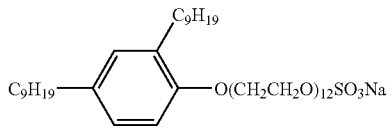

<<Preparation of Sample 101>>

A heat developable light-sensitive material, Sample 101, was prepared following the steps below.

(Coating onto Reverse Surface)

While stirring, added to 830 g of methyl ethyl ketone were 84.2 g of cellulose acetate butyrate (CAB 381-20, produced by Eastman Kodak Co.) and 4.5 g of a polyester resin (Vitel PE2200B, produced by Bostic Co.) and were dissolved. Subsequently, 0.30 g of Infrared Dye 1, 4.5 g of Fluorine-based Surface Active Agent-1, and 1.5 g of a fluorine-based surface active agent (Eftop EF-105, produced by Jecom Co.), and the resultant mixture was vigorously stirred until everything was dissolved. Finally, while stirring, 75 g of silica particles (Cilysia 450, produced by Fuji Silysia Chemical Ltd.), which was dispersed into methyl ethyl ketone at a concentration of 1 percent, was added, employing a dissolver type homogenizer, whereby a back surface liquid coating composition was prepared.

Fluorine-based Surface Active Agent-1: $C_9F_{17}O(CH_2CH_2O)_{22}C_9F_{16}$

Subsequently, the prepared back surface liquid coating composition was applied, employing an extrusion coater, onto the surface of Subbing Layer "b" subbed onto the aforesaid support to result in a dried layer thickness of 3.5 μm, and subsequently dried. Drying was performed over a period of 5 minutes employing a drying air flow at a drying temperature of 100° C. and a dew point of 10° C.

Infrared Dye 1

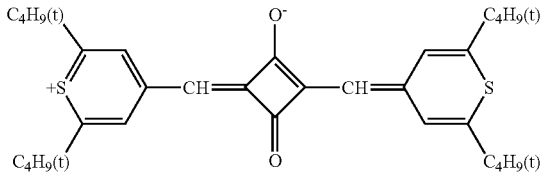

(Coating onto Light-sensitive Layer Side)

(Preparation of Each Additive Solution)

<Preparation of Stabilizer Solution>

A stabilizer solution was prepared by dissolving 0.31 g of potassium acetate in 4.97 g of methanol.

<Preparation of Infrared Sensitizing Dye Solution A>

Infrared Sensitizing Dye Solution A was prepared by dissolving 19.2 g of Infrared Sensitizing Dye-1, 488 g of 2-chlorobenzoic acid, 2.779 g of Stabilizer-2, and 365 mg of 5-methyl-2-mercaptobenzimidazole in 31.3 ml of methyl ethyl ketone in a dark environment.

<Preparation of Additive Solution "a">

Additive-Solution "a" was prepared by dissolving 27.98 g of 1,1-bis(2-hydroxy-3,5-dimethylphenyl)-3,5,5-trimethylhexane (hereinafter referred to as Reducing Agent A) as a developing agent), 1.54 g of 4-methylphthalic acid, and 0.48 g of aforesaid Infrared Dye 1 in 110 g of methyl ethyl ketone.

<Preparation of Additive Solution "b">

Additive Solution "b" was prepared by dissolving 3.56 g of Antifogging Agent-2 and 3.43 g of phthalazine in 40.9 g of methyl ethyl ketone.

(Preparation of Light-sensitive Layer Liquid Coating Composition A-1)

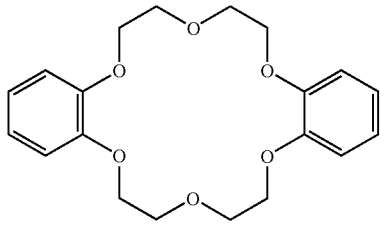

Stabilizer-2

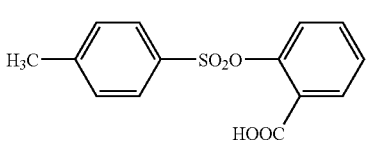

Infrared Sensitizing Dye-1

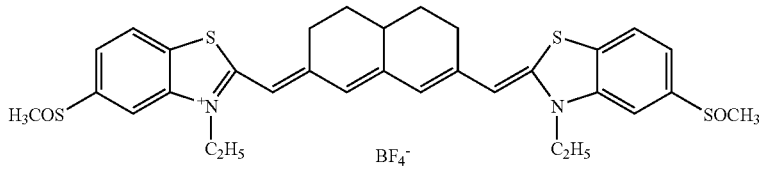

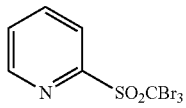

Antifogging Agent-2

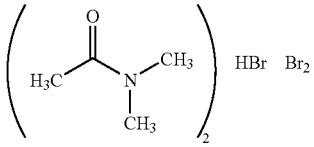

(Preparation of Light-sensitive Layer Liquid Coating Composition A-2)

Under an ambience of inactive gas (97 percent nitrogen), while stirring, a mixture consisting of 50 g of aforesaid Light-sensitive Emulsion Dispersion A-3 and 15.11 g of methyl ethyl ketone was maintained at 21° C., and 390 μl of Antifogging Agent-1 (a 10 percent methanol solution) was added and stirred over one hour. Further, 494 μl of calcium bromide (a 10 percent methanol solution) was added and stirred over 20 minutes. Subsequently, 167 μl of a stabilizer solution was added and stirred over 10 minutes. Thereafter, 1.32 g of aforesaid Infrared Sensitizing Dye Solution A was added and stirred over one hour. Then, the temperature was lowered to 13° C., and stirring was performed for an additional 30 minutes. While maintaining the temperature at 13° C., 13.31 g of polyvinyl butyral (Butvar B-79), as a binder resin, was added and stirred over 30 minutes. Thereafter, 1.084 g of tetrachlorophthalic acid (a 9.4 percent by weight methyl ethyl ketone solution), and stirring was performed for 15 minutes. Further, upon continuing stirring, 12.43 g of Additive Solution "a", 1.6 ml of Desmodur N3300 (a 10 percent methyl ethyl ketone solution of aliphatic isocyanate, produced by Mobay Co.), 4.27 g of Additive Solution "b" were successively added and stirred, whereby Light-sensitive Layer Liquid Coating Composition A-2 was obtained.

(Preparation of Light-sensitive Layer Liquid Coating Composition A-3)

Under an ambience of inactive gas (97 percent nitrogen), while stirring, a mixture consisting of 50 g of aforesaid Light-sensitive Emulsion Dispersion A-4 and 15.11 g, of methyl ethyl ketone was maintained at 21° C., and 390 μl of Antifogging Agent-1 (a 10 percent methanol solution) was added and stirred over one hour. Further, 494 μl of calcium bromide (a 10 percent methanol solution) was added and stirred over 20 minutes. Subsequently, 167 μl of a stabilizer solution was added and stirred over 10 minutes. Thereafter, 1.32 g of aforesaid Infrared Sensitizing Dye Solution A was added and stirred over one hour. Thereafter, the temperature was lowered to 13° C., and stirring was performed for an additional 30 minutes. While maintaining the temperature at 13° C., 13.31 g of polyvinyl butyral (Butvar B-79) as a binder resin was added and stirred for 30 minutes. Thereafter, 1.084 g of tetrachlorophthalic acid (a 9.4 percent by weight methyl ethyl ketone solution), and stirring was performed for 15 minutes. Further, under continuing stirring, 12.43 g of Additive Solution "a", 1.6 ml of Desmodur N3300 (a 10 percent methyl ethyl-ketone solution of aliphatic isocyanate, produced by Mobay Co.), and 4.27 g of Additive Solution "b" were successively added and stirred, whereby Light-sensitive Layer Liquid Coating Composition A-3 was obtained.

(Preparation of Light-sensitive Layer Liquid Coating Composition A-4)

Under an ambience of inactive gas (97 percent nitrogen), while stirring, a mixture consisting of 50 g of aforesaid Light-sensitive Emulsion Dispersion A-2, 10 g of aforesaid Light-sensitive MEK Silver Emulsion 6, and 5.11 g of methyl ethyl ketone was maintained at 21° C., and 390 μl of Antifogging Agent-1 (a 10 percent methanol solution) was added and stirred over one hour. Further, 494 μl of calcium bromide (a 10 percent methanol solution) was added and stirred over 20 minutes. Subsequently, 167 μl of a stabilizer solution was added and stirred over 10 minutes. Thereafter, 1.32 g of aforesaid Infrared Sensitizing Dye Solution A was added and stirred over one hour. Thereafter, the temperature was lowered to 13° C., and stirring was performed for an additional 30 minutes. While maintaining the temperature at 13° C., 13.31 g of polyvinyl butyral (Butvar B-79), as a binder resin, was added and stirred over 30 minutes. Thereafter, 1.084 g of tetrachlorophthalic acid (a 9.4 percent by weight methyl ethyl ketone solution), and stirring was performed over 15 minutes. Further, under continuing stirring, 12.43 g of Additive Solution "a", 1.6 ml of Desmodur N3300 (a 10 percent methyl ethyl ketone solution of aliphatic isocyanate, produced by Mobay Co.), 4.27 g of Additive Solution "b" were successively added and stirred, whereby Light-sensitive Layer Liquid Coating Composition A-4 was obtained.

(Preparation of Light-sensitive Layer Liquid Coating Composition A-5)

Under an ambience of inactive gas (97 percent nitrogen), while stirring, 50 g of aforesaid Light-sensitive Emulsion Dispersion A-2 and 5.11 g of methyl ethyl ketone was maintained at 21° C., and 390 μl of Antifogging Agent-1 (a 10 percent methanol solution) was added and stirred over one hour. Further, 494 μl of calcium bromide (a 10 percent methanol solution) was added and stirred over 20 minutes. Subsequently, 167 μl of a stabilizer solution was added and stirred over 10 minutes. Thereafter, 1.32 g of aforesaid Infrared Sensitizing Dye Solution A was added and stirred over one hour. Thereafter, the temperature was lowered to 13° C., and stirring was performed for an additional 30 minutes. While maintaining the temperature at 13° C., 13.31 g of polyvinyl butyral (Butvar B-79), as a binder resin, was added and stirred over 30 minutes. Thereafter, 1.084 g of tetrachlorophthalic acid (a 9.4 percent by weight methyl ethyl ketone solution) and 10 g of aforesaid Light-sensitive MEK Silver Emulsion was added and stirring was performed over 15 minutes. Further, under continuing stirring, 12.43 g of Additive Solution "a", 1.6 ml of Desmodur N3300 (a 10 percent methyl ethyl ketone solution of aliphatic isocyanate, produced by Mobay Co.), and 4.27 g of Additive Solution "b" were successively added and stirred, whereby Light-sensitive Layer Liquid Coating Composition A-5 was obtained.

(Preparation of Light-sensitive Layer Liquid Coating Composition A-6)

Under an ambience of inactive gas (97 percent nitrogen), while stirring, 50 g of aforesaid Light-sensitive Emulsion Dispersion A-2 and 5.11 g of methyl ethyl ketone was maintained at 21° C., and 390 μl of Antifogging Agent-1 (a 10 percent methanol solution) was added and stirred over one hour. Further, 494 μl of calcium bromide (a 10 percent methanol solution) was added and stirred over 20 minutes. Subsequently, 167 μl of a stabilizer solution was added and stirred over 10 minutes. Thereafter, 1.32 g of aforesaid Infrared Sensitizing Dye Solution A was added and stirred over one hour. Thereafter, the temperature was lowered to 13° C., and stirring was performed for an additional 30 minutes. While maintaining the temperature at 13° C., 13.31 g of polyvinyl butyral (Butvar B-79), as a binder resin was added and stirred over 30 minutes. Thereafter, 1.084 g of tetrachlorophthalic acid (a 9.4 percent by weight methyl ethyl ketone solution) was added and stirring was performed over 15 minutes. Further, under continuing stirring, 12.43 g of Additive Solution "a", 1.6 ml of Desmodur N3300 (a 10 percent methyl ethyl ketone solution of aliphatic isocyanate, produced by Mobay Co.), and 4.27 g of Additive Solution "b" were successively added. Thereafter, 10 g of aforesaid Light-sensitive MEK Emulsion 6 was added and stirred, whereby Light-sensitive Layer Liquid Coating Composition A-6 was obtained.

(Preparation of Surface Protective Layer Liquid Coating Composition)

While stirring, 96 g of cellulose acetate butyrate (CBA 171-15, described above), 4.5 g of polymethyl methacrylic acid (Paraloid A-21, produced by Rohm & Haas Co.), 1.0 g of benzotriazole, and 1.0 g of a fluorine based surface active agent (Eftop EF-105, produced by Jemco Co.) were added to and dissolved in 865 g of methyl ethyl ketone. Subsequently, 30 g of the matting agent dispersion described below was added while stirring, whereby a surface protective layer liquid coating composition was prepared.

<Preparation of Matting Agent Dispersion>

Dissolved in 42.5 g of MEK was 7.5 g of cellulose acetate butyrate (CAB 171-15, produced by. Eastman Chemical Co.). Added to the resulting solution was 5 g of silica particles (Cilysia 320, produced by Fuji Silysia Chemical Ltd.), and the resultant mixture was dispersed at 8,000 rpm for 30 minutes, employing a dissolver type homogenizer, whereby a matting agent dispersion was prepared.

(Coating)

Light-sensitive Layer Liquid Coating Composition A-1 and the surface protective layer liquid coating composition were simultaneously coated employing a prior art extrusion type coater. Coating was performed so that the light-sensitive layer resulted in a coated silver weight of 1.7 g/m$^2$ and the surface protective layer resulted in a dried layer thickness of 2.5 μm. Thereafter, drying was performed employing drying air flow at a drying temperature of 75° C. and a dew point of 10° C., whereby Sample 101 was prepared.

<<Preparation of Samples 102–106>>

Samples 102–106 were prepared in the same manner as above Sample 101, except that Light-sensitive Layer Liquid Coating Composition A-1 was replaced with each of A-2-A-6.

<<Evaluation of Heat Developable Light-Sensitive Materials>>

Various types of evaluations were performed for Samples 101–106 prepared as above based on the methods below.

(Exposure and Photographic Processing)

The light-sensitive layer coated side of each Sample prepared as above was subjected to laser scanning exposure via an optical wedge, employing an exposure device in which a semiconductor laser which was subjected to longitudinal multi-mode of wavelengths of 800–820 nm at high frequency superposition was employed as a laser beam source. During this exposure, an image was formed, at an angle between the exposed surface of a sample and the exposure laser beam of 75 degrees. In this case, compared to the aforesaid angle of 90 degrees, images were obtained which exhibited minimized unevenness and unexpectedly excellent sharpness.

Thereafter, employing an automatic processor fitted with the heat drum and the cooling zone shown in FIG. 1, development was carried out under a state in which the protective layer of the sample was brought into contact with the drum surface. At the same time, exposure and development were performed at 23° C. and 50 percent relative humidity.

(Determination of Photographic Speed, Fog Density, and Maximum Density)

The resultant silver image density composed of wedge gradations was determined employing a densitometer and a characteristic curve was prepared in which the ordinate represented silver image density (D) and the abscissa represented logarithm (LogE) of the exposure amount (E).

In this characteristic curve, the inverse of the ratio of the exposure amount which was required to result in a density which was 0.1 higher than the minimum density (fog density) was defined as photographic speed. In addition, minimum density (fog density) as well as maximum density was determined. Incidentally, the photographic speed as well as the maximum density was represented as a relative value when the photographic speed and the maximum density of Sample 101 were 100. Table 3 shows the results.

(Evaluation of Dispersibility in Coatings)

With regard to each coating sample, the degree of dispersion of light-sensitive silver-halide grains of a grain diameter of 0.005–0.1 μm, which was determined from the exposure direction of light-sensitive materials, was determined employing the above method.

Namely, ultra-thin flakes of a thickness of 0.1–0.2 μm were prepared employing a diamond knife. The resultant ultra-thin flake was held employing a copper mesh and transferred onto a carbon membrane, which had been made hydrophilic employing glow discharge. Thereafter, while cooling to at most −130° C., the bright field image of the ultra-thin flake was observed at a magnification of 5,000–40,000, employing a transmission type electron microscope (hereinafter referred to as TEM) and quickly imaged by a camera. An ultra-thin collodion organic membrane was used as a carbon membrane. The accelerating voltage of TEM was set at 150 kV. The recorded TEM image, decomposed to 2,048×2048 pixels per image was subjected to image processing employing a computer, and a histogram was prepared. Subsequently, locations (cells) corresponding to silver halide were extracted employing binarization processing. Subsequently, the equivalent circular diameter (HEYWOOD) of the extracted cell was obtained. At least rondo 500 particles of an equivalent circular diameter of 0.005–0.1 μm, and preferably at least 1,000 particles of the same were extracted and the following values were determined. Average values and the standard deviation were calculated and the degree of dispersion was obtained.

TABLE 4

| | Fog | Photographic Speed | Maximum Density | Degree of Dispersion of Light-Sensitive Silver Halide (%) | Remarks |
|---|---|---|---|---|---|
| 101 | 0.18 | 100 | 100 | 90 | Comp. |
| 102 | 0.177 | 105 | 106 | 85 | Comp. |
| 103 | 0.177 | 110 | 150 | 75 | Inv. |
| 104 | 0.17 | 111 | 160 | 74 | Inv. |
| 105 | 0.165 | 112 | 165 | 75 | Inv. |
| 106 | 0.16 | 113 | 165 | 77 | Inv. |

Comp.: Comparative Example

As can clearly be seen from Table 4, the heat developable light-sensitive materials of the present invention resulted in lower fog and suitable outputted images for diagnoses even though the photographic speed and the maximum density were nearly equal to, or better than, those of the comparative examples.

What is claimed is:

1. A photothermographic imaging material comprising a support having thereon a photosensitive layer comprising photosensitive silver halide grains, light-insensitive organic silver salt grains, a reducing agent for silver ions and a polymer, wherein an average particle size of the photosensitive silver halide grains is 0.005 to 0.1 μm, and the polymer dissolves both in water and in an organic solvent.

2. The photothermographic imaging material of claim 1, wherein the photosensitive silver halide grains contain AgBr in an amount of not less than 50 weight % based on the total weight of the photosensitive silver halide grains.

3. The photothermographic imaging material of claim 1, wherein the polymer has a solubility in water at 25° C. of not less than 1 weight %, and the polymer has a solubility in methyl ethyl ketone at 25° C. of not less than 5 weight %.

4. The photothermographic imaging material of claim 1, wherein the polymer has a molecular weight of 3000 to 200000.

5. The photothermographic imaging material of claim 1, wherein the polymer contains a group represented by the following formula:

$$-(EO)_l-(PO)_m-(TO)_n-R$$

wherein E is an ethylene group; P is a propylene group; T is a butylene group; R is a substituent; l is an integer of 1 to 300; m is an integer of 0 to 60; and n is an integer of 0 to 40, provided that $l+m+n \geqq 2$.

6. The photothermographic imaging material of claim 1, wherein the polymer has an amide group in the molecule.

7. The photothermographic imaging material of claim 1, wherein the polymer contains a group selected from the group consisting of a straight chain or branched chain alkyl group having 4 to 22 carbon atoms, an aryl group and a heterocylic group having a ring size of not less than 5.

8. The photothermographic imaging material of claim 1, wherein the polymer has an isoelectric point in water at 25° C. of not more than pH 6.

9. The photothermographic imaging material of claim 1, wherein the polymer has an carboxyl group in the molecule.

10. The photothermographic imaging material of claim 1, wherein a variation coefficient in a size of the photosensitive silver halide grains is from 0 to 30%.

11. The photothermographic imaging material of claim 1, wherein a dispersion degree of the photosensitive silver halide grains is not more than 80%.

* * * * *